US006126346A

United States Patent [19]

Hibino et al.

[11] Patent Number: 6,126,346

[45] Date of Patent: Oct. 3, 2000

[54] SERIAL HEAD TYPE RECORDER

[75] Inventors: Kiyoshi Hibino, Gifu; Mitsuaki Kurokawa, Motosu-Gun; Yoshinori Senoh, Anpachi-Gun, all of Japan

[73] Assignee: Sanyo Electric Co., Ltd., Osaka-fu, Japan

[21] Appl. No.: 08/917,217

[22] Filed: Aug. 25, 1997

[30] Foreign Application Priority Data

Aug. 26, 1996 [JP] Japan ..... 8-224131
Oct. 31, 1996 [JP] Japan ..... 8-289941

[51] Int. Cl.[7] ..... B41J 13/02

[52] U.S. Cl. ..... 400/636; 400/659

[58] Field of Search ..... 400/582, 634, 400/636, 636.2, 618, 659

[56] References Cited

U.S. PATENT DOCUMENTS 5,169,136 12/1992 Yamagata et al. ..... 400/636.2
5,169,250 12/1992 Tsuru et al. ..... 400/636.2
5,529,414 6/1996 Kaano et al. ..... 400/636.2
5,594,486 1/1997 Kiyohara ..... 400/363.2

*Primary Examiner*—John S. Hilten
*Attorney, Agent, or Firm*—Arent, Fox, Kintner, Plotkin & Kahn

[57] ABSTRACT

A number-of-pulses correction value corresponding to non-uniformity in conveyance appearing during one circulation of a conveying roller is held in a number-of-pulses correction value storing section 32. A control section 33 produces the target number of pulses (a real number) in the printing position at the destination of one line feed on the basis of the number-of-pulses correction value, and the target number of pulses (a real number) in the printing position at the destination of the line feed is changed into an integer, and the pulses whose number is an integer are fed to a pulse motor 11, to control the amount of rotation of the pulse motor 11. Further, the control section 33 corrects the target number of pulses in the printing position at the current time point in correspondence to the fact that the pulses whose number is not a real number but an integer are fed to the motor. Consequently, it is possible to reduce the occurrence of non-uniformity in a pitch between lines.

5 Claims, 39 Drawing Sheets

$A \cdot \pi \cdot n = B$ n is natural number

| index i , j | correction value H |
|---|---|
| 0 | 0 |
| 1 | −1.2345 |
| 2 | +0.0012 |
| ⋮ | ⋮ |
| 29 | −4.1234 |
| 30 | +5.6789 |
| 31 | −3.4567 |

| index | L (displacement) | H (correction) |
|---|---|---|
| 0 | 0 | 0 |
| 1 | 128 | H(1) |
| ⋮ | ⋮ | ⋮ |
| 34 | 4352 | H(34) |
| 35 | 4480 | H(35) |
| 36 | 4608 | H(36) |

SERIAL HEAD TYPE RECORDER

BACKGROUND OF THE INVENTION

1. Field of the Invention

The present invention relates to a serial head type recorder using a serial head.

2. Description of the Prior Art

FIG. 34 is a perspective view showing a principal part of a serial head type recorder, and FIG. 35 is an illustration showing a printing mechanism. A paper conveying section 501 comprises a conveying roller 501*a* and a pinch roller 501*b*. The pinch roller 501*b* and the conveying roller 501*a* are provided in an opposite arrangement, to convey a paper sheet 510 with the paper sheet 510 interposed therebetween. A platen 502 is arranged in the vicinity of the paper conveying section 501. A paper feeding roller 508 feeds the leading end of the paper sheet 510 to the paper conveying section 501. A pulse motor 511 (not shown in FIG. 34. See FIG. 36) is rotated through a predetermined angle in response to the number of pulses. A group of gears 503 transmits torque produced by the pulse motor 511 to the conveying roller 501*a* and the paper feeding roller 508. A serial head 504 does printing on the paper sheet 510, which is of a thermal type, for example. A head supporting member 515 for supporting the serial head 504 is mounted on a carriage 505. An ink ribbon cassette 506 is set in the carriage 505. A shaft 507 guides the carriage 505 in transverse direction (cross the direction of paper carriage at right angle) of the paper sheet. The paper sheet is put on a paper feeding plate 512.

The paper sheet 510 is positioned between the serial head 504 and the platen 502. An ink ribbon 506*a* of the ink ribbon cassette 506 is interposed between the paper sheet 510 and the serial head 504. The serial head 504 and the ink ribbon cassette 506 are moved leftward (in the direction of carriage scanning) in FIG. 35. The ink ribbon 506*a* is wound around a winding-side roll 506*c* upon being delivered from a feeding-side roll 506*b*. After one line is printed, the conveying roller 501*a* is driven, so that the paper sheet 510 is moved by its line feed width (that is, a line feed operation is performed).

FIG. 37 is a schematic view showing how printing of three lines and approximately one-third of the subsequent line is done on the paper sheet 510 by the above-mentioned printing principle.

A color printer can be also constructed using the above-mentioned serial head by preparing ink ribbons in colors such as yellow (Y), magenta (M), and cyan (C) or preparing an ink ribbon on which colors such as yellow (Y), magenta (M) and cyan (C) are printed in this order. Formation of a color image in such a color printer can be realized by first printing one scanning and recording line by the ink ribbon in yellow (Y), then printing a scanning and recording line over the above-mentioned scanning and recording line by the ink ribbon in magenta (M), and further printing a scanning and recording line over the above-mentioned scanning and recording line by the ink ribbon in cyan (C), to form one color scanning and recording line, and repeating the printing of the color scanning and recording line.

FIG. 36 is a perspective view showing a conventional paper conveying mechanism. A driving force produced by the pulse motor 511 is respectively transmitted to the conveying roller 501*a* and the paper feeding roller 508 through a first transmission gear system 531 and a second transmission gear system 532 in the group of gears 503. A paper feeding gear 532*a* in the second transmission gear system 532 and the paper feeding roller 508 are directly connected to each other.

In the serial head type recorder, non-uniformity in a pitch between lines printed presents a problem. For example, if the amount of conveyance of the paper sheet 510 is larger than the line feed width (the printing width of the serial head 504), a clearance occurs between the lines, as shown in FIG. 38. On the other hand, if it is smaller, images are undesirably overlapped with each other, so that the density of only a portion where the images are overlapped with each other is increased, and the images are degraded because dots do not coincide with each other. FIG. 38 is a schematic view. In a sublimation type printer, an ink layer as shown in FIG. 38 is not seen.

The non-uniformity in a pitch between lines is caused by the non-uniformity in conveyance of a paper sheet in a paper conveying system. The causes of the non-uniformity in conveyance are (1) eccentricity of the conveying roller 501*a* and gears, and (2) the load of a paper sheet from the exterior.

The above-mentioned item (1) will be considered. FIG. 39 is an illustration showing the relationship between non-uniformity in conveyance and deviation between lines. S denotes the target amount of conveyance, and L denotes the actual amount of conveyance. The difference between S and L is non-uniformity in conveyance (F=L−S). Letting G be a line feed width, a clearance between the 0-th line and the first line is L1−(L0+G). L0=S0+F0, L1=S1+F1, and G=S1−S0, whereby the clearance is represented by F1−F0. FIG. 40 is a graph showing the relationship between the number of pulses fed to a motor and the amount of paper feeding, where a solid line indicates the ideal amount of feeding (no non-uniformity in conveyance), and a dotted line indicates the actual amount of feeding (non-uniformity in conveyance).

In order to solve the problem described in the above-mentioned item (1), an attempt to employ a high-precision gear and a high-precision roller has been made. Even in such a case, however, non-uniformity in conveyance of approximately 65±$\mu$m occurs. In a high-resolution printer and a color printer, therefore, only the employment of such a method is insufficient as a countermeasure of the non-uniformity in a pitch between lines. A method of intentionally overlapping dots on the preceding line in the case of a line feed operation to prevent the occurrence of a clearance between lines has been known. Such a method is effective to a certain extent in a melt type color printer. In the sublimation type color printer, however, when dots are thus overlapped with each other, an image of good quality is not obtained unless the amount of deviation in overlapping of dots is changed from zero to not more than approximately 30 $\mu$m in the direction of overlapping.

The load described in the item (2) will be then considered. Examples of the load applied to the paper sheet 510 include a load caused by the paper feeding roller 508, a frictional force produced between paper sheets stocked in the paper feeding plate 512 and a paper sheet which is being printed, and a frictional force with a guide portion on a paper path. The largest one of them is the load caused by the paper feeding roller 508. The load caused by the paper feeding roller 508 is not produced if the peripheral speed thereof (Vf: see FIG. 36) is made entirely equal to the peripheral speed of the conveying roller 501*a* (Vc: see FIG. 36), which is actually difficult. There is slack in conveyance in the paper sheet 510 in the case of Vf>Vc, while the above-mentioned load, that is, a force for the conveying roller 508 to return the paper sheet 510 is produced in the case of Vf<Vc.

Conventionally, a contact state between the paper sheet 510 and the paper feeding roller 508 has been maintained until the leading end of the paper sheet 510 is detected by a sensor (not shown) through the paper feeding section 501, as shown in FIG. 41A, while the contact state between the paper sheet 510 and the paper feeding roller 508 has been released upon swinging the paper feeding plate 512 downward, as shown in FIG. 41B. An example of a mechanism for swinging and driving the paper feeding plate 512 is a mechanism comprising a spring, a push-down cam, and a electromagnetic clutch for controlling the push-down cam.

FIG. 42 is a flow chart showing the contents of control in a recorder having the above-mentioned swing-type paper feeding plate. The paper feeding plate 512 is first swung upward, to form the contact state between the paper sheet 510 and the paper feeding roller 508 (step 521). The pulse motor 511 is then driven, to rotate the paper feeding roller 508 and the conveying roller 501*a* (step 522). It is judged whether or not the leading end of the paper sheet 510 is detected (step 523). If the leading end of the paper sheet 510 is detected, the driving of the pulse motor 511 is stopped (step 524), and the paper feeding plate 512 is swung downward to release the contact state (step 525). One line is printed in three colors (step 526), it is judged whether or not printing of all lines is terminated (step 527), a paper discharging operation is performed if the printing of all lines is terminated (step 528), and a line feed operation is performed if the printing of all lines is not terminated (step 529), after which the program proceeds to the step 526.

The other prior art has been also known. FIG. 43 is a perspective view showing the other conventional paper conveying mechanism. A driving force produced by a pulse motor 511 is respectively transmitted to a conveying roller 501*a* and a paper feeding roller 508 through a first transmission gear system 531 and a second transmission gear system 532 in a group of gears 503. A paper feeding gear 532*a* in the second transmission gear system 532 and the paper feeding roller 508 are connected to each other through a spring clutch 513. A spring cylindrical portion of the spring clutch 513 is fitted in a shaft portion 508*a* of the paper feeding roller 508, and one end of the spring clutch 513 is fastened to the paper feeding gear 532*a*. In a state where the rotational speed of the paper feeding gear 532*a* exceeds the rotational speed of the paper feeding roller 508, the spring clutch 513 is strongly fastened to the shaft portion 508*a*, to feed the driving force to the paper feeding roller 508. On the other hand, in a state where the rotational speed of the paper feeding gear 532*a* is below the rotational speed of the paper feeding roller 508, a fastening force to the shaft portion 508*a* is weakened, to allow the free rotation of the paper feeding roller 508.

The ratio of gears in the group of gears 503, for example, is so set that the peripheral speed Vf of the paper feeding roller 508<the peripheral speed Vc of the conveying roller 501*a*.

FIG. 44 is a flow chart showing the contents of control at the time of printing in a recorder comprising the above-mentioned paper conveying mechanism. Part of operations (states) which are not control operations are described, and are denoted by S'. The driving of the pulse motor 511 is first started, to rotate the paper feeding roller 508 and the conveying roller 501*a* (step 531). The speed relationship therebetween is the peripheral speed Vf of the paper feeding roller 508<the peripheral speed Vc of the conveying roller 501*a* (S'532), as described above. This state is maintained until the leading end of the paper sheet 510 is interposed between the conveying roller 501*a* and the pinch roller 501*b* (S'532, S'533).

When the leading end of the paper sheet 510 is interposed between the conveying roller 501*a* and the pinch roller 501*b*, the paper sheet 510 is conveyed at the peripheral speed Vc of the conveying roller 501*a* and the paper feeding roller 508 is rotated at the peripheral speed Vc upon being dragged by the friction of the paper sheet 510. Consequently, the rotational speed of the paper feeding gear 532*a* is below the rotational speed of the paper feeding roller 508, so that a fastening force to the shaft portion 508*a* is weakened. Therefore, the paper feeding roller 508 is rotated by the movement of the paper sheet 510 upon permission of the free rotation of the paper feeding roller 508, so that paper feeding roller 508 and the conveying roller 501*a* are rotated at an equal peripheral speed (S'533, S'534).

It is then judged whether or not the leading end of the paper sheet 510 is detected (step 535). If the leading end of the paper sheet 510 is detected, the pulse motor 511 is stopped (step 536). One line is printed in three colors (step 537), and it is judged whether or not printing of all lines is terminated (step 538). If the printing of all lines is terminated, a paper discharging operation is performed (step 539). On the other hand, if the printing of all lines is not terminated, a line feed operation is performed (step 540). When the trailing end of the paper sheet 510 deviates from the paper feeding roller 508, the paper sheet 510 is conveyed only by the conveying roller 501*a* (S'541, S'542). Before the trailing end of the paper sheet 510 deviates from the paper feeding roller 508, a state where the paper feeding roller 508 and the conveying roller 501*a* are rotated at an equal peripheral speed is maintained (S'541, S'543).

In the above-mentioned conventional structure in which the paper feeding plate 512 is swung, the load at the time of printing (at the time of a line feed operation) can be almost eliminated. However, a swinging and driving mechanism is required, making the structure complicated, so that the cost is comparatively high. Further, time required for a swinging operation increases time required for printing.

In the conventional structure in which the spring clutch 513 is used, the paper feeding roller 508 is rotated by the movement of the paper sheet 510 upon permission of the free rotation of the paper feeding roller 508. Therefore, the load applied to the conveying roller 501*a* is reduced. However, such a coupled driven operation itself will be a certain degree of load. Moreover, sliding friction between the shaft portion 508*a* and the spring clutch 513 increases the load in the case of the coupled driven operation, whereby a slip, that is, non-uniformity in conveyance is liable to occur at the time of a line feed operation of the paper sheet 510 by the conveying roller 501*a*. In experiments, a slip of several hundred micrometers in width occurs with respect to a line feed width of 17 mm, so that the image quality cannot be sufficiently improved.

The present invention has been made in view of the above-mentioned circumstances and has for its object to provide a serial head type recorder capable of reducing non-uniformity in conveyance to improve the image quality.

SUMMARY OF THE INVENTION

A serial head type recorder according to the present invention is a serial head type recorder comprising a conveying roller for conveying a paper sheet, a motor rotated through a predetermined angle in response to the number of pulses, a group of gears for transmitting torque produced by the motor to the conveying roller, and a serial head for doing printing on the paper sheet, being characterized in that the amount of feeding in accordance with one line feed of the paper sheet by the conveying roller is set to an integral multiple of the length of the circumference of the conveying roller, and the width of the serial head is set to not less than the amount of feeding.

As a result, even if the conveying roller is not co-axial, the paper sheet is conveyed by an amount corresponding to the length of the circumference of the conveying roller when the conveying roller is rotated integral times. That is, the amount of feeding corresponding to one line feed of the paper sheet by the conveying roller is set to an integral multiple of the length of the circumference of the conveying roller, so that a line feed width in a line feed operation performed by the conveying roller can be made constant. When the width of the serial head coincides with the amount of feeding, no overlapping printing is done. On the other hand, when the width of the serial head is larger than the amount of feeding by one dot, for example, overlapping printing is done by one dot in adjacent lines.

The speed reducing ratio of at least a gear directly connected to the conveying roller to a gear engaged therewith in the group of gears may be a ratio of integers. Consequently, small non-uniformity in conveyance caused by at least the gear directly connected to the conveying roller and the gear engaged therewith regularly occurs for each circulation of the conveying roller, whereby the line feed width in the line feed operation performed by the conveying roller can be made constant without being affected by the non-uniformity in conveyance.

A serial head type recorder according to the present invention is a serial head type recorder comprising a conveying roller for conveying a paper sheet, a motor rotated through a predetermined angle in response to the number of pulses, a group of gears for transmitting torque produced by the motor to the conveying roller, and a serial head for doing printing on the paper sheet, being characterized by further comprising storing means for storing data relating to the amount of rotation of the motor fed for each line feed from a reference position on the basis of non-uniformity in conveyance in the line feed so that the non-uniformity in conveyance is reduced, rotation control means for controlling the rotation of the motor on the basis of the data, and reverse rotation control means for rotating the motor in the reverse direction by the total amount of rotation for all line feeds every time printing on one paper sheet is terminated.

In such construction, a clearance between lines, for example, can be eliminated in printing on one paper sheet by the rotation control means for controlling the rotation of the motor on the basis of the data. Data relating to the amount of rotation of the motor is fed from the reference position. If printing of the succeeding line is done as it is after the printing on one paper sheet, therefore, the data is useless for the printing of the succeeding line. Every time the printing on one paper sheet is terminated, the motor is rotated in the reverse direction by the total amount of rotation corresponding to all line feeds, to ensure the reference position.

A serial head type recorder according to the present invention is a serial head type recorder comprising a conveying roller for conveying a paper sheet, a motor rotated through a predetermined angle in response to the number of pulses, a group of gears for transmitting torque produced by the motor to the conveying roller, and a serial head for doing printing on the paper sheet, being characterized in that the speed reducing ratio of at least a gear directly connected to the conveying roller to a gear engaged therewith in the group of gears is set to a ratio of integers, being characterized by comprising storing means for storing a number-of-pulses correction value corresponding to the target number of pulses fed for each of a plurality of partitions obtained in dividing the circumference of the conveying roller on the basis of non-uniformity in conveyance for the partition so that the non-uniformity in conveyance is reduced, means for adding the number of pulses, which is a real number, corresponding to one line feed to the target number of pulses, which is a real number, in the printing position at the current time point to calculate the target number of pulses, which is a real number, representing the amount of feeding of the paper sheet at the destination of the line feed, and adding the target number of pulses, which is a real number, representing the amount of feeding of the paper sheet at the destination of the line feed and the number-of-pulses correction value in the partition corresponding to the target number of pulses to calculate the number of feed pulses, which is a real number, forming the basis of the number of pulses, whose number is an integer, fed to the motor, means for calculating the number of pulses corresponding to the line feed from the number of feed pulses which is a real number, changing the calculated number of pulses into an integer, and feeding the pulses whose number is an integer to the motor, and means for correcting the target number of pulses at the destination of the line feed in correspondence to the fact that the pulses whose number is not a real number but an integer are fed to the motor.

In such construction, the speed reducing ratio of at least the gear directly connected to the conveying roller to the gear engaged therewith is set to a ratio of integers, whereby the non-uniformity in conveyance corresponding to the ratio of integers periodically appears during one circulation of the conveying roller. Since the number-of-pulses correction value corresponding to the non-uniformity in conveyance is held, and the rotation of the motor is controlled on the basis of the correction value, the non-uniformity in conveyance can be almost eliminated. Further, there is provided means for correcting the target number of pulses in the printing position at the current time point in correspondence to the fact that the pulses whose number is not a real number but an integer are fed to the motor, whereby an error produced by feeding the pulses whose number is not a real number but an integer to the motor is almost eliminated.

A serial head type recorder according to the present invention is a serial head type recorder comprising a conveying roller for conveying a paper sheet, a motor rotated through a predetermined angle in response to the number of pulses, a group of gears for transmitting torque produced by the motor to the conveying roller, and a serial head for doing printing on the paper sheet, being characterized in that the speed reducing ratio of at least a gear directly connected to the conveying roller to a gear engaged therewith in the group of gears is set to a ratio of integers, and by further comprising storing means for storing a number-of-pulses correction value corresponding to the number of feed pulses fed for each of a plurality of partitions obtained in dividing the circumference of the conveying roller on the basis of non-uniformity in conveyance for the partition so that the non-uniformity in conveyance is reduced, means for acquiring the target number of pulses, which is a real number, in the printing position at the current time point by adding the number of feed pulses in the printing position at the current time point and the number-of-pulses correction value in the partition corresponding to the number of feed pulses, means for acquiring the target number of pulses, which is a real number, representing the amount of feeding of the paper sheet at the destination of one line feed by adding the target number of pulses in the printing position at the current time point and the number of pulses, which is a real number, corresponding to the line feed, means for acquiring the number of feed pulses, which is a real number, representing the amount of feeding of the paper sheet at the destination of the line feed upon obtaining the number-of-pulses correction value corresponding to the number of feed pulses using the target number of pulses, which is a real number, representing the amount of feeding of the paper sheet at the destination of the line feed in place of the number of feed pulses, means for subtracting the number of feed pulses in the printing position at the current time point from the number of feed pulses, which is a real number, representing the amount of feeding of the paper sheet at the destination of the line feed, to calculate the number of pulses, which is a real number, corresponding to the line feed by considering the error, and means for changing the number of pulses, which is a real number, corresponding to the line feed into an integer and feeding the pulses whose number is an integer to the motor.

Even in such construction, the rotation of the motor is controlled on the basis of the number-of-pulses correction value, whereby the non-uniformity in conveyance can be almost eliminated.

A serial head type recorder according to the present invention is a serial head type recorder comprising a conveying roller for conveying a paper sheet, a motor rotated through a predetermined angle in response to the number of pulses, a group of gears for transmitting torque produced by the motor to the conveying roller, and a serial head for doing printing on the paper sheet, being characterized in that the speed reducing ratio of at least a gear directly connected to the conveying roller to a gear engaged therewith in the group of gears is set to a ratio of integers, and by further comprising storing means for storing a number-of-pulses correction value corresponding to the number of feed pulses fed for each of a plurality of partitions obtained in dividing the circumference of the conveying roller on the basis of non-uniformity in conveyance for the partition so that the non-uniformity in conveyance is reduced, means for acquiring the target number of pulses, which is a real number, in the printing position at the current time point by adding the number of feed pulses in the printing position at the current time point and the number-of-pulses correction value in the partition corresponding to the number of feed pulses, means for adding the number of pulses, which is a real number, corresponding to a defined line feed to the number of feed pulses in the printing position at the current time point, to calculate the number of feed pulses, which is a real number, representing the amount of feeding of the paper sheet at the destination of a temporary line feed, means for adding the number of feed pulses, which is a real number, representing the amount of feeding of the paper sheet at the destination of the temporary line feed to the number-of-pulses correction value in the partition corresponding to said number of feed pulses, to calculate the target number of pulses at the destination of the temporary line feed, means for subtracting the target number of pulses in the printing position at the present time point from the target number of pulses at the destination of the temporary line feed, to calculate the number of pulses, which is a real number, corresponding to the temporary line feed, means for subtracting the number of pulses, which is a real number, corresponding to the defined line feed from the number of pulses, which is a real number, corresponding to the temporary line feed, to calculate an error, means for calculating the corrected number of pulses, which is a real number, corresponding to the line feed by adding the error, and means for changing the corrected number of pulses which is a real number into an integer and feeding the pulses whose number is an integer to the motor.

Even in such construction, the rotation of the motor is controlled on the basis of the number-of-pulses correction value, whereby the non-uniformity in conveyance can be almost eliminated.

A serial head type recorder according to the present invention is a serial head type recorder comprising a paper conveying roller section comprising a conveying roller for conveying a paper sheet and a pinch roller provided opposite to the conveying roller for interposing the paper sheet between the pinch roller and the conveying roller, a serial head for doing printing on the paper sheet, a paper feeding plate on which the paper sheet is put, a paper feeding roller for feeding the paper sheet upon abutting against the paper sheet put on the paper feeding plate, a motor for producing a driving force, a first transmission gear system for transmitting the driving force to the conveying roller from the motor, and a second transmission gear system for transmitting the driving force to the paper feeding roller from the motor, being characterized in that the roller diameters of the conveying roller and the paper feeding roller and/or the ratio of gears in each of the first transmission gear system and the second transmission gear system are so set that the peripheral speed of the conveying roller is higher than the peripheral speed of the paper feeding roller, the gear in the final stage in the second transmission gear system is provided with a gear-side projection at a predetermined distance from its center of rotation, the paper feeding roller has a roller-side projection protruding in its radial direction provided in its side end, and the roller-side projection is pressed upon abutment of the gear-side projection which circulates against the roller-side projection, so that the paper feeding roller is rotated.

In the above-mentioned construction, in a state where the paper sheet is conveyed only by the paper feeding roller, the gear-side projection abuts against the roller-side projection. Therefore, the roller-side projection is pressed, so that the paper feeding roller is rotated by a force produced by the motor. In a state where the paper sheet stretches over both the paper feeding roller and the paper conveying roller section, the peripheral speed of the conveying roller is higher than the peripheral speed of the paper feeding roller, so that the paper feeding roller is rotated upon being dragged by a frictional force of the paper sheet. That is, the paper feeding roller is rotated by the movement of the paper sheet. Resistance produced by such a coupled driven operation is only rotating resistance produced by a bearing of the paper feeding roller. There is no sliding resistance as in a conventional spring clutch, whereby the load is made significantly light. Consequently, the occurrence of a slip is reduced, so that the non-uniformity in conveyance is reduced. Therefore, the image quality can be improved.

As described in the foregoing, the gear-side projection abuts against the roller-side projection in a state where the paper sheet is conveyed only by the paper feeding roller. However, the roller-side projection circulates at a higher speed than the gear-side projection in a state where the paper sheet is conveyed by both the paper feeding roller and the paper conveying roller section, whereby the roller-side projection can overtake the gear-side projection. When the roller-side projection overtakes the gear-side projection, the free rotation (the coupled driven operation) of the paper feeding roller is prevented, causing an excessive load for the conveying roller.

Therefore, it is desirable that the roller-side projection does not overtake the gear-side projection while the paper sheet is conveyed by both the paper feeding roller and the paper conveying roller section, that is, before a state where the paper sheet is conveyed only by the paper conveying roller section.

For example, letting Lp be the length in the direction of conveyance of the paper sheet, L be the length of a paper path from the paper feeding roller to the paper conveying section, Vc be the peripheral speed of the conveying roller, Df be the diameter of the paper feeding roller, Vf be the peripheral speed of the paper feeding roller in a case where the paper sheet is conveyed only by the paper feeding roller, and π be the ratio of the circumference of circle to its diameter, the following setting is considered:

$$\pi \times Df > (Lp - L) \times (1 - Vf/Vc)$$

The foregoing and other objects, features, aspects and advantages of the present invention will become more apparent from the following detailed description of the present invention when taken in conjunction with the accompanying drawings.

Figure 41A:
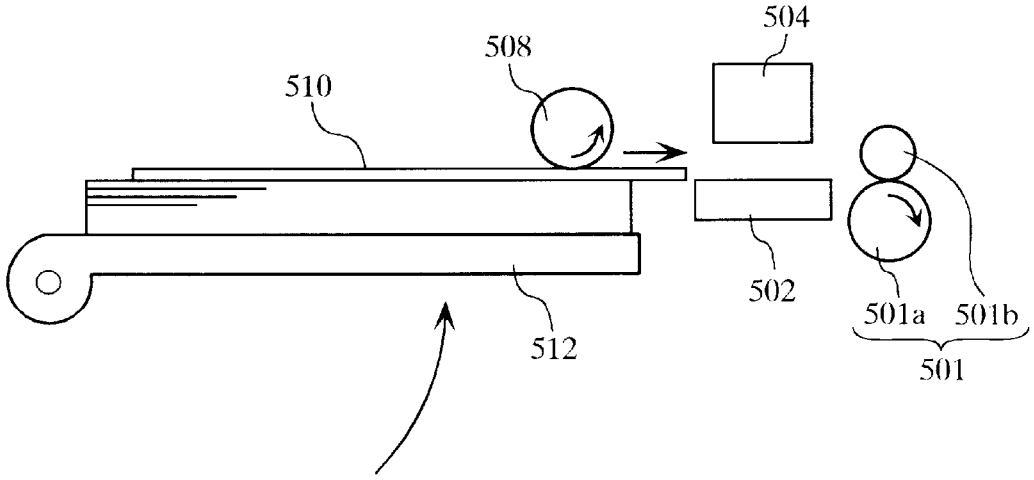
FIG. 41 is a diagram showing a conventional mechanism for preventing a load in conveyance from being produced, where FIG. 41(*a*) illustrates a state where a paper feeding roller is pressed against a paper sheet, and FIG. 41(*b*)
Figure 41B:
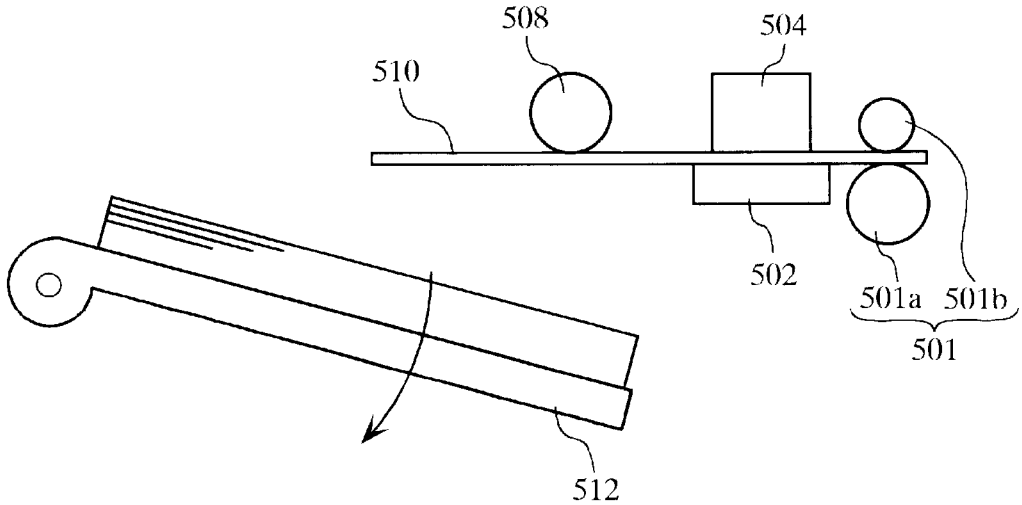
Figure 42:
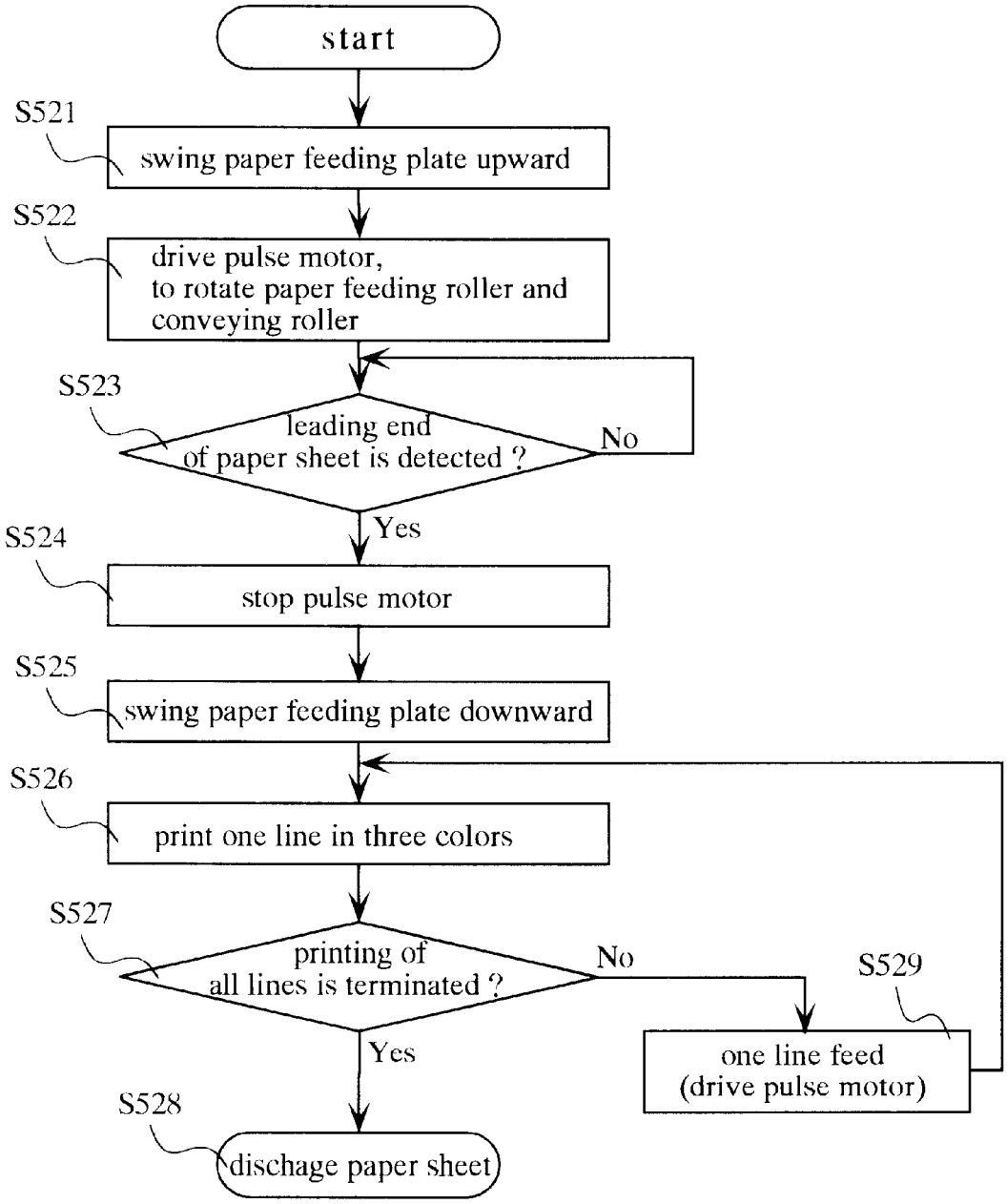
Figure 43:
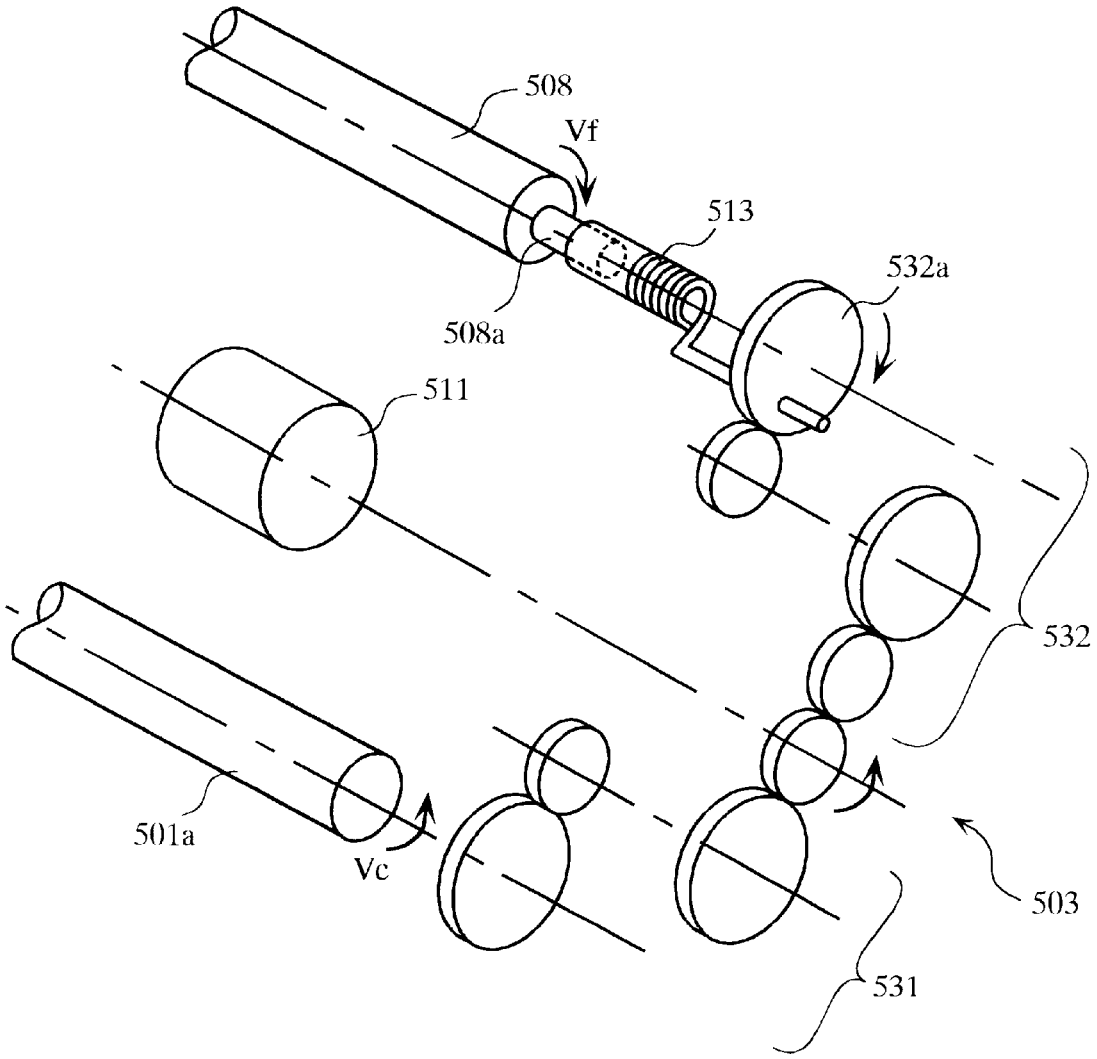
Figure 44:
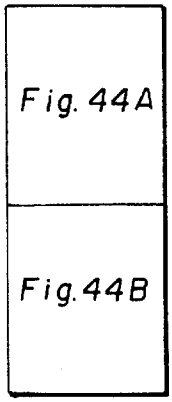
Figure 44A:
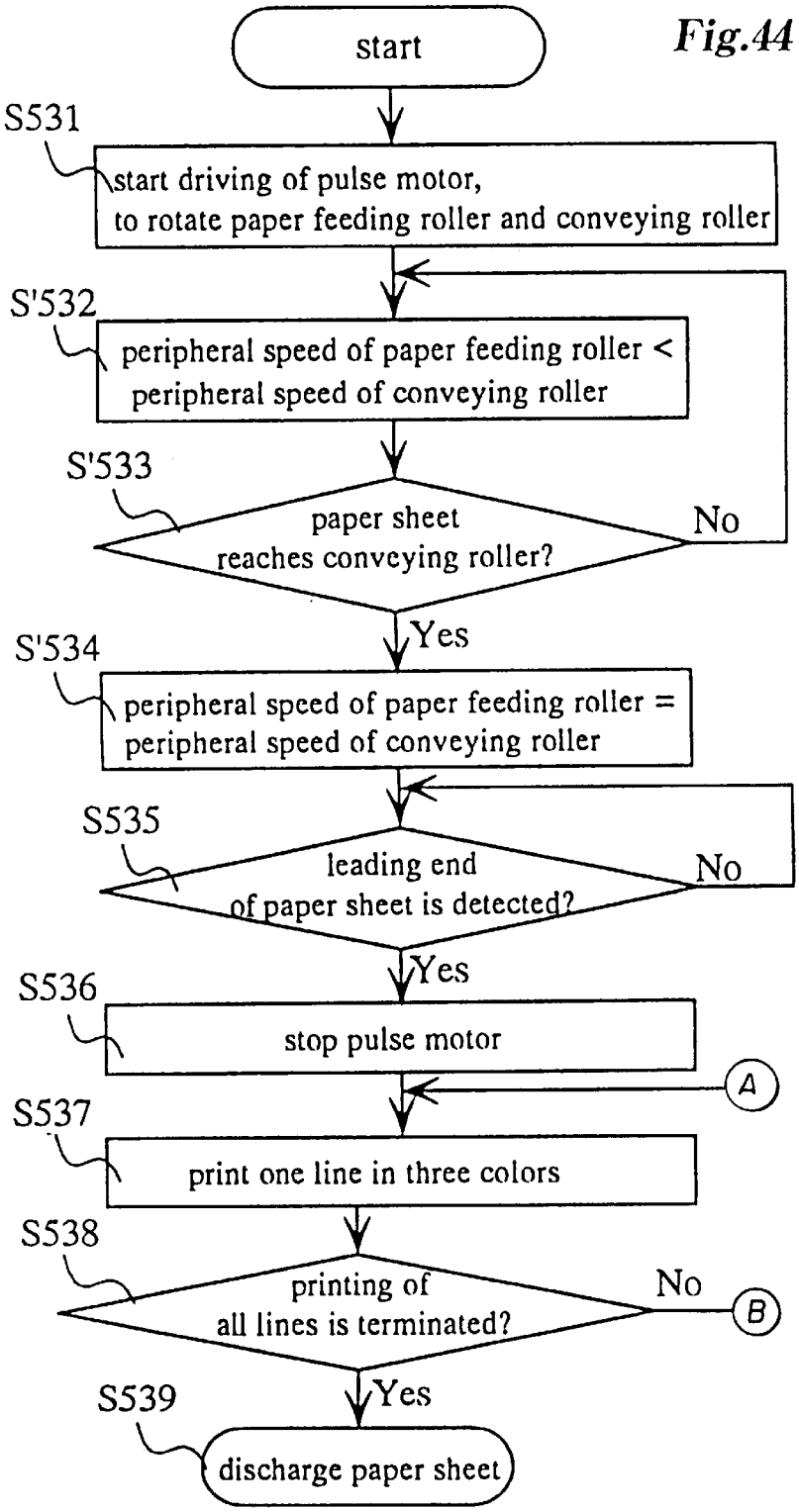
Figure 44B:
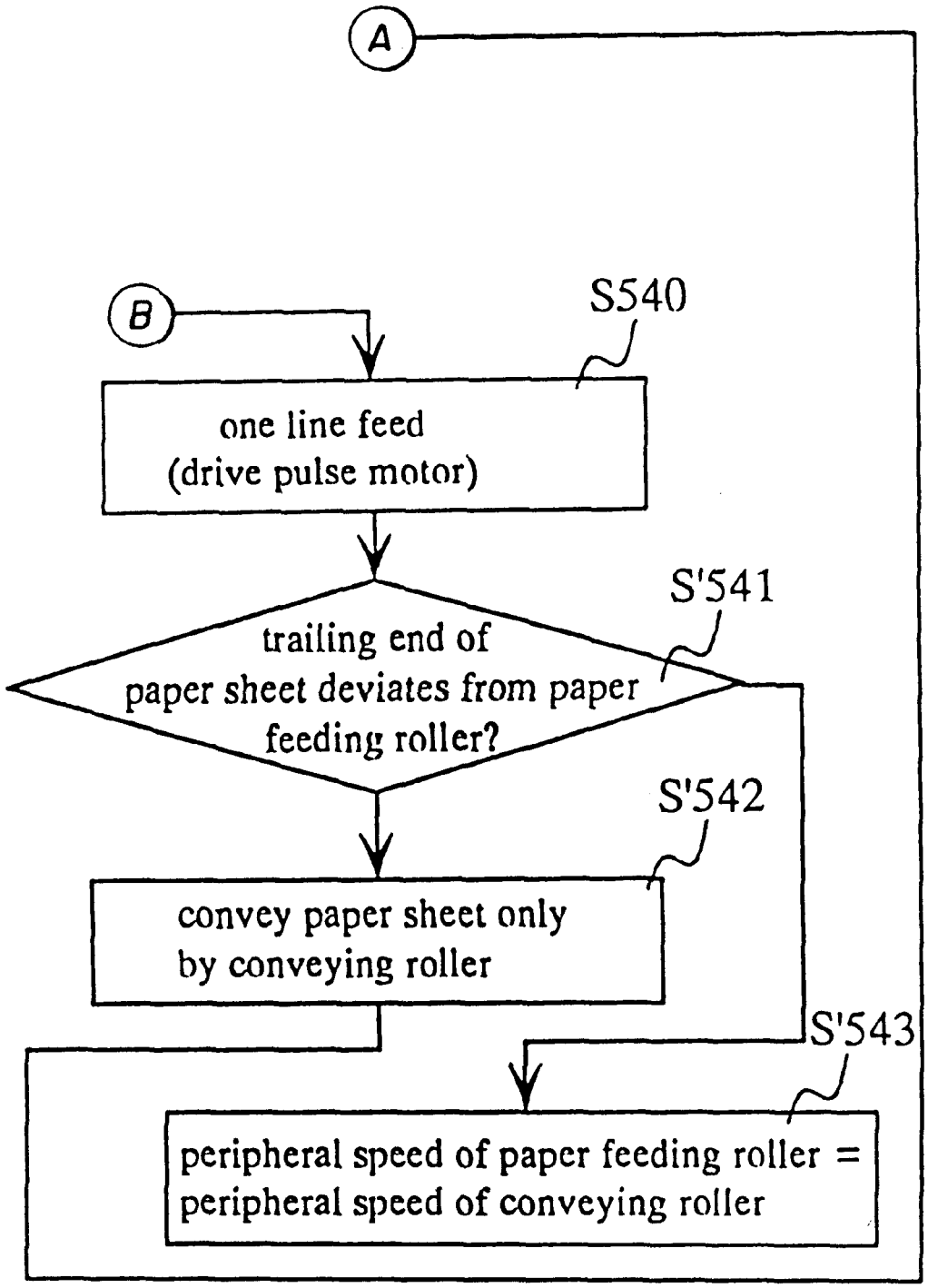

illustrates a state where the paper feeding roller is separated from the paper sheet;

FIG. 42 is a flow chart showing the contents of a printing operation in the conventional construction shown in FIG. 41;

FIG. 43 is a perspective view showing a paper conveying mechanism of another conventional serial head type recorder; and FIG. 44 is a flow chart showing the contents of a printing operation, for example, in the conventional construction shown in FIG. 43.

DESCRIPTION OF THE PREFERRED EMBODIMENTS

Embodiment 1

Figure 1:
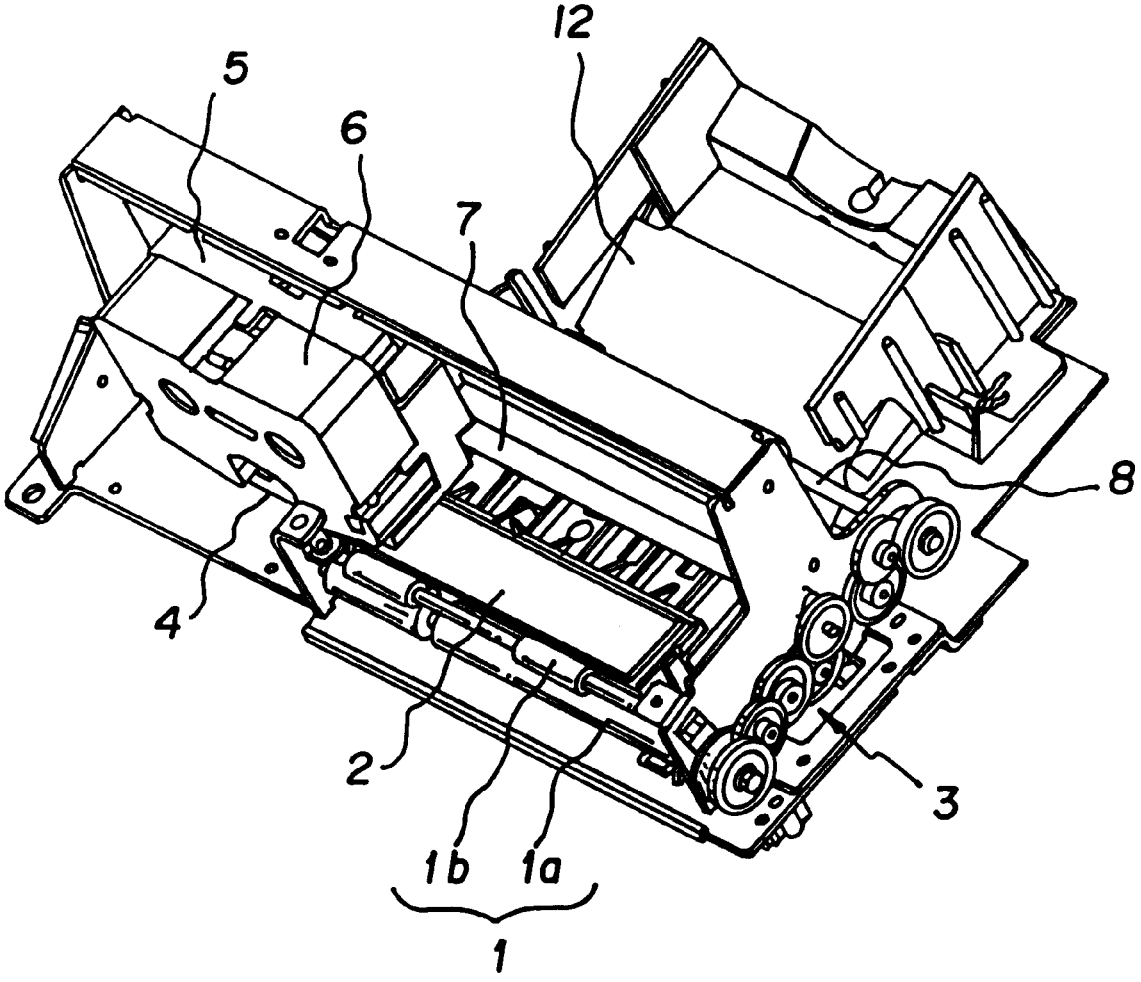
FIG. 1 is a perspective view showing a mechanism of a serial head type recorder according to the present invention.
Figure 2:
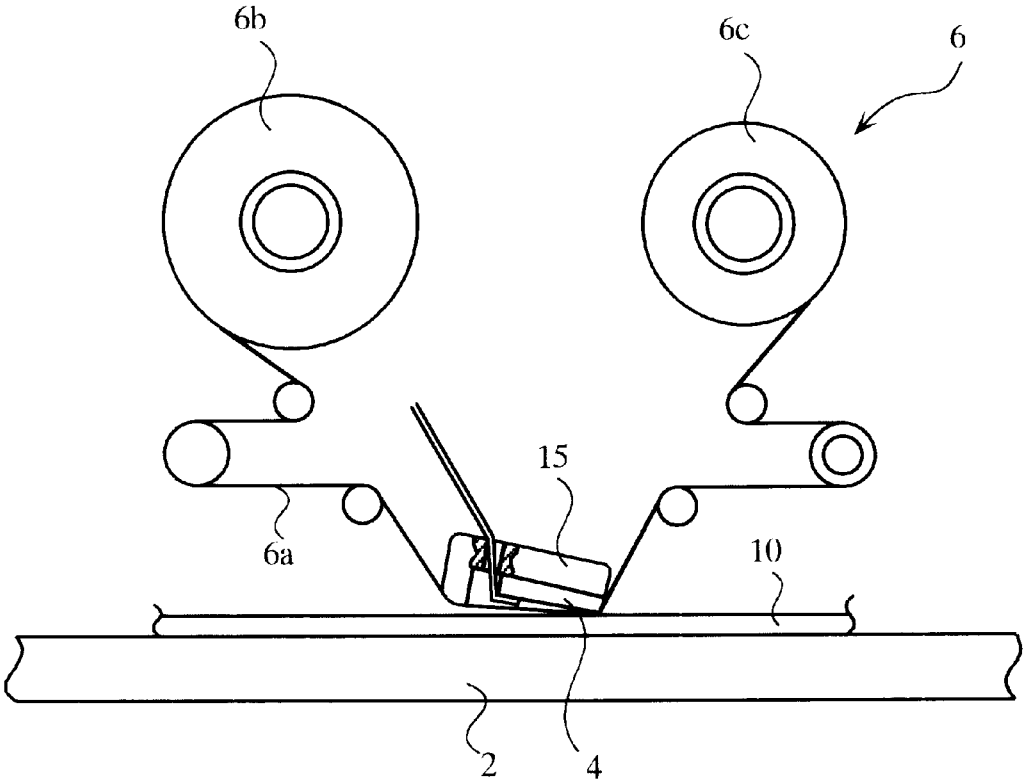
FIG. 2 is a perspective view showing a printing mechanism of the serial head type recorder shown in FIG. 1.
Figure 3:
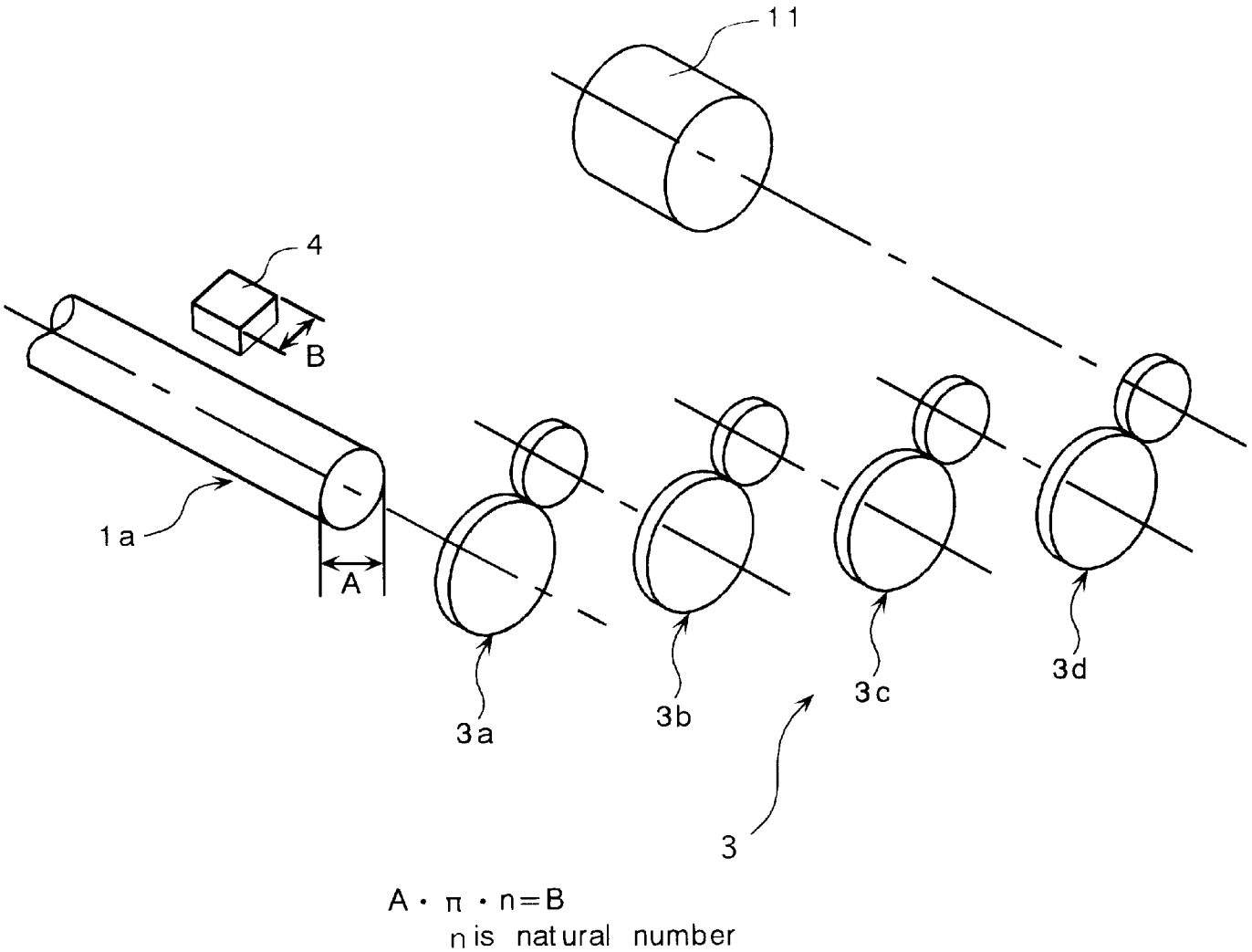
FIG. 3 is a perspective view showing a paper conveying system of a serial head type recorder according to a first embodiment of the present invention.

A first embodiment of the present invention will be described on the basis of the drawings. FIG. 1 is a perspective view showing a principal part of a serial head type recorder, FIG. 2 is an illustration showing a printing mechanism, and FIG. 3 is a perspective view showing a paper conveying mechanism.

A paper feeding section 1 comprises a conveying roller 1*a* and a pinch roller 1*b*. The pinch roller 1*b* and the conveying roller 1*a* are provided in an opposite arrangement, to convey a paper sheet 10 with the paper sheet 10 interposed therebetween. A platen 2 is arranged in the vicinity of the paper conveying section 1. A paper feeding roller 8 feeds the leading end of the paper sheet 10 to the paper conveying section 1. A pulse motor 11 is rotated through a predetermined angle in response to the number of pulses. A group of gears 3 transmits torque produced by the pulse motor 11 to the conveying roller 1*a* and the paper feeding roller 8. A serial head 4 does printing on the paper sheet 10, which is of a thermal type, for example. A head supporting member 15 for supporting the serial head 4 is attached to a carriage 5. An ink ribbon cassette 6 is set in the carriage 5. A shaft 7 guides the carriage 5 along the side of the paper sheet. The paper sheet is put on a paper feeding plate 12.

The paper sheet 10 is positioned between the serial head 4 and the platen 2. An ink ribbon 6*a* of the ink ribbon cassette 6 is interposed between the paper sheet 10 and the serial head 4. The serial head 4 and the ink ribbon cassette 6 are moved leftward (in the direction of carriage scanning) in FIG. 2, so that the ink ribbon 6*a* is delivered from a paper feeding roll 6*b* and is wound around a winding roll 6*c*. When one line is printed, the conveying roller 1*a* is driven, so that the paper sheet 10 is moved by its line feed width (that is, a line feed operation is performed).

The serial head type recorder according to the present embodiment has the relationship indicated by the following first equation, letting A be the roller diameter of the conveying roller 1*a* and B be the head printing width of the serial head 4:

$$A \cdot \pi \cdot n = B \qquad \text{first equation}$$

where n is a natural number

Figure 4:
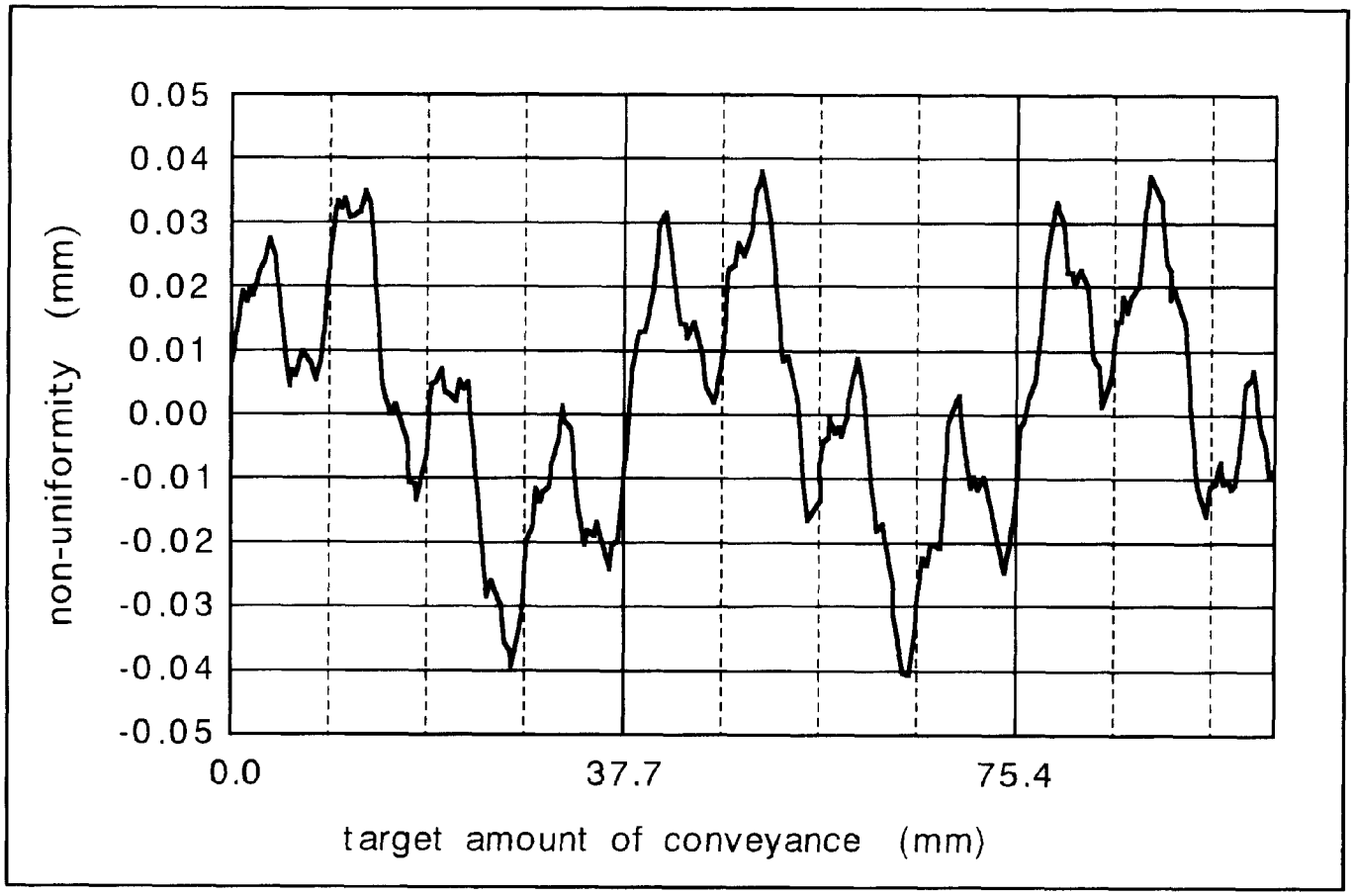
FIG. 4 is a graph showing the non-uniformity in conveyance of a paper sheet.

FIG. 4 is a graph showing the relationship between the target amount of conveyance and non-uniformity in conveyance. As can be seen from the graph, when the length of the circumference of the conveying roller 1*a* is 37.7 mm, non-uniformity in conveyance occurs during one circulation. When the non-uniformity in conveyance is seen at spacing of 37.7 mm which is the length of the circumference of the conveying roller 1*a*, however, it is found that the value of the non-uniformity in conveyance is approximately the same. In the construction of the present embodiment in which the amount of feeding corresponding to one line feed of the paper sheet 10 by the conveying roller 1*a* is taken as 37.7 mm, and the head printing width B is set to 37.7 mm with the value of n taken as 1, for example, a clearance between line feeds is prevented from occurring.

When the head printing width B is made larger by one dot, for example, than 37.7 mm, overlapping printing is done by one dot in adjacent lines. The amount of feeding corresponding to one line feed may be set to not once but an integral multiple of, for example, twice or three times the length of the circumference of the conveying roller 1*a*. It is desirable that the speed reducing ratio of at least a first gear 3*a* directly connected to the conveying roller 1*a* to a small gear of a second gear 3*b* engaged therewith in the group of gears 3 is a ratio of integers. Consequently, small non-uniformity in conveyance caused by such gears regularly occurs for each circulation of the conveying roller 1*a*. Therefore, a line feed width in a line feed operation performed by the conveying roller 1*a* can be made approximately constant without being greatly affected by the non-uniformity in conveyance. It goes without saying that the speed reducing ratio may be a ratio of integers in a third gear 3*c* or a fourth gear 3*d*.

Embodiment 2

Description is now made of another embodiment of the present invention. The construction of a paper conveying system and portions constituting a head are the same as those in the embodiment 1 and hence, the description thereof is not repeated.

Figure 5:
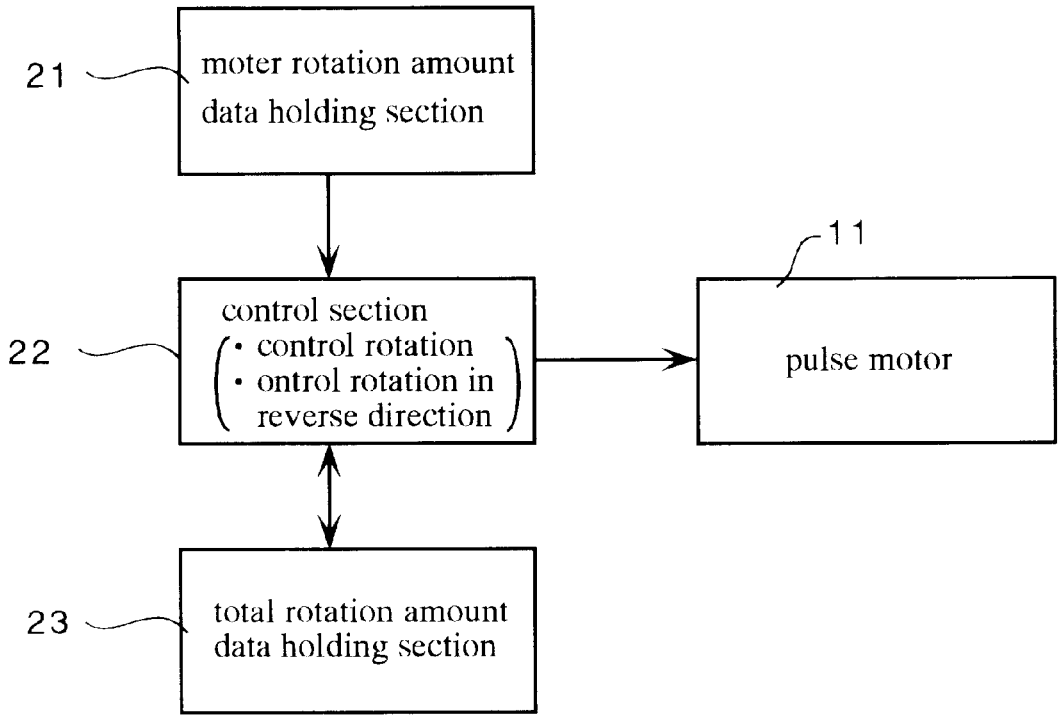
FIG. 5 is a block diagram showing a control system of a serial head type recorder according to a second embodiment of the present invention.

FIG. 5 is a block diagram showing a control system of a serial head type recorder in the embodiment. A motor rotation amount data storing section 21 stores, on the basis of the measurement of the non-uniformity in conveyance of a paper sheet in each line feed, data relating to the amount of rotation of a pulse motor 11 fed for the line feed from a reference position so that the non-uniformity in conveyance is reduced. The above-mentioned measurement and processing for storing the data are carried out in the inspection and shipment stages of products.

A control section 22 controls the rotation of the pulse motor 11 on the basis of the above-mentioned data. The total amount of rotation of the pulse motor 11 is measured, and is stored in a total rotation amount data storing section 23. Further, data relating to the total amount of rotation is read out from the total rotation amount data storing section 23 every time printing on one paper sheet is terminated, to rotate the pulse motor 11 in the reverse direction by the total amount of rotation.

In such construction, the rotation of the pulse motor 11 is controlled on the basis of data found from the measured non-uniformity in conveyance, whereby a clearance between lines, for example, can be eliminated in printing on one paper sheet. The data relating to the amount of rotation of the pulse motor 11 is fed from the reference position. If the subsequent printing is done as it is after the printing on one paper sheet, therefore, the data is useless even in the subsequent printing. Every time the printing on one paper sheet is terminated, therefore, the pulse motor 11 is rotated in the reverse direction by the total amount of rotation for all line feeds. Consequently, the reference position is ensured in the subsequent printing, whereby a clearance between lines, for example, is eliminated even in the subsequent printing.

Embodiment 3

Description is now made of another embodiment of the present invention.

Figure 6:
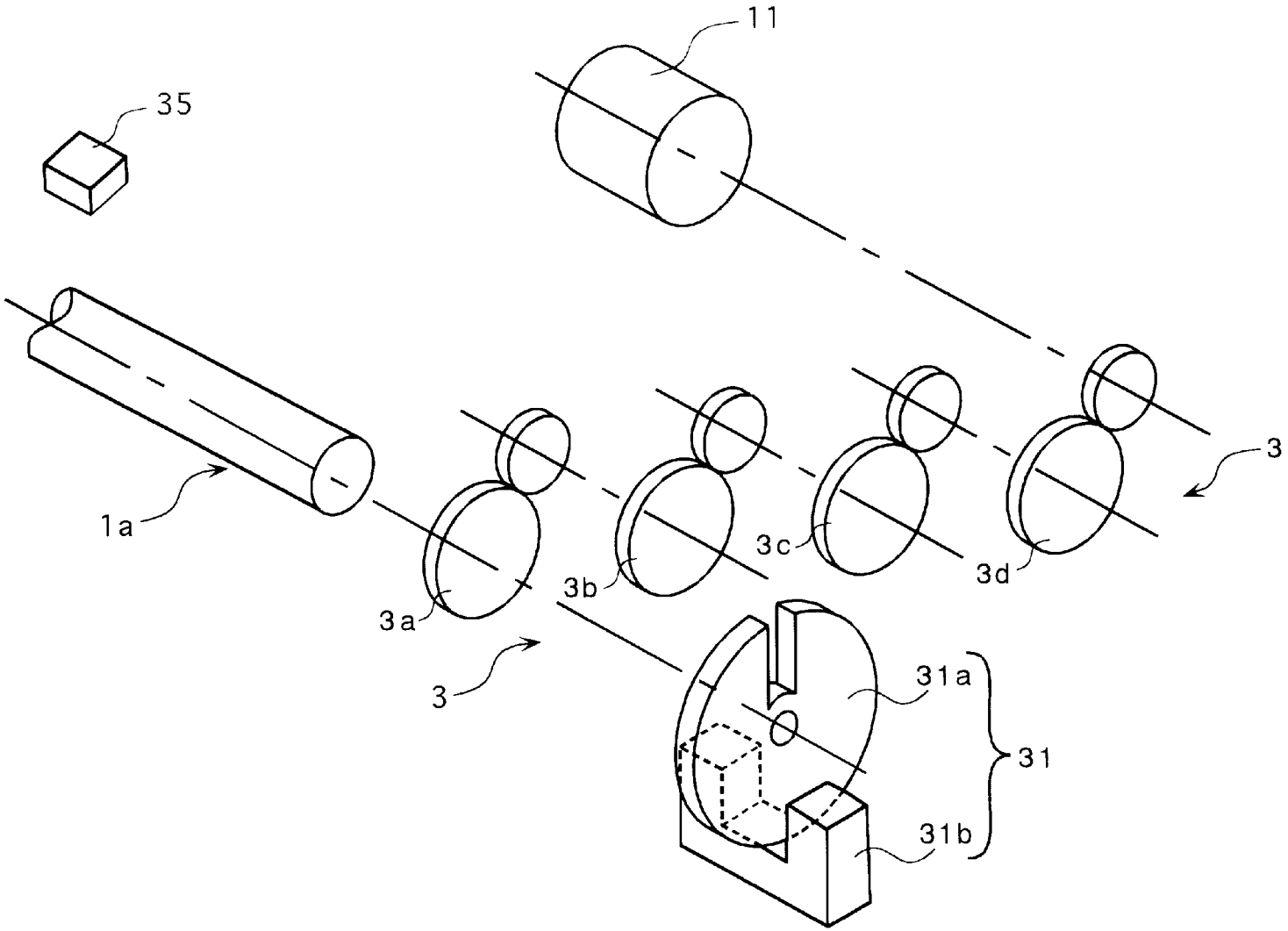
FIG. 6 is a perspective view showing a paper conveying system of a serial head type recorder according to a third embodiment of the present invention.

FIG. 6 is a schematic perspective view showing a conveying roller 1*a*, group of gears 3, a pulse motor 11, a circulation sensor 31 for detecting a reference position of one circulation of the conveying roller 1*a* and a paper sensor 35 which constitute a paper conveying system in the present embodiment. The speed reducing ratio of at least a first gear 3*a* directly connected to the conveying roller 1*a* to a small gear of a second gear 3*b* engaged therewith in the group of gears 3 is a ratio of integers. The circulation sensor 31 comprises a sensor plate portion 31*a* and a plate sensor portion 31*b*. The sensor plate portion 31*a* is composed of a disk member having one notch (a reference position), whose center is positioned on an extension of the central axis of the conveying roller 1*a* and is connected to the conveying roller 1*a* or the first gear 3*a*. When the conveying roller 1*a* is rotated once, therefore, the sensor plate portion 31*a* is rotated once. The plate sensor portion 31*b* reports one circulation of the conveying roller 1*a* by producing a signal when it detects the notch formed in the sensor plate portion 31*a*. The paper sensor 35 detects the leading end of a paper sheet in the printing starting position.

Figures 7, 8:
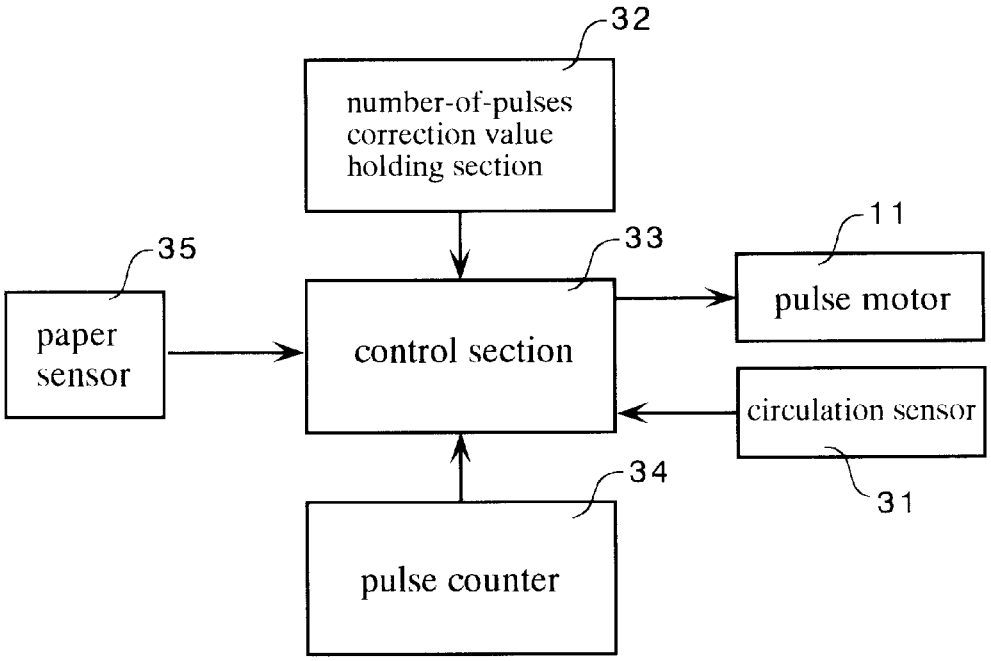
FIG. 7 is a block diagram showing a control system of the serial head type recorder according to the third embodiment of the present invention.
FIG. 8 is an illustration showing the contents of a number-of-pulses correction value storing section in the present invention.
Figure 9:
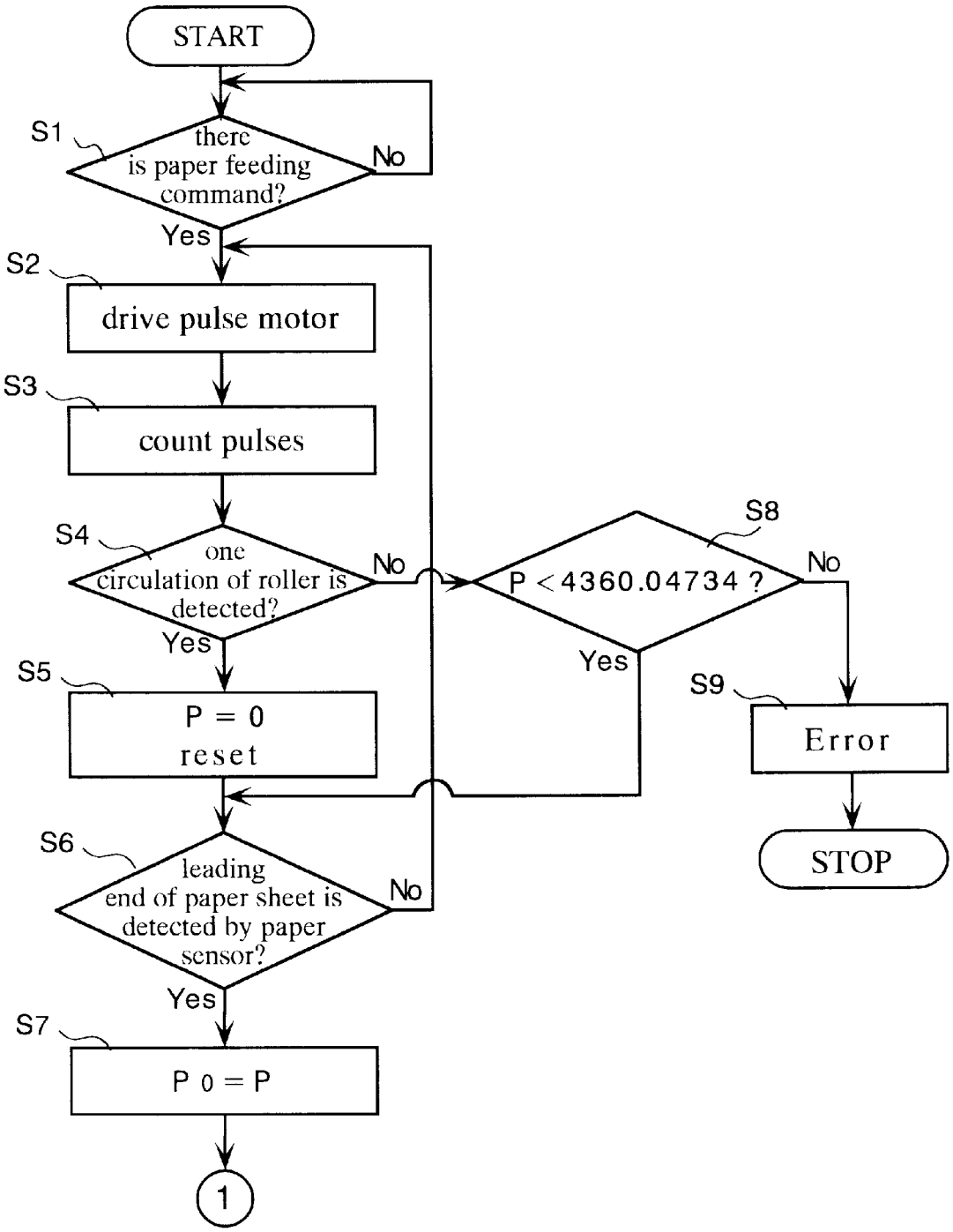
FIG. 9 is a flow chart showing a part of a first example of control carried out by a control section in the third embodiment of the present invention.
Figure 10:
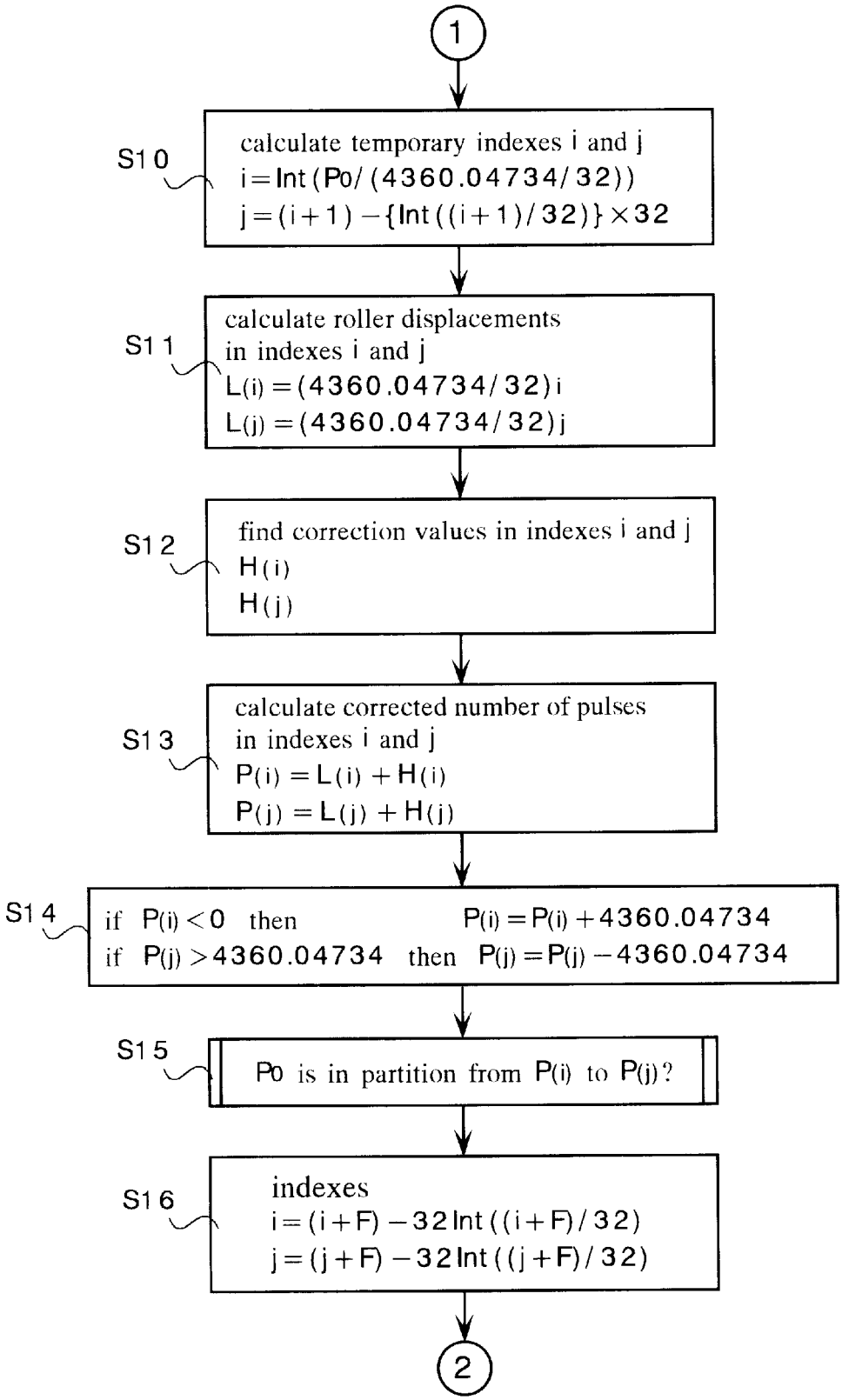
FIG. 10 is a flow chart subsequent to FIG. 9.
Figure 11:
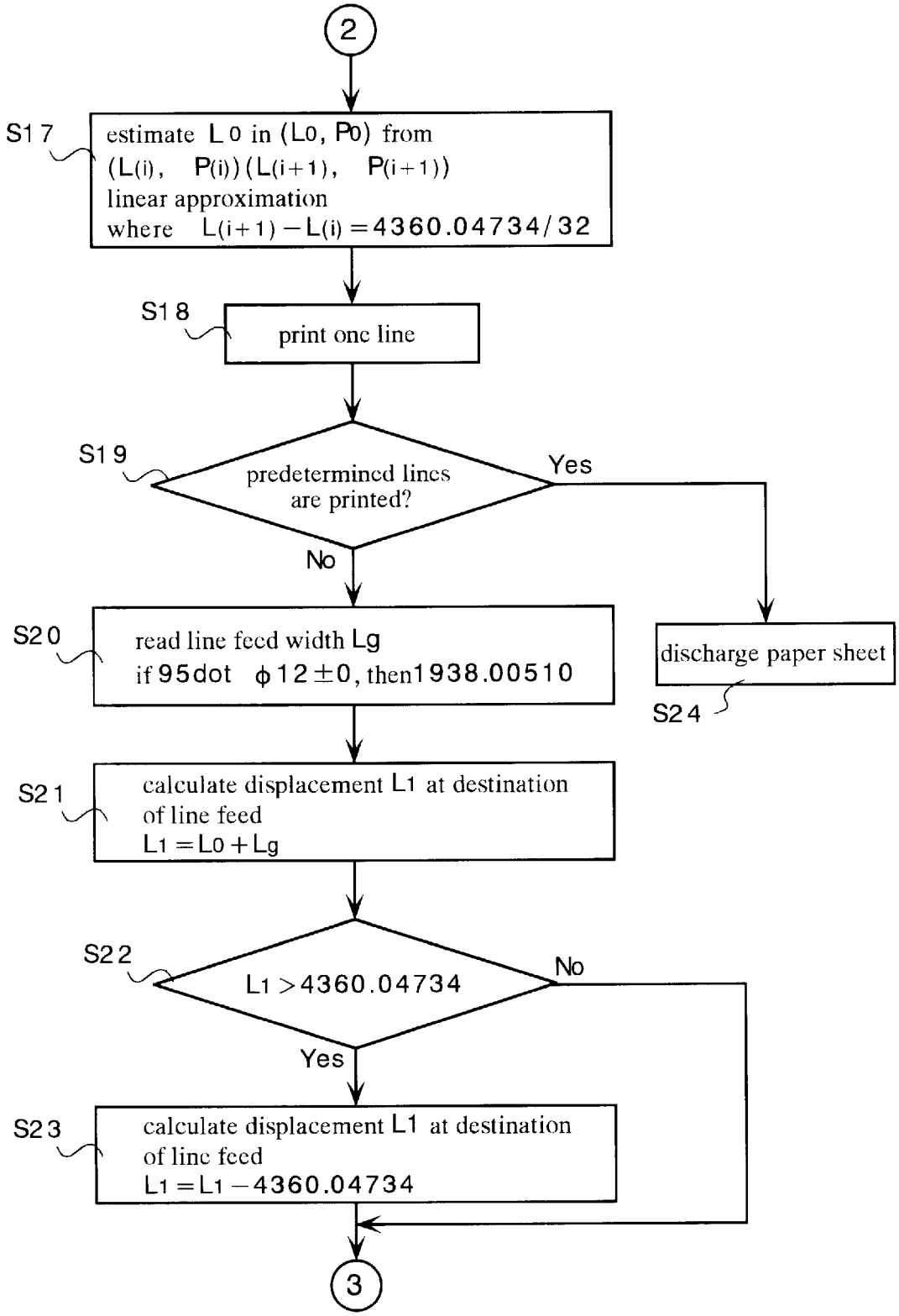
FIG. 11 is a flow chart subsequent to FIG. 10.
Figure 12:
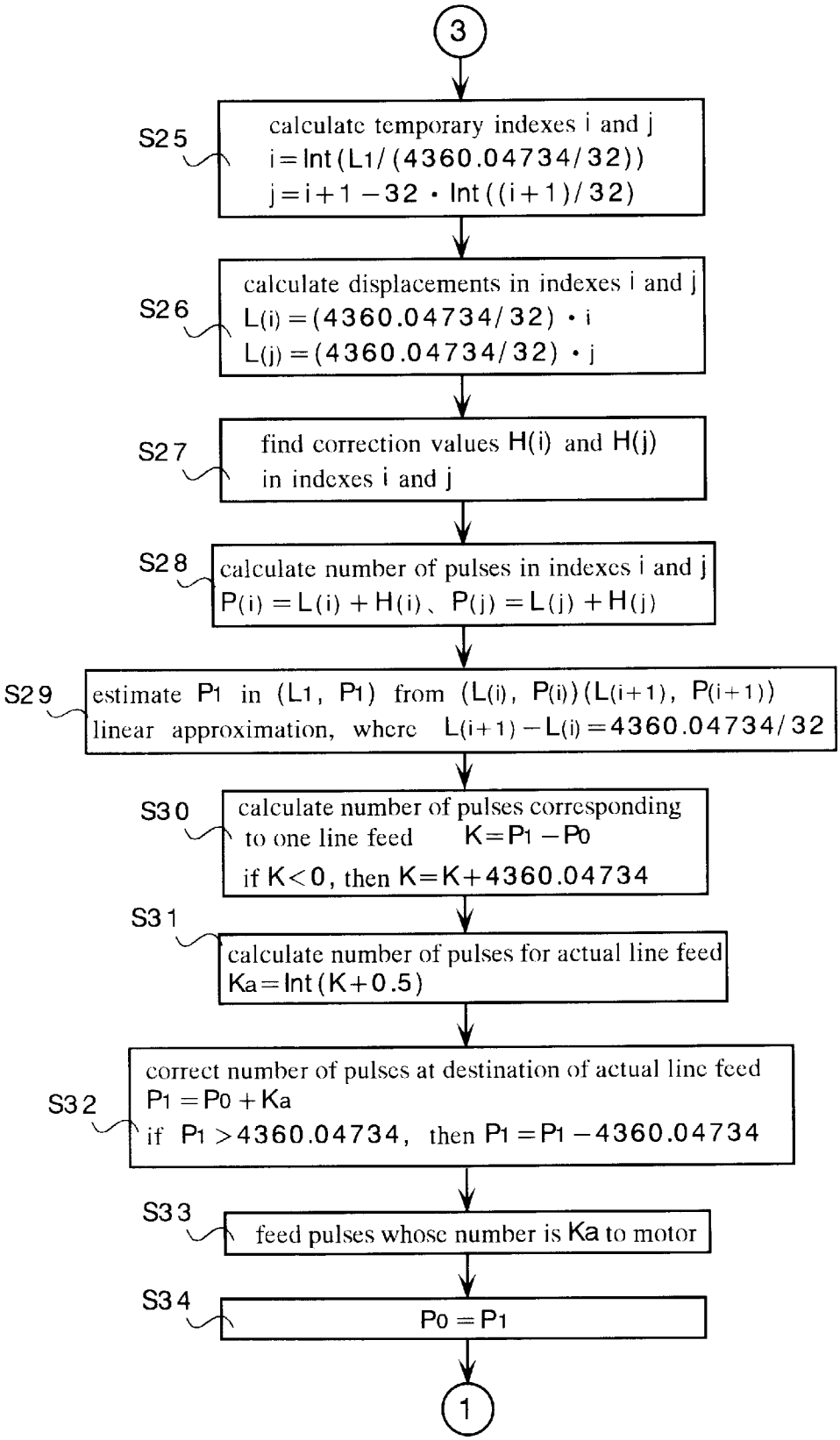
FIG. 12 is a flow chart subsequent to FIG. 11.

FIG. 7 is a block diagram showing a control system of a serial head type recorder according to the present embodiment. A number-of-pulses correction value storing section 32 stores, on the basis of the measurement of the non-uniformity in conveyance of a paper sheet 10 for each of a plurality of partitions obtained in dividing the circumference of the conveying roller 1*a* number-of-pulses correction value (H) fed for the partition so that the non-uniformity in conveyance is reduced.

Figure 17:
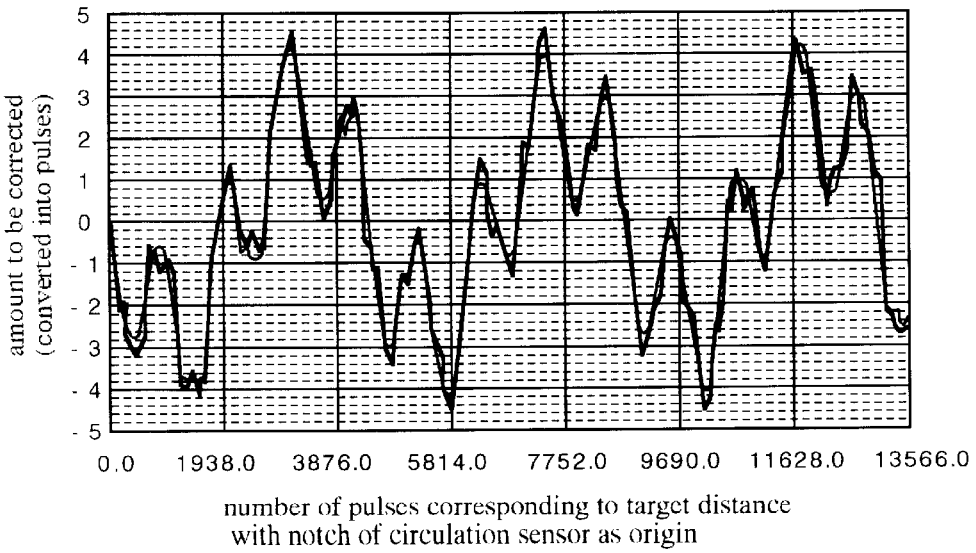
FIG. 17 is a graph showing the relationship between the number of pulses corresponding to the target distance with a circulation sensor of a conveying roller in the present invention as the origin and an amount to be corrected (converted into the number of pulses)

FIG. 8 illustrates one example of a number-of-pulses correction value in each of 32 partitions (11.25°:360/32 in terms of an angle) obtained in dividing the circumference of the conveying roller 1*a*. The measurement of the non-uniformity in conveyance and the storage of the number-of-pulses correction value in the storing section 32 on the basis of the measurement are carried out in the shipment stage of products. If the relationship between the number of pulses corresponding to the target distance with a notch of the circulation sensor 31 taken as the origin and an amount to be corrected (converted into pulses) is indicated, a graph as shown in FIG. 17, for example, is obtained. A curve having a fine wave in FIG. 17 is a correction curve in a case where speed reducing ratios determined by all gears are respectively taken as ratios of integers. On the other hand, a curve having a smoother wave is a correction curve in a case where a speed reducing ratio determined by the small gear of the second gear 3*b* is taken as a ratio of integers.

A pulse counter 34 measures the number of pulses fed to the pulse motor 11 every time one circulation of the conveying roller 1*a* is detected by the sensor 31. A control section 33 obtains a number-of-pulses correction value in the partition corresponding to the amount of rotation of the conveying roller 1*a* on the basis of the above-mentioned number of pulses, to control the rotation of the pulse motor 11 on the basis of the number-of-pulses correction value.

Schematic description will be made prior to detailed description of the contents of control carried out by the control section 33. In the serial head type recorder according to the present embodiment of such construction, the speed reducing ratio of at least the first gear 3*a* directly connected to the conveying roller 1*a* to the small gear of the second gear 3*b* engaged therewith is a ratio of integers as described above, whereby non-uniformity in conveyance due to eccentricity of the gears, for example, periodically appears depending on the ratio of integers during one circulation of the conveying roller 1*a*. Motor rotation control is carried out using the number-of-pulses correction value in each of the partitions corresponding to the non-uniformity in conveyance in the range of the one circulation. Even when a line feed width corresponds to 0.45 rotation of the conveying roller, for example, therefore, a clearance between line feeds can be reduced upon obtaining the amount of rotation of the conveying roller 1*a* which is to be a target by properly rotating the pulse motor 11 using the number-of-pulses correction value in the partition corresponding to 0.45 rotation (if the conveying roller 1*a* is rotated a predetermined number of times to the printing starting position, a partition corresponding to rotation considering the predetermined number of times of rotation).

Description is now made of the basic idea in control carried out by the control section 33 and specific contents such as a speed reducing ratio in the group of gears 3 and the diameter of the conveying roller 1*a*.

① The target position of the paper sheet is managed using L (the target number of pulses which is a real number). L denotes a target displacement of the conveying roller, which is in the range of $0 \leqq L \leqq 4360.04734$ when it is represented by the number of pulses (a real number) with a one circulation point detected by the circulation sensor 31 taken as the origin.

The value of 4360.04734 which is the number of pulses for one circulation of the conveying roller 1*a* is found by 360°/(15°×I), letting the total speed reducing ratio I in the group of gears 3 be 0.0055, and the step angle of the motor be 15°.

When it is assumed that a line feed width Lg corresponds to 95 dots, and the resolution is 144 dpi, the line feed width Lg is 16.7569444 . . . mm.

$$25.4\ \text{mm} \times 95/144\ \text{dots} = 16.7569444\ \ldots\ \text{mm}$$

When the roller diameter=12±0, the number of pulses corresponding to the line feed width is 1938.0051.

$$4360.04734 \times 16.7569444/12\ \pi = 1938.0051\ \ldots$$

Figure 40:
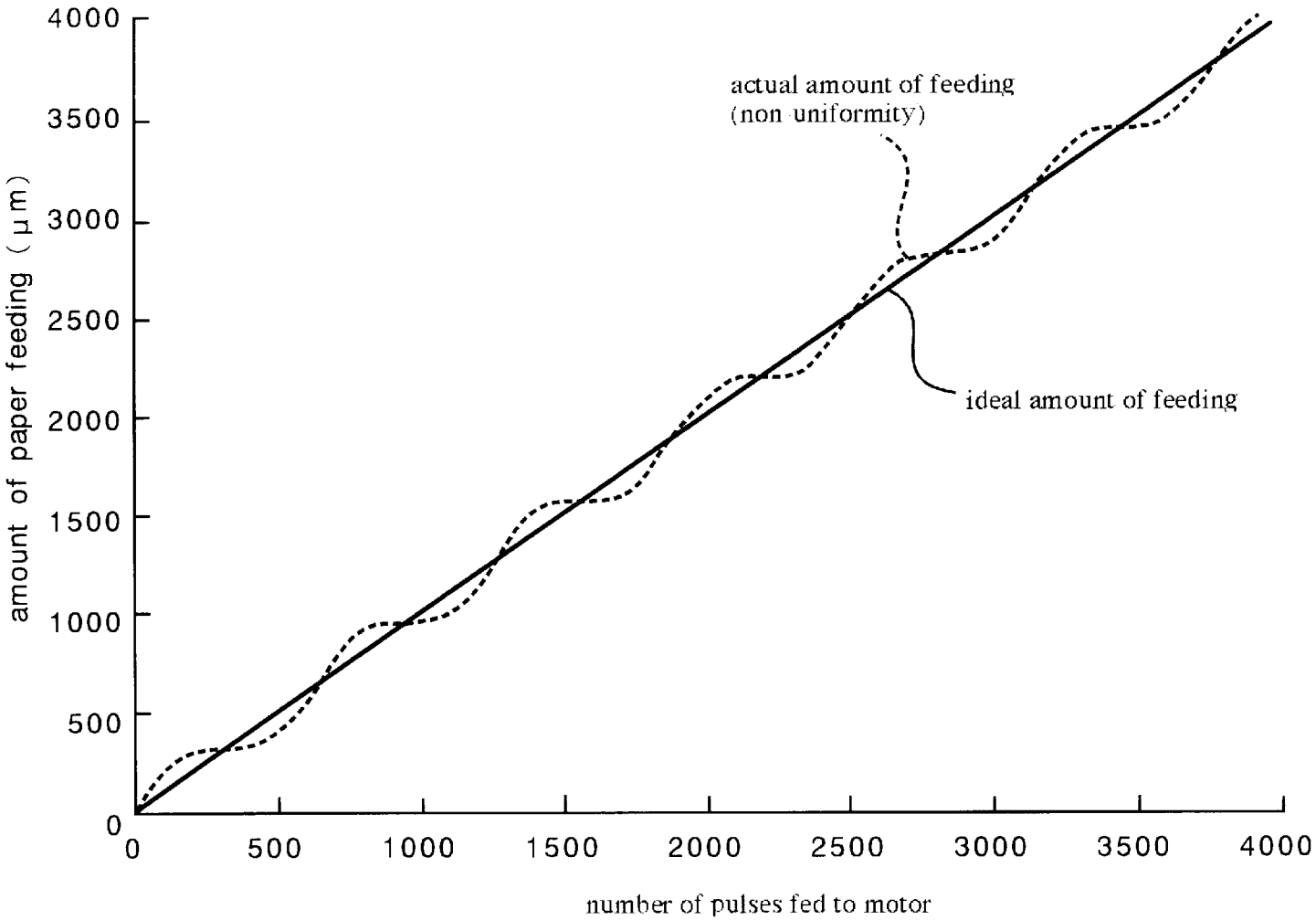
FIG. 40 is a graph showing the relationship between the number of motor pulses and the amount of paper feeding.

The step for measuring the roller diameter is actually omitted, and there is a difference between the measured diameter and the diameter actually contributing to conveyance, whereby the number of pulses corresponding to the line feed width is found by the measurement as follows. That is, an ideal straight line shown in FIG. 40 is replaced with a straight line obtained by linearly approximating the actual amount of conveyance. The number of pulses corresponding to 16.7569444 mm is found from the slope of the straight line.

② The number of pulses fed to the pulse motor is managed using P (the number of pulses after correction which is a real number). P is in the range of $0 \leqq P \leqq 4360.04734$ when it is represented by the number of pulses (a real number) obtained on calculation with a one circulation point detected by the circulation sensor 31 as the origin. However, the number of pulses itself which can be fed to the motor is an integer.

③ Letting H be a number-of-pulses correction value in FIG. 8, H is represented by H=P−L. Consequently, the number of pulses P to be fed to the motor is P=L+H.

④ Let the number of pulses P in a case where the paper sensor 35 detects the leading end of the paper sheet be $P_0$ ($P_0$ is an integer). An actual roller displacement $L_0$ in a case where the pulses whose number is $P_0$ are fed is estimated.

⑤ A displacement at the destination of one line feed $L_1$ is $L_1=L_0+Lg$. In the case of $L_1$, the number of pulses $P_1$ is estimated. The number of pulses K corresponding to the line feed is $K=P_1-P_0$. When K is changed into an integer, to find Ka, $P_1=P_0+Ka$ because the number of pulses actually fed to the motor is an integer.

⑥ The pulses whose number is Ka are fed to the motor. Ka is an integer, whereby a roller displacement at that time is not $L_1$. Therefore, $L_1$ is estimated from $P_1$.

⑦ The foregoing processing is repeated.

⑧ When the speed reducing ratios determined by all the gears are respectively ratios of integers, a count value is not used in the example of control after one circulation of the conveying roller 1*a* is first detected, to reset the number of pulses P to the above-mentioned number of pulses $P_0$. On the other hand, when only part of the speed reducing ratios are respectively ratios of integers, the number of pulses P is reset every time one circulation of the roller is detected. Consequently, the following step 32 is omitted in this case.

The detailed contents of control carried out by the control section 33 will be described on the basis of flow charts of FIGS. 9 to 13.

It is first judged whether or not there is a paper feeding command (step 1). If there is a paper feeding command, the driving of the pulse motor 11 (the feeding of pulses) is started (step 2). The number of pulses (P) fed to the pulse motor 11 is counted by the pulse counter 34 (step 3). It is detected by the circulation sensor 31 whether or not a notch (a reference position) of the conveying roller 1*a* is detected (step 4).

When the reference position is detected, processing of P=0 (reset processing) is performed (step 5). It is judged whether or not the leading end of the paper sheet is detected by the paper sensor 35 (step 6). If the leading end of the paper sheet is detected, processing of $P_0$=P is performed (step 7). That is, the actual number of pulses fed to the pulse motor 11 until the leading end of the paper sheet is detected is replaced with $P_0$.

On the other hand, if the reference position is not detected in the step 4, it is judged whether or not P<4360.04734 (step 8). If the answer is in the affirmative, the program proceeds to the step 6. If the answer is in the negative, error processing is performed (step 9). If the leading end of the paper sheet is not detected in the step 6, the program proceeds to the step 2. In the step 2, the driving of the pulse motor 11 is continued. Even when the program proceeds to the step 8 from the step 4, after which the program proceeds to the step 6, and $P_0$=P in the step 7, the above-mentioned number of pulses P is the number of pulses, whose number is an integer, fed to the pulse motor 11 from the time when the reference position of the conveying roller 1*a* is detected by the circulation sensor 31 to the time when the leading end of the paper sheet is detected by the paper sensor 35.

Calculation processing of temporary indexes i and j is then performed (step 10). The index i is found by calculation of $i=I_{nt}$ ($P_0$/(4360.04734/32)), and the index j is found by calculation of $j=(i+1)-\{I_{nt}(i+1)/32\}\times 32$. The index j is 1 when i is zero, 2 when i is 1, and zero when i is 31. The indexes i and j indicate how many partitions are there to a partition where the conveying roller is displaced by an amount corresponding to the number of pulses $P_0$.

Roller displacements L(i) and L(j) in the indexes i and j are then calculated (step 11). L(i) is found by calculation of L(i)=(4360.04734/32)×i, and L(j) is found by calculation of L(j)=(4360.04734/32)×j. That is, one partition corresponds to 4360.04734/32 pulses. 4360.04734/32 is multiplexed by the number of partitions, so that the amount of roller displacement corresponding to the partitions is found.

Number-of-pulses correction values H(i) and H(j) in the indexes i and j are then found from a list after correction shown in FIG. 8 (step 12). For example, −1.2345 if H(1).

The corrected number of pulses P(i) and P(j) in the indexes i and j are then calculated (step 13). P(i) is found by calculation of P(i)=L(i)+H(i), and P(j) is found by calculation of P(j)=L(j)+H(j).

Processing for ensuring 0<P<4360.04734 is then performed (step 14). That is, if P(i)<0, then processing of P(i)=P(i)+4360.04734 is performed. On the other hand, if P(j)>4360.04734, then processing of P(j)=P(j)−4360.04734 is performed.

Figure 13:
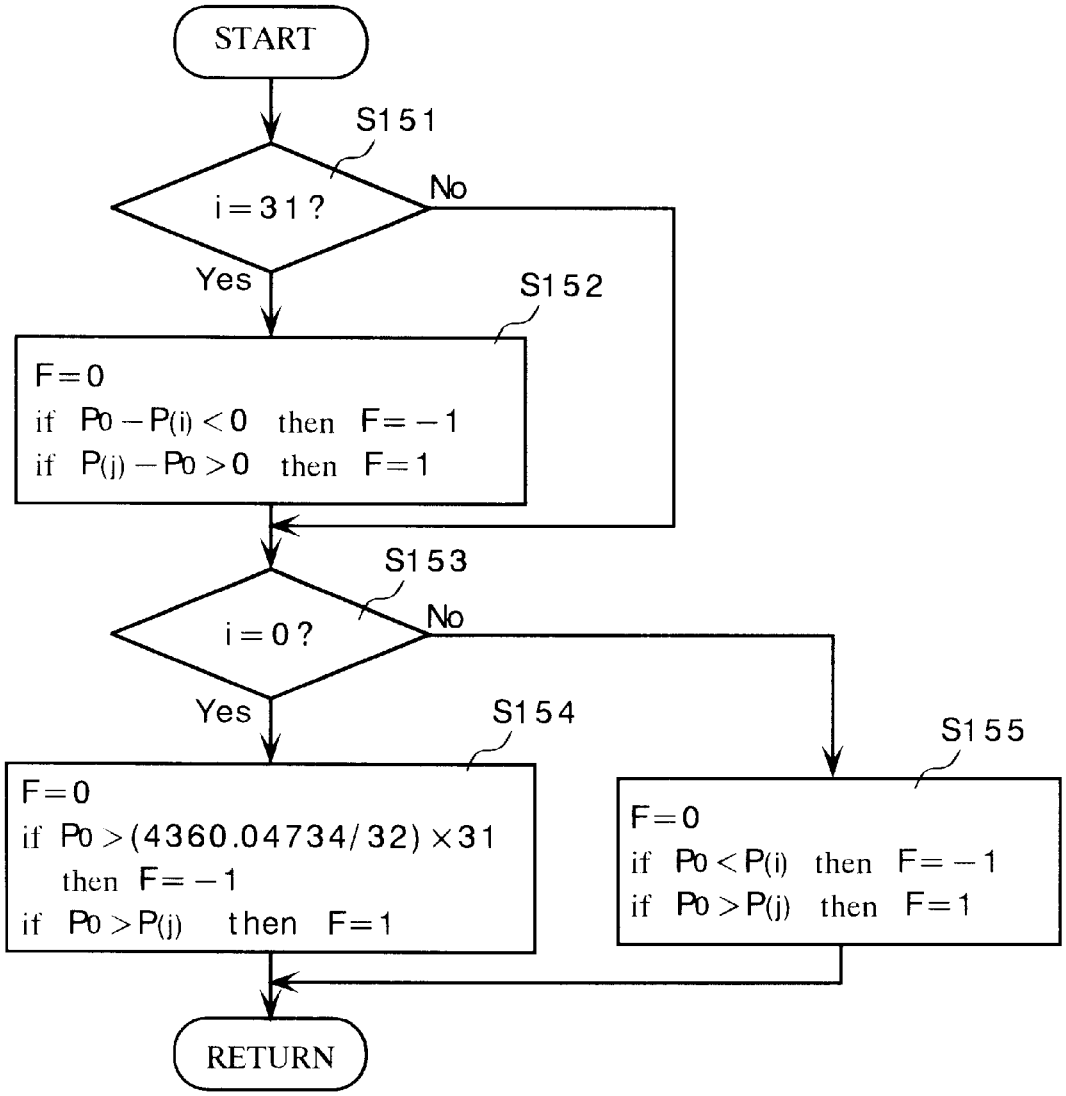
FIG. 13 is a flow chart showing the specific contents in the step 15 shown in FIG. 10.
Figure 14:
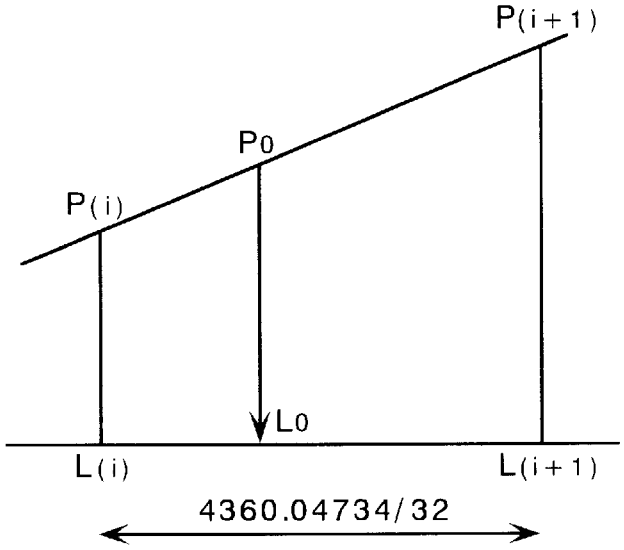
FIG. 14 is an illustration for explaining the estimation of $L_0$ in the third embodiment of the present invention.
Figure 15:
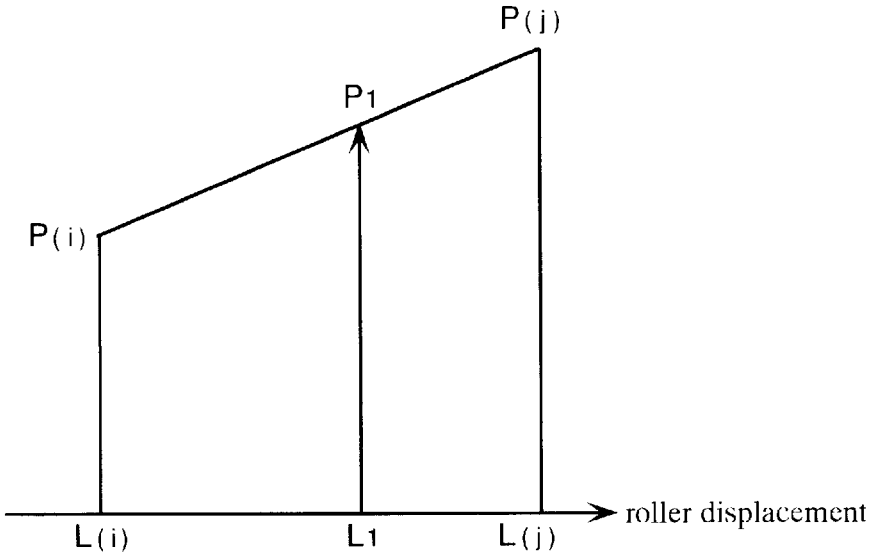
FIG. 15 is an illustration for explaining the estimation of $P_1$ in the third embodiment of the present invention.

It is then judged whether or not $P_0$ is in a partition from P(i) to P(j) (step 15). In this processing, it is first judged whether or not i=31 (step 151), as shown in FIG. 13. If the answer is in the negative, the program proceeds to the step 153. On the other hand, if the answer in the affirmative, F=0 as a general rule by processing in the step 152. F=−1 if $P_0$−P(i)<0, while F=1 if P(j)−$P_0$>0, after which the program proceeds to the step 153.

In the step 153, it is judged whether or not i=0. If the answer is in the affirmative, F=0 as a general rule. F=−1 if $P_0$>(4360.04734/32)×31, while F=1 if $P_0$>P(j) (step 154), after which the program is returned. On the other hand, if the answer is in the negative in the step 153, F=0 as a general rule. F=−1 if $P_0$<P(i), while F=1 if $P_0$ >P(j) (step 155), after which the program is returned.

If the processing in the step 15 (151 to 155), F=0 means that the number of pulses $P_0$ is inside the partition, F=1 means that it is outside the partition, and its plus or minus means the direction of deviation.

After the processing in the step 15, calculation of $i=(i+F)-32\times I_{nt}((i+F)/32)$ and calculation of $j=(j+F)-32\times I_{nt}((j+F)/32)$ are carried out (step 16). That is, i remains i, and j remains j when $P_0$ is inside the partition, while the partition is corrected when $P_0$ is outside the partition (F=±1).

Processing for estimating a roller displacement $L_0$ is then performed from the number of pulses $P_0$ (step 17). Specifically, $L_0$ in ($L_0$, $P_0$) is estimated from (L(i), P(i)) and (L(j), P(j)). In this processing, a change from P(i) to P(j) is considered to be linear, and the amount of shift of $P_0$ from P(i) and the amount of shift of $L_0$ from L(i) are caused to correspond to each other to find $L_0$ (linear approximation). That is, $L_0$ can be estimated from $L_0$−L(i): L(j)−L(i)=$P_0$−P(i): P(j)−P(i).

Processing for scanning a serial head in $L_0$ found as described above and printing one line is then performed (step 18). Thereafter, it is judged whether or not predetermined lines are printed (step 19). If predetermined lines are printed, paper discharge processing is performed (step 24). If predetermined lines are not printed, the number of pulses to be fed to the pulse motor is calculated so as to advance the paper sheet by an amount corresponding to one line feed for the purpose of subsequent printing.

A line feed width Lg is first read out (step 20). The line feed width Lg is 1938.0051 upon being converted into the number of pulses, as described above. A displacement $L_1$ at the destination of the line feed is calculated (step 21). $L_1$ is obtained by an equation of $L_1=L_0+Lg$.

It is then judged whether or not $L_1$>4360.04734 (step 22). This corresponds to examination whether or not the conveying roller 1*a* is rotated beyond the reference position during the line feed. If the conveying roller 1*a* is rotated beyond the reference position, $L_1$ is replaced with the value of $L_1$−4360.04734 (step 23).

The indexes i and j are then calculated (step 25). In this processing, the index i is found by calculation of $i=I_{nt}$ ($L_1$/(4360.04734/32), and the index j is found by calculation of $j=(i+1)-\{I_{nt}(i+1)/32\}\times 32$, as in the step 10. Roller displacements L(i) and L(j) in the indexes i and j are then calculated (step 26). In this processing, L(i) is found by calculation of L(i)=(4360.04734/32)×i, and L(j) is calculation of L(j)=(4360.04734/32)×j, as in the step 11.

Number-of-pulses correction values H(i) and H(j) in the indexes i and j are then calculated (step 27). They may be found from the above-mentioned list shown in FIG. 8, as in the step 12. Corrected number of pulses P(i) and P(j) in the indexes i and j are calculated (step 28). In this processing, P(i) and P(j) can be found by calculation of P(i)=L(i)+H (i) and calculation of P(j)=L(j)+H(j), as in the step 13.

$P_1$ in ($L_1$, $P_1$) is then estimated from (L(i), P(i)) and (L (j), P(j)) (step 29). $L_1$ has been already obtained in the step 21. In processing for estimating $P_1$, a change from P(i) to P(j) is considered to be linear, and the amount of shift of $L_1$ from L(i) and the amount of shift of $P_1$ from P(i) are caused to correspond to each other to estimate $P_1$ (linear approximation).

The number of pulses (a real number) corresponding to one line feed K is then calculated (step 30). K is found from $K=P_1-P_0$. When the conveying roller 1*a* is rotated beyond the reference position, $P_1-P_0<0$, whereby $K=4360.04734+P_1-P_0$. Since the number of pulses fed to the pulse motor is an integer, whereby the number of pulses Ka which is an integer is found (step 31). Ka is found by processing of $I_{nt}$ (K+0.5). Addition of 0.5 means a change into an integer after rounding.

The number of pulses at the destination of the actual line feed is then corrected (step 32). Specifically, $P_1$ is newly found by $P_1=P_0+Ka$. If $P_1>4360.04734$, then correction processing of $P_1=P_1-4360.04734$ is performed. In the step 33, the pulses whose number is Ka are fed to the pulse motor. When the speed reducing ratios determined by all the gears are respectively ratios of integers, processing of $P_0=P_1$ is performed (step 34), after which the program proceeds to the step 10. When speed reducing ratios determined by part of the gears are respectively ratios of integers, P is reset every time one circulation of the roller is detected. At this time, the step 32 is omitted. An actual count value is used as $P_1$. The reason why the correction processing in the step 32 is performed is that processing in a case where the program is returned to the step 10 is coped with by replacing the value of $P_0$ with the value of $P_1$ in the foregoing step 34, and $P_0$ should fall within the range of $0<P_0<4360.04734$.

Description is made of the frame of the foregoing processing. The amount of actual roller displacement (the actual position of the paper sheet) $L_0$ is estimated by considering a correction value in the correction table shown in FIG. 8 on the basis of the number of feed pulses $P_0$ (an integer) fed to the motor in a case where the leading end of the paper sheet is detected, the line feed width is added to $L_0$ to calculate the position of the subsequent paper sheet (the amount of roller displacement) $L_1$, the number of feed pulses $P_1$ after the correction for obtaining $L_1$ is found by considering a correction value in the correction table shown in FIG. 8, and the number of pulses K to be fed this time is found by $P_1-P_0$ and is further changed into an integer to find Ka as the number of pulses to be actually fed to the motor.

Figure 16:
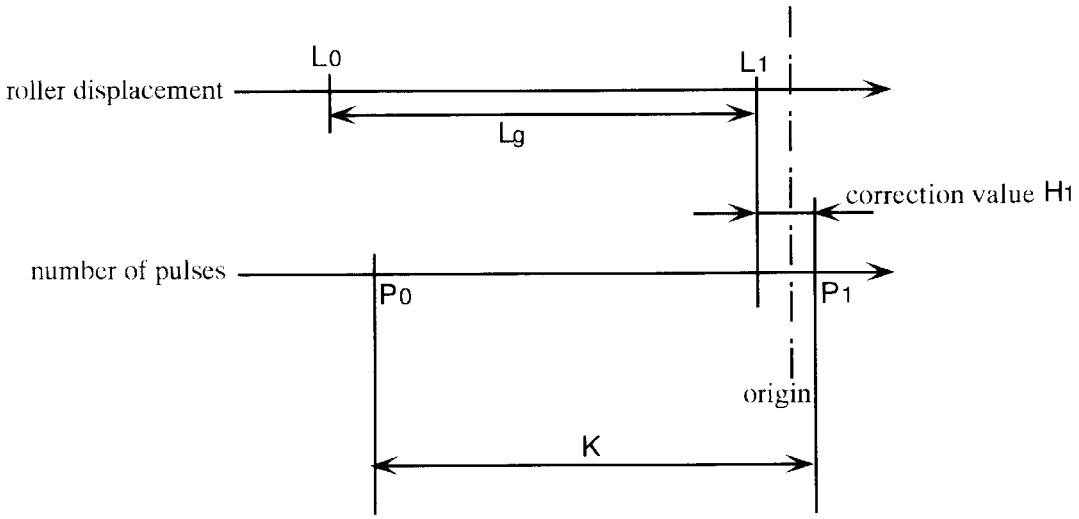
FIG. 16 shows that K obtained by considering a correction value $H_1$ to $L_1=L_0+Lg$ is used, and $P_1$ is obtained by calculation of $P_0+K$.

If the number of pulses K can be fed to the pulse motor (actually impossible), the amount of roller displacement after the line feed is $L_1$. Since the pulse motor is driven using the number of pulses Ka which is an integer as described above, however, the displacement after the line feed is not actually $L_1$. If the amount of roller displacement $L_1$ is fed as $*L_0$ in calculation for the subsequent line feed ($*L_1=*L_0+Lg$), therefore, an error between the amount of actual displacement and L for managing the actual displacement is increased. In the step 34, processing of $P_0=P_1$ is performed, after which the program is returned to the step 10 and proceeds to the step 17. In the step 17, $L_0$ is estimated again on the basis of $P_0$, so that the amount of displacement $L_1$ at the destination of the subsequent line feed is calculated in the step 21 on the basis of $L_0$. FIG. 16 shows that K obtained by considering a correction value $H_1$ to $L_1=L_0+Lg$ is used, and $P_1$ is obtained by calculation of $P_0+K$.

When a case of $P_0=P=136$ is assumed in the step 7, i=0 and j=1 in the step 10, L(0)=0 and L(1)=136.25148 in the step 11, H(0)=0 and H(1)=−1.2345 in the step 12, and P(0)=0 and P(1)=135.01698 in the step 13. Consequently, there is no correction in the step 14. In the judgment of a partition in the step 15, 136 which is $P_0$ is not in a partition from 0 to 135.01698, whereby the partition must be corrected. Specifically, the answer is in the affirmative in the step 153, and $P_0$ (136)>P(j)=135.01698 in the step 154, so that F=1. In the step 16, i=((0+1)−=×0)=1 and j=(1+1)−32×0=2. That is, correction to i=1 and j=2 is made.

Figures 18, 19:
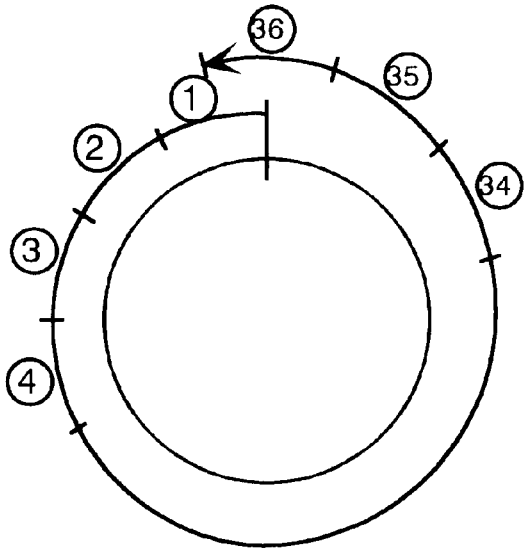
FIG. 18 is an illustration showing the relationship between a conveying roller and partitions in a second example of control carried out by a control section in the third embodiment of the present invention.
FIG. 19 is an illustration showing the contents of a number-of-pulses correction value storing section in the second example of control carried out by the control section in the third embodiment of the present invention.

A modified example (a second example of control) of the above-mentioned example of control (the first example of control) will be described using FIGS. 18 and 19. Modified points in the modified example are as follows.

① Modified point 1

In the first example of control, the circumference of the conveying roller is divided by 32 (number of partitions), so that the total of all the partitions just corresponds to the circumference of the conveying roller.

In the second example of control, 140.4291531 which is the number of pulses corresponding to the circumference of the conveying roller (although it is 4360.04734 in the previous example, it is 4493.7329 upon being changed as the roller diameter, the step angle, and the speed reducing ratio are changed) by 32 is taken as an integer upon being shifted up three bits. That is, 140.4291531×8≈1123.4. It shall be 1024 for convenience. 1024 is shifted down three bits, so that the number of pulses in one partition is taken as 128. Since 4493.7329 which is the number of pulses corresponding to the circumference of the conveying roller divided by 128 gives 35.107 . . . , the number of partitions is taken as 36. That is, in the relationship between the circumference of the conveying roller and partitions in this case, the total of all the partitions exceeds the circumference of the conveying roller, so that the first partition and the 36-th partition take charge of the same portion of the conveying roller in an overlapped state, as shown in FIG. 18. A number-of-pulses correction table in this case is as shown in FIG. 19.

② Modified point 2

In the first example of control, $L_0$ is estimated from the number of feed pulses $P_0$ at the time point where the leading end of the paper sheet is detected.

In the second example of control, $L_0'$ obtained by the following processing is replaced with $L_0$. Inherently, $P_0=L_0+H_0$. However, $L_0$ and $H_0$ are unknown (because $H_0$ is given with respect to $L_0$). Therefore, $P_0$ is used in place of $L_0$, to set $H_0'$ which is temporary $H_0$. $L_0\approx L_0'=P_0-H_0'$ from $L_0=P_0-H_0$. $L_0$ is replaced with $L_0'$. If such a method is employed, simple processing is sufficient, although an error slightly exists. In order to reduce the error, temporary $H_0''$ is found using $L_0'$ again, $L_0\approx L_0''=L_0'-H_0''$ from $L_0=P_0-H_0$, and $L_0$ is replaced with $L_0''$. The larger the number of times of such processing is, the smaller the error becomes.

③ Modified point 3

In the first example of control, the number of pulses Lg, which is a real number, corresponding to one line feed is added to the target number of pulses $L_0$, which is a real number, in the printing position at the present time point, to calculate the target number of pulses $L_1$, which is a real number, representing the amount of feeding of the paper sheet at the destination of the line feed. If $L_1$ exceeds the number of pulses corresponding to the circumference of the conveying roller, processing of $L_1=L_1$−the number of pulses corresponding to the circumference of the roller (step 23) is performed.

In the second example of control, if $L_1$ exceeds 36 (partitions)×128 (pulses)=4608 in view of the fact that the total number of pulses in an index is not less than the number of pulses corresponding to the circumference of the conveying roller from the above-mentioned modified point 1, $L_1$ is corrected to $L_1$−the number of pulses corresponding to the circumference of the roller. For example, if $L_1$=4600, i=35 to j=36 are used as indexes (i, j). If $L_1$=4610, $L_1$ is corrected to 4610−4493.7329=116.2671 from $L_1$>4608, so that i=0 to j=1 are used as indexes (i, j).

④ Modified point 4

In the first example of control, correction of the target number of pulses in the printing position at the present time point made in correspondence to the fact that the pulses whose number is not a real number but an integer are fed to the motor is made upon setting $P_0=P_1$ in the step 34 and further estimating $L_0$ from $P_0$ through the processing in the step 10 to step 17. Specifically, the number of pulses $P_1$ (a real number) after correction is found from the amount of roller displacement at the destination of one line feed $L_1=L_0+Lg$ ($P_1=L_1+H_1$), and the difference K (a real number) from the number of pulses $P_0$ at this time point is found ($K=P_1-P_0$) and is further changed into an integer ($Ka=I_{nt}(K+0.5)$). However, $P_1$ is found as the number of pulses which is an integer ($P_1=P_0+Ka$, that is, replacement with an integer) in corresponding to the fact that the pulses whose number is not a real number but an integer are fed to the motor, and $P_1$ which is an integer is taken as $P_0$ to estimate $L_0$ from $P_0$.

In the second example of control, $P_1'=P_0+Ka$ (replacement with an integer), to make calculation of $E=P_1'-P_1$ (a real number). That is, the calculation is for taking out a portion after the decimal point. This corresponds to processing for finding the difference by feeding the pulses whose number is not a real number but an integer. Processing of $L_1'=L_1+E$ is performed to replace $L_1$ with $L_1'$, to find the roller displacement $L_1$ at the destination of the line feed by taking $L_1$ as $L_0$.

⑤ Modified point 5

In the first example of control, the reset of the pulse counter in a case where one circulation of the conveying roller is detected in the steps 4 and 5 (hereinafter referred to as detection of a reference point) is not performed after the steps. A method of not detecting a reference point presents no problem if the ratios of gears in the group of gears 3 are respectively ratios of integers with respect to all the gears (the ratio of a roller shaft to each of the other shafts). That is, if the number of pulses corresponding to the circumference of the conveying roller is fed to the motor, the conveying roller always circulates once.

However, there is an error caused by the number of significant digits in the number of pulses corresponding to the circumference of the conveying roller, and it is not rather desirable that the ratios of gears are respectively ratios of integers with respect to all the gears in the group of gears 3 (because the degradation of the gears is promoted). Generally, the ratio of integers is ensured between a first shaft and a second shaft or between third shafts. Even if the pulses whose number corresponds to the circumference of the conveying roller are fed to the motor, the conveying roller does not necessarily circulate once.

In the second example of control, the reference point is detected each time, to reset the pulse counter. That is, as described in the modified point 3, $L_1$ is corrected to $L_1$−the number of pulses corresponding to the circumference of the roller, $P_1$ is estimated from $L_1$, and the conveying roller is rotated by $P_1$. When one circulation of the roller is detected during the rotation, the pulse counter is reset, and the amount of displacement of the conveying roller by $P_1$ after an elapse of the reference point is found by the pulse counter. Processing is repeated again using the number of pulses ($P_0$) detected by the pulse counter. In this case, $L_1$ is produced on the basis of $P_0$ actually detected by the pulse counter, whereby the necessity of the corrected roller displacement $L_1$ described in the modified point 4 is eliminated.

The contents of the above-mentioned second example of control will be described on the basis of flow charts of FIGS. 20 to 24.

Figure 20:
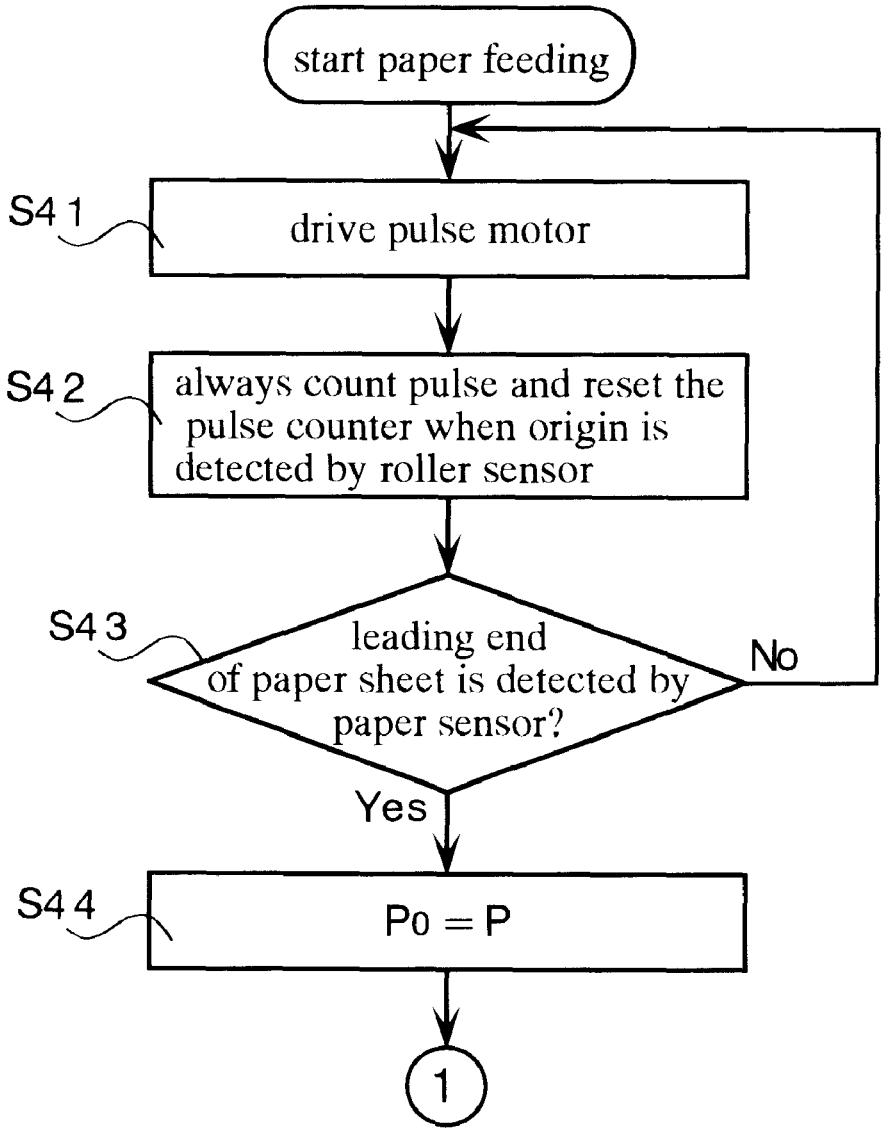
FIG. 20 is a flow chart showing a part of the second example of control carried out by the control section in the third embodiment of the present invention.

As shown in FIG. 20, the pulse motor is first driven after a command to start paper feeding (step 41). The pulse counter 34 (see FIG. 7) for always counting the number of feed pulses to the pulse motor is reset when the reference position of the conveying roller is detected by the circulation sensor 31 (step 42). This processing is always performed. It is judged whether or not the leading end of the paper sheet is detected by the paper sensor 35 (step 43). If the leading end of the paper sheet is detected, processing of $P_0$=P is performed (step 44).

Figure 21:
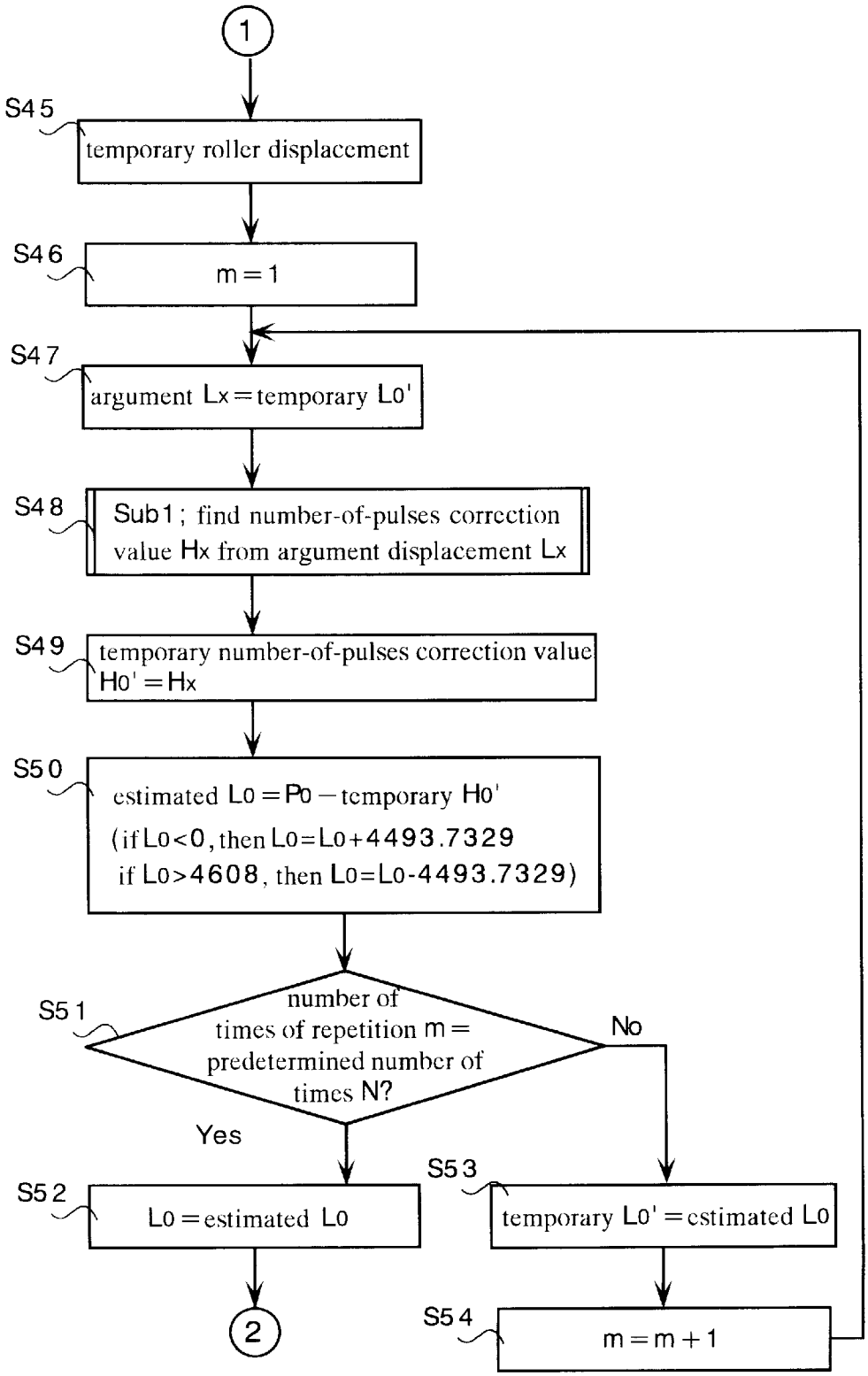
FIG. 21 is a flow chart subsequent to FIG. 20.

Estimation processing of a roller displacement $L_0$ from the number of pulses $P_0$ is then started. As shown in FIG. 21, the value of $P_0$ is first substituted as a temporary roller displacement $L_0'$ (hereinafter referred to as temporary $L_0'$) (step 45). "1" is then substituted as the number of times of repetition m (step 46). The value of the temporary $L_0'$ is substituted as an argument displacement Lx (step 47), and a number-of-pulses correction value Hx is found from the argument displacement Lx (step 48). The step 48 is specifically carried out by the processing in the steps 73, 74, and 75 shown in FIG. 24. The processing corresponds to partition judgment processing in the first example of control. The value of Hx is then substituted as a temporary number-of-pulses correction value $H_0'$ (step 49). Estimated $L_0$ is found by $P_0$ and $H_0'$ (step 50). It is then judged whether or not the number of times of repetition m reaches a predetermined number of times N (step 51). If the number of times of repetition m does not reach the predetermined number of times N, the estimated $L_0$ is replaced with the temporary $L_0'$ (step 53), and m is incremented (step 54), after which the program is returned to the step 47. In the step 47, processing for producing the estimated $L_0$ is repeated. On the other hand, if the number of times of repetition m reaches the predetermined number of times N, the estimated $L_0$ is replaced with $L_0$ (step 52).

The above-mentioned processing in the step 45 to the step 52 corresponds to the processing in the step 10 to the step 17 in the first example of control, and indicates the specific contents of the above-mentioned modified point 2.

Figure 22:
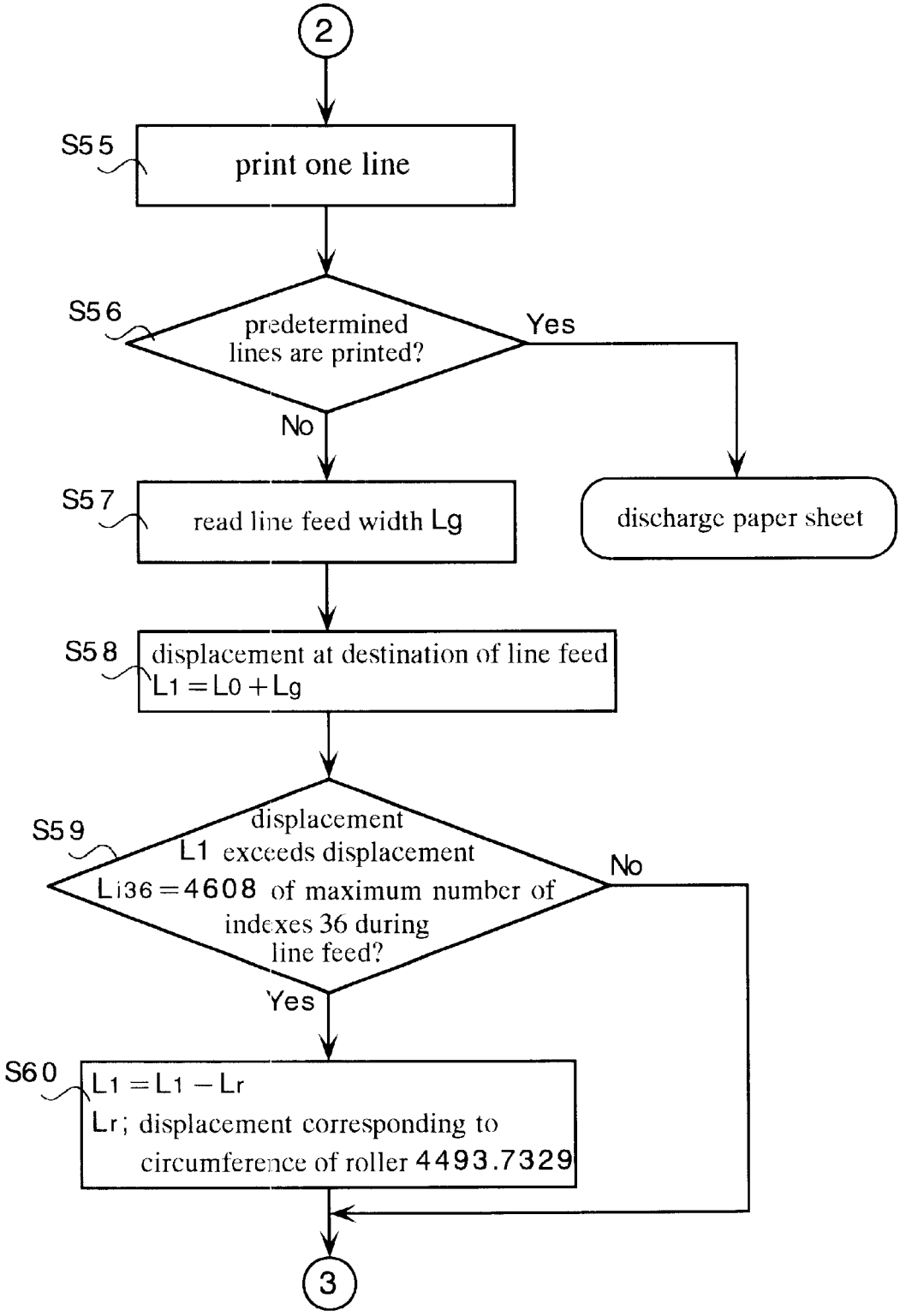
FIG. 22 is a flow chart subsequent to FIG. 21.

Processing for calculating a roller displacement $L_1$ at the destination of one line feed is then performed. That is, as shown in FIG. 22, it is judged whether or not predetermined lines are printed (step 56) after one line is printed (step 55). If the predetermined lines are printed, the paper sheet is discharged. If the predetermined lines are not printed, a line feed width Lg is read out (step 57), and $L_0$ and Lg are added to find the roller displacement $L_1$ at the destination of the line feed (step 58). It is judged whether or not the roller displacement $L_1$ at the destination of the line feed exceeds a displacement $L_1$ (36)=4608 corresponding to the maximum number of partitions 36 during the line feed (see FIG. 19) (step 59). If it exceeds the displacement $L_1$(36)=4608, that is, the reference position of the conveying roller is detected by the circulation sensor in paper feeding to the destination of the line feed, processing of $L_1=L-Lr$ (step 60) is performed, after which the program proceeds to the step 61. On the other hand, if it does not exceed the displacement $L_1$ (36)=4608, the program directly proceeds to the step 61. Lr is a displacement corresponding to the circumference of the conveying roller (4493.7329 pulses).

The above-mentioned processing in the steps 59 and 60 is processing corresponding to the modified point 3.

Figure 23:
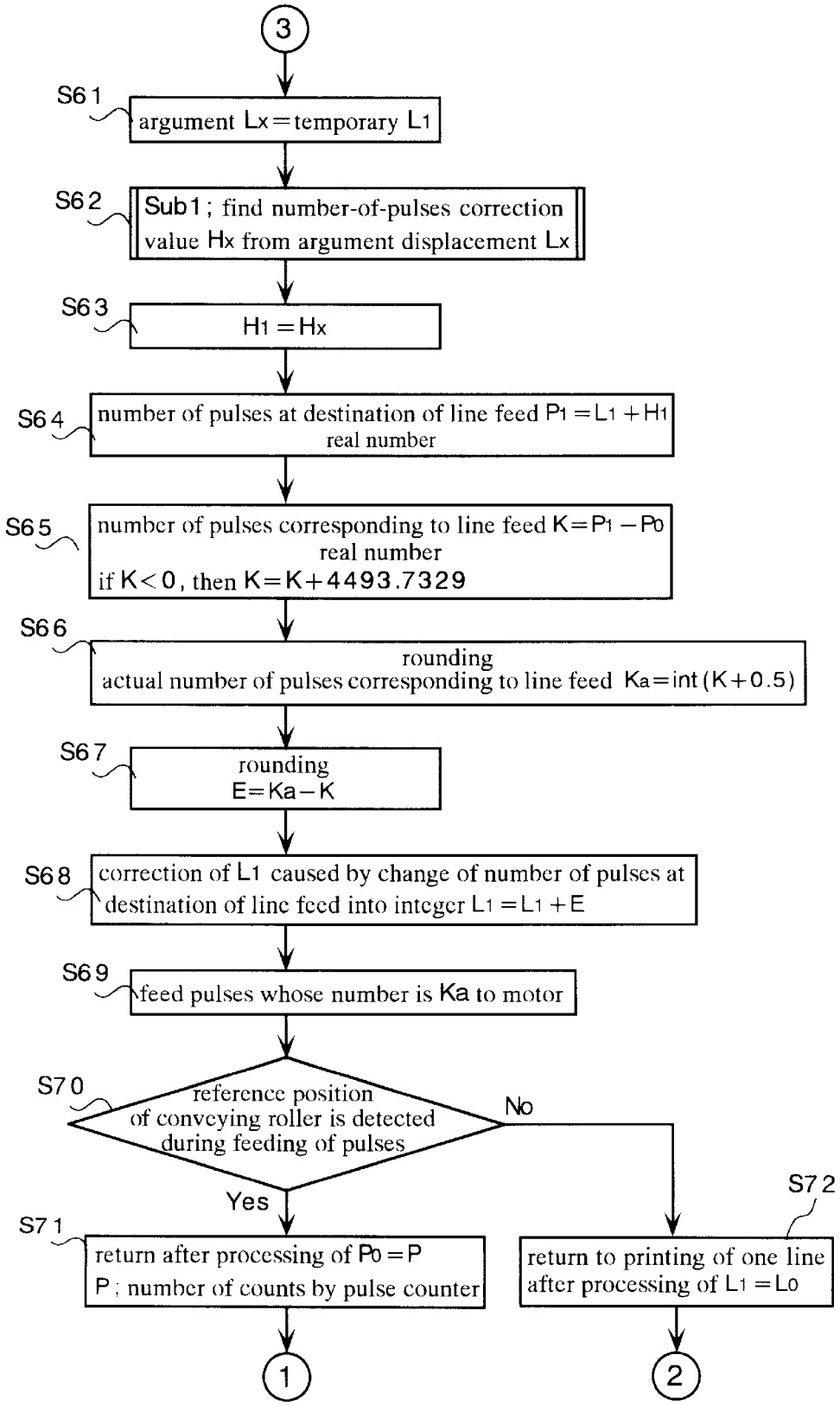
FIG. 23 is a flow chart subsequent to FIG. 22.
Figure 24:
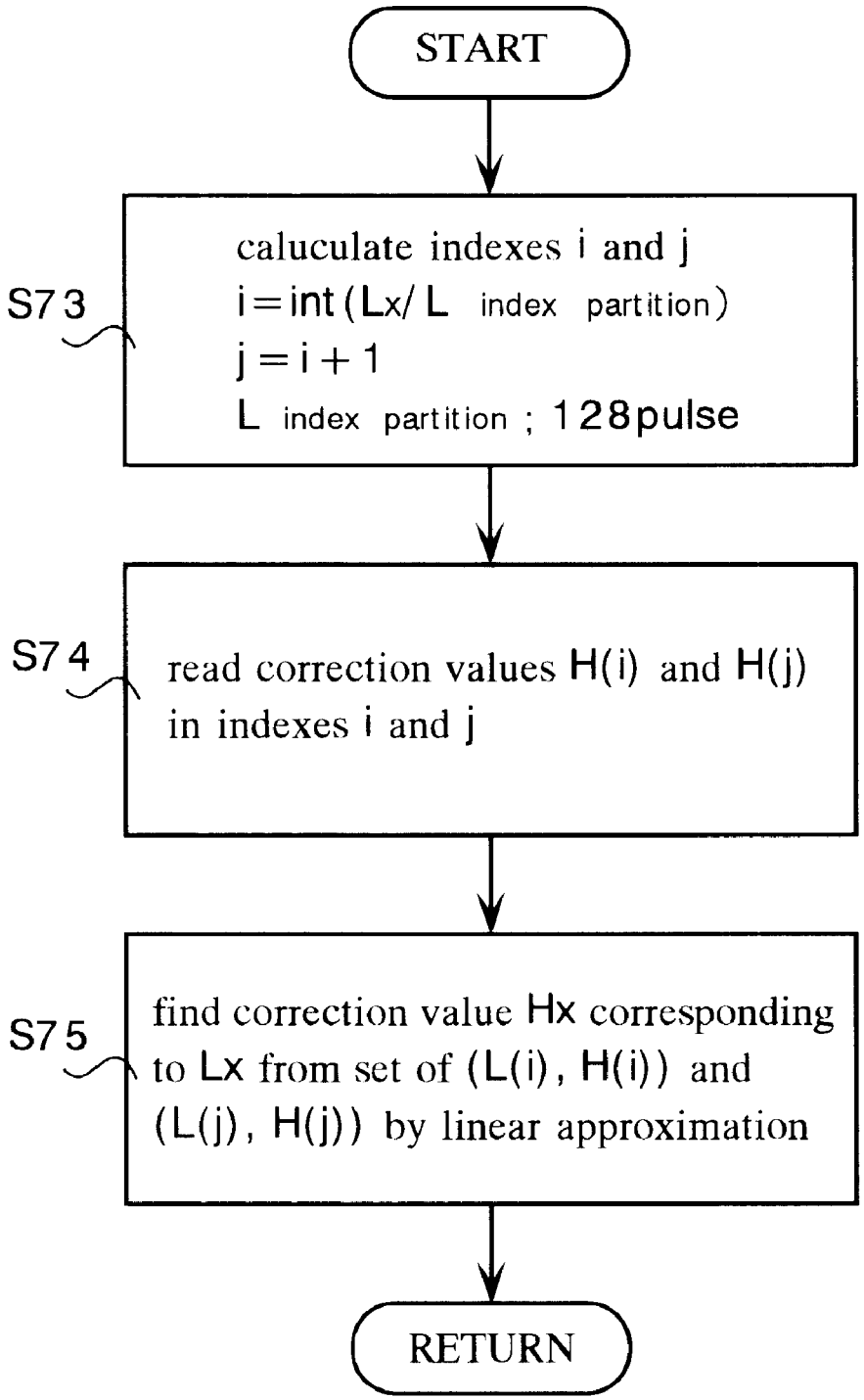
FIG. 24 is a flow chart showing the specific contents in the steps 48 and 62.

As shown in FIG. 23, the number of pulses at the destination of the line feed (the number of pulses after correction, which is a real number, forming the basis of the number of pulses, whose number is an integer, fed to the motor) $P_1$ is calculated from the roller displacement at the destination of the line feed (the target number of pulses, which is a real number, representing the amount of paper feeding at the destination of the line feed). The value of $L_1$ is substituted as an argument displacement Lx (step 61). A number-of-pulses correction value Hx is found from the argument displacement Lx (step 62). This step 62 is specifically carried out by the processing in the steps 73, 74, and 75 shown in FIG. 24. The value of Hx is then substituted as $H_1$ (step 63). The number of pulses $P_1$ (a real number) at the destination of the line feed is found by processing of $P_1=L_1+H_1$ (step 64). The number of pulses K (a real number) at the destination of the line feed is then found by processing of $K=P_1-P_0$ (step 65). If 0>K, then 4493.7329 is added to K. The number of pulses Ka (an integer) for the actual line feed is then found by processing of $Ka=I_{nt}(K+0.5)$ (step 66). E is then found by processing of E=Ka−K in rounding (step 67). Correction of $L_1$ caused by a change of the number of pulses $P_1$ at the destination of the line feed into an integer is made by processing of $L_1=L_1+E$ (step 68).

Processing for feeding the pulses whose number corresponds to Ka to the motor is started (step 69), and it is judged whether or not the reference position of the conveying roller is detected by the circulation sensor 31 during the feeding of pulses (step 70). If it is detected, processing of $P_0=P$ (the number of counts performed by the pulse counter 34) is performed (step 71), after which the program proceeds to the step 45. On the other hand, if it is not detected, processing of $L_1=L_0$ is performed (step 71), after which the program proceeds to the step 55.

The above-mentioned processing in the step 61 to the step 66 corresponds to the step 25 to the step 31 in the first example of control. The processing in the step 67 and the step 68 is simplified processing of processing for calculating L again on the basis of P in the step 34 to the step 10 and the subsequent steps in the first example of control, and is processing corresponding to the modified point 4. The step 71 is processing corresponding to the modified point 5.

Although in the present embodiment, the number of partitions is set to 32 or 36, the present invention is not limited to the same. For example, it may be 4361 or 4494 which corresponds to the number of pulses corresponding to the circumference of the conveying roller.

Furthermore, the amount of conveyance of the paper sheet is measured only by the conveying roller (in an unloaded state), to find the reference number of pulses corresponding to the line feed Lg by linear approximation. However, over initial several lines in printing on one paper sheet, the paper feeding roller is rotated by the movement of the paper sheet, so that such a coupled driven operation will be a load in conveying the paper sheet, whereby a slip of approximately 0.04% occurs. This corresponds to a slip of 16.68 mm in a case where the width of one line is taken as 16.7 mm. The slip of 16.68 mm corresponds to approximately 0.8 upon being converted into the number of pulses.

Therefore, it is desired that the reference number of pulses Lg is added in a corresponding amount ΔPg over the several lines.

On the other hand, one paper sheet is conveyed only by the conveying roller (a capstan roller) in the second half thereof, so that the reference number of pulses corresponding to the line feed need not be changed.

In one line in an intermediate portion of the paper sheet, a state where the paper feeding roller is a load and a state where it is not a load continuously arise. In this case, it is desirable that the reference number of pulses Lg is added in a corresponding amount ΔPg/2 (the denominator may be a numerical value corresponding to the ratio of the states).

Embodiment 4

Description is now made of another embodiment of the present invention. In the embodiment 3, letting L be the target number of pulses, which is a real number, corresponding to the amount of actual displacement of the conveying roller, and H be a number-of-pulses correction value, which is a real number, corresponding to the target number of pulses L, the number of feed pulses P, which is a real number, forming the basis of the number of feed pulses, whose number is an integer, fed to the motor for driving the conveying roller is calculated by P=L+H, and the number of pulses corresponding to one line feed is calculated by P in the current line and P in the succeeding line.

In the embodiment 4, letting L be the target number of pulses, which is a real number, corresponding to the amount of actual displacement of the conveying roller, P be the number of feed pulses, which is a real number, forming the basis of the number of feed pulses, whose number is an integer, fed to the motor for driving the conveying roller, and A be a number-of-pulses correction value, which is a real number, corresponding to the number of feed pulses P, the target number of pulses L is calculated by L=P+A, and the number of pulses corresponding to the line feed is calculated by L in the current line and L in the subsequent line as the amount of displacement actually corresponding to L even if the pulses whose number is P are fed to the motor. The number-of-pulses correction value A may be stored in a storage portion in the same form as that shown in FIG. 8.

Figure 25:
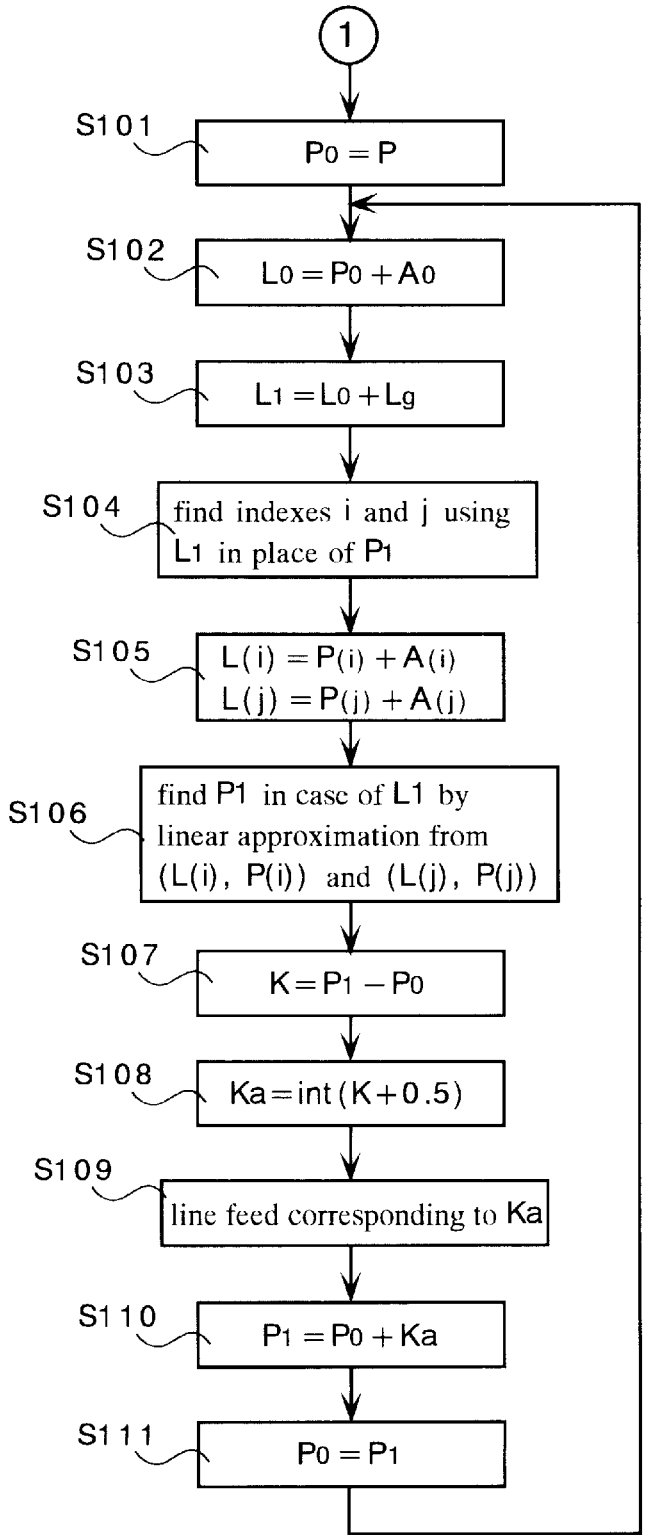
FIG. 25 is a flow chart showing a first example of control carried out by a control section in a fourth embodiment of the present invention.

FIG. 25 is a flow chart showing the contents of first control in the present embodiment, which corresponds to FIGS. 9 to 13, and is shown in a simplified manner in order to avoid the overlapping of description. Processing of $P_0=P$ is performed (step 101) in the same manner as the processing in the step 7 and the previous steps in FIG. 9. Processing of $L_0=P_0+A_0$ is then performed (step 102). That is, $A_0$ corresponding to $P_0$ is acquired on the basis of the number of pulses $P_0$ fed to the motor, to acquire the amount of actual roller displacement $L_0$. The amount of actual roller displacement at the destination of one line feed is acquired by processing of $L_1=L_0+Lg$ (step 103). Indexes i and j are then found using $L_1$ in place of $P_1$ (step 104). Calculation processing of L(i)=P(i)+A(i) and L(j)=P (j)+A(j) is performed (step 105). Further, $P_1$ in the case of $L_1$ is further found by linear approximation from (L(i), P(i)) and (L(j), P(j)) (step 106).

The number of pulses K, which is a real number, corresponding to the line feed is then found by an operation of $K=P_1-P_0$ (step 107). K is rounded to an integer, to find Ka (step 108), and a line feed operation corresponding to Ka is performed (step 109). Further, processing of $P_1=P_0+Ka$ is performed (step 110), and $P_0=P_1$ (step 111), after which the program is returned to the step 101.

A serial head type recorder in which such control is carried out also comprises a conveying roller for conveying a paper sheet, a motor rotated through a predetermined angle in response to the number of pulses, a group of gears for transmitting torque produced by the motor to the conveying roller, and a serial head for doing printing on the paper sheet. The speed reducing ratio of at least a gear directly connected to the conveying roller to a gear engaged therewith in the group of gears is set to a ratio of integers. The serial head type recorder may be constructed as shown in FIG. 7 so that means for performing processing corresponding to each of the steps is realized by a control section 33.

Figure 26:
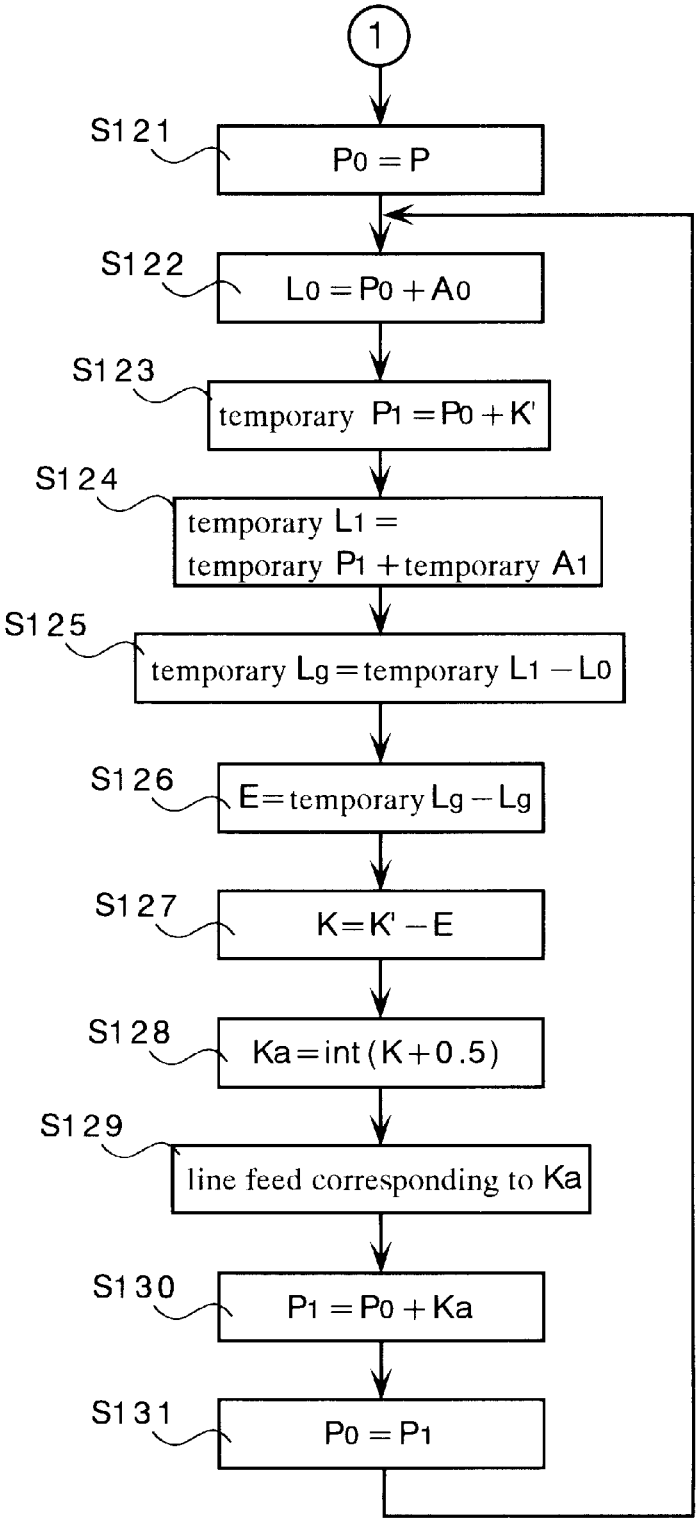
FIG. 26 is a flow chart showing a second example of control carried out by the control section in the fourth embodiment of the present invention.

FIG. 26 is a flow chart showing the contents of second control in the present embodiment, which corresponds to FIGS. 20 to 24, and is shown in a simplified manner in order to avoid the overlapping of description. Processing of $P_0=P$ is first performed (step 121) in the same manner as the processing in the step 44 and the previous steps in FIG. 20. Processing of $L_0=P_0+A_O$ is then performed (step 122). The temporary number of feed pulses at the destination of one line feed is then acquired by processing of temporary $P_1=P_0+K'$ (step 123). K' is the reference number of pulses corresponding to the line feed, and may be determined in any manner. However, a line feed width Lg is used in place of K' herein. The amount of actual roller displacement in a case where it is assumed that the pulses whose number is the temporary $P_1$ are fed to the motor is calculated by processing of temporary $L_1$=temporary $P_1$+temporary $A_1$ (step 124).

An error E from a line feed with Lg is found by processing of temporary Lg=temporary $L_1-L_0$ (step 125) and processing of E=temporary Lg−Lg (step 126), and K' is corrected by considering the error E, to find the number of pulses K, which is a real number, corresponding to the line feed (K=K'−E) (step 127). K is rounded to an integer, to find Ka (step 128), and a line feed operation corresponding to Ka is performed (step 129). Further, processing of $P_1=P_0+Ka$ is performed (step 130), and $P_0=P_1$ (step 131), after which the program is returned to the step 121.

A serial head type recorder in which such control is carried out also comprises a conveying roller for conveying a paper sheet, a motor rotated through a predetermined angle in response to the number of pulses, a group of gears for transmitting torque produced by the motor to the conveying roller, and a serial head for doing printing on the paper sheet. The speed reducing ratio of at least a gear directly connected to the conveying roller to a gear engaged therewith in the group of gears is set to a ratio of integers. The serial head type recorder may be constructed as shown in FIG. 7 so that means for performing processing corresponding to each of the steps is realized by the control section 33.

It is not desirable from the viewpoint of prevention of the degradation of the gears that the speed reducing ratios determined by all the gears are respectively taken as ratios of integers with respect to the roller. Therefore, in the above-mentioned embodiment, the speed reducing ratio of a roller shaft to a small gear engaged therewith is taken as a ratio of integers.

However, the non-uniformity in conveyance of a third shaft is approximately ±6 μm, which cannot be ignored. Letting $1_3$ be the amount of conveyance (a period) in a case where the third shaft circulates once, the non-uniformity in conveyance can be significantly reduced if the speed reducing ratio of the third shaft to the roller shaft is so determined that the amount of conveyance $1_3$ and the printing width are optimized. Moreover, the speed reducing ratio is not a ratio of integers, so that the degradation of the gears is not promoted.

$$1_3=\phi 12.15\ \pi\times(13/52)\times(19/41)=4.4222\ \text{mm}$$

Figure 27:
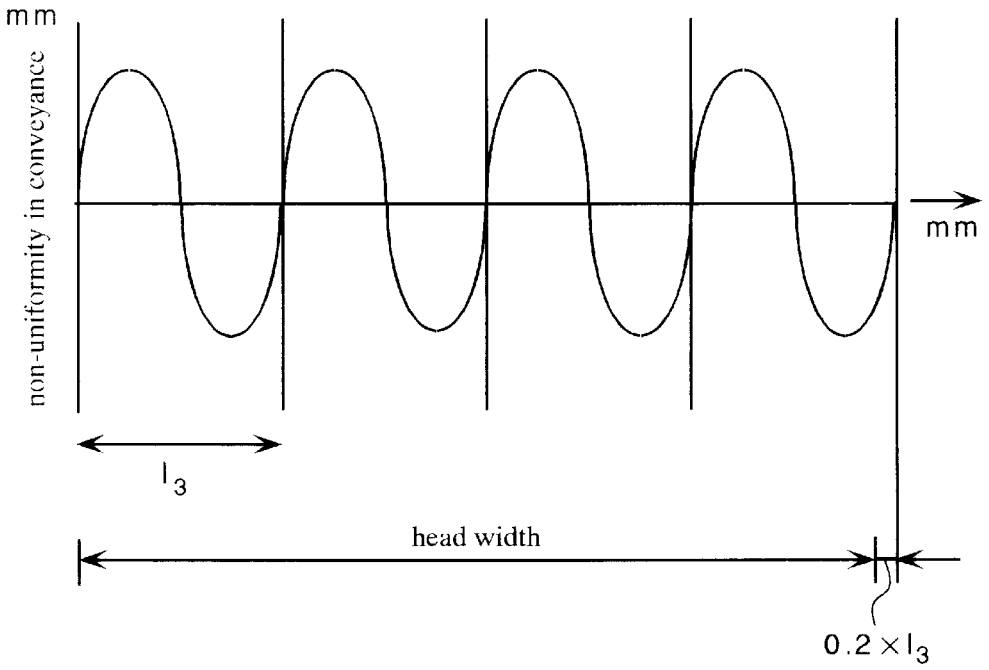
FIG. 27 is a diagram showing the relationship between the head width and non-uniformity in conveyance caused by a third shaft, showing how a period of approximately 0.2 occurs as a phase difference.

(52)→the number of teeth of a large gear in the first shaft (13)→the number of teeth of a small gear in the first shaft (41)→the number of teeth of a large gear in the second shaft (19)→the number of gears of a small gear in the second shaft The printing width B is B=95 dots×25.4 mm/144 dpi =16.7569 mm. Further, $B/1_3=3.79$. Consequently, the phase difference is a period of approximately 0.2, as shown in FIG. 27.

Figure 28:
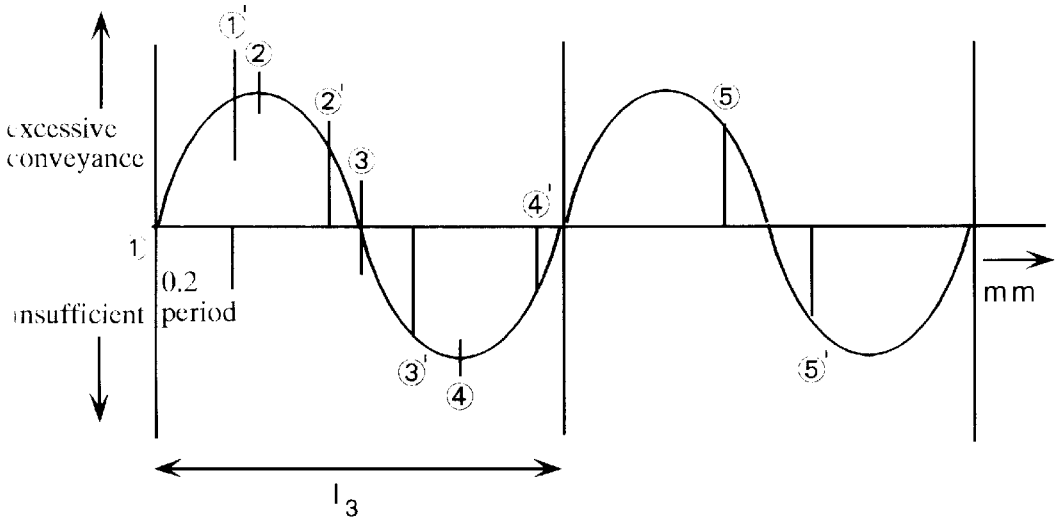
FIG. 28 is an illustration showing deviation between lines (①~①', ②~②', etc.) due to the phase difference of a period of 0.2.

Deviation between lines which can be considered by the phase difference $0.2\times1_3$ corresponds to ①~①', ②~②', . . . ⑤~⑤' in FIG. 28. On calculation, the deviation between lines is 6 μm×1.175=7 μm. Consequently, it is most desirable that the phase difference is zero. The roller diameter, the speed reducing ratio of the third shaft to the roller shaft, and the printing width are so determined that $B/1_3=n$ (n is an integer). 1.175 is the value of a multiplier representing the maximum effect of the phase found on calculation.

If the speed reducing ratio of the third shaft to the roller shaft and the roller diameter are determined by a printer, the printing width may be adjusted.

$$m\ \text{dots}\times 25.4\ \text{mm}/144\ \text{dpi}=n\cdot 4.4222\ \text{mm}$$

If n is taken as 4 close to 3.79, m=100 dots

If n is taken as 3 close to 3.79, m=75 dots

Even if the ratio of gears cannot be changed into a ratio of integers, therefore, the effect of the non-uniformity in conveyance can be reduced.

The technique of the embodiment 4 may be also applied to a fourth shaft and a fifth shaft. The closer the shaft is to the roller shaft, the higher the order of priority thereof is. When the printing width is set in correspondence to the third shaft, the speed reducing ratio, for example, may be set with respect to the fourth shaft or the like.

Embodiment 5

An embodiment of the present embodiment will be described with reference to the drawings.

Figure 29:
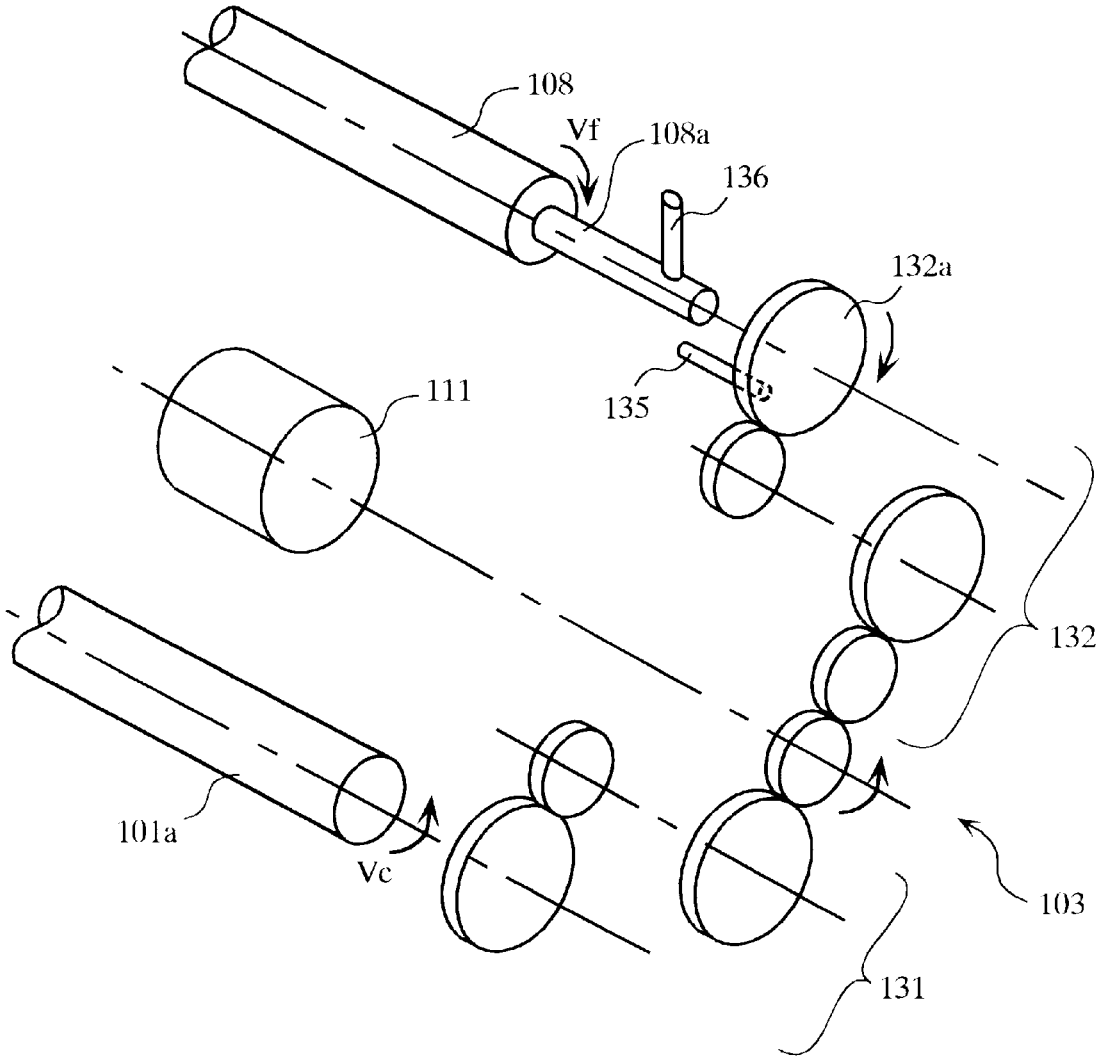
FIG. 29 is a perspective view showing a paper conveying mechanism in a serial head type recorder according to a fifth embodiment of the present invention.
Figure 30:
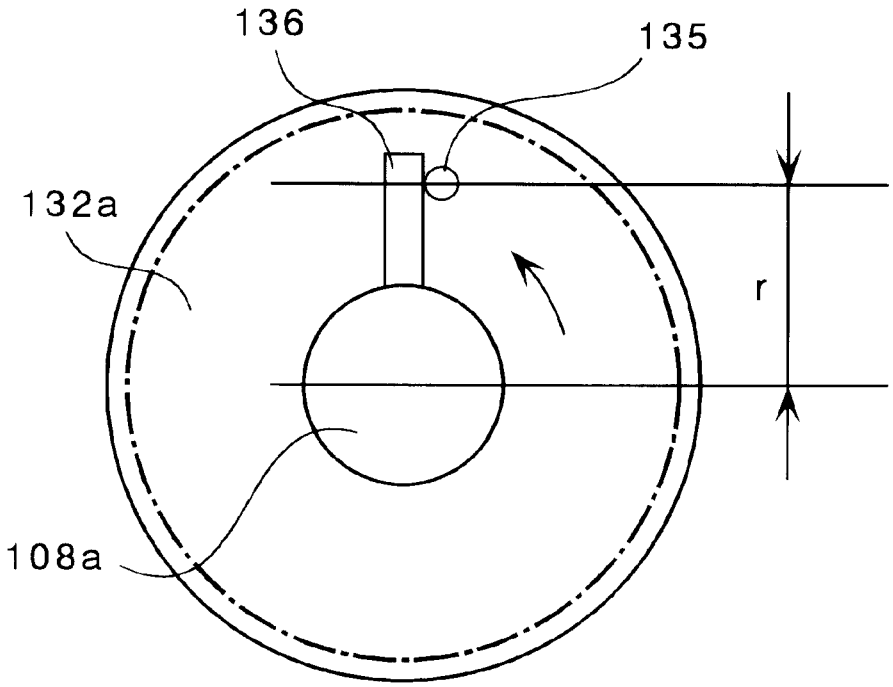
FIG. 30 is an enlarged view showing the positional relationship between a gear-side pin and a paper feeding roller-side pin in FIG. 29.

FIG. 29 is a perspective view showing a paper conveying mechanism of a color recorder in the embodiment of the present invention. A driving force produced by a pulse motor 111 is respectively transmitted to a conveying roller 101*a* and a paper feeding roller 108 through a first transmission gear system 131 and a second transmission gear system 132 in a group of gears 103. A paper feeding gear (a gear in the final stage) 132*a* in the second transmission gear system 132 is provided with a gear-side pin 135 which is a projection in a position at a predetermined distance r away from its center of rotation, as also shown in an enlarged view of FIG. 30. A shaft portion 108*a* at a side end of the paper feeding roller 108 is provided with a roller-side pin 136 which is a projection protruding in its radial direction. The gear-side pin 135 which circulates abuts against the roller-side pin 136, so that the roller-side pin 136 is pressed so that the paper feeding roller 108 is rotated. The diameters of the rollers 101 and 108 and/or the ratio of gears in each of the first transmission gear system 131 and the second transmission gear system 132 are so set that the peripheral speed Vc of the conveying roller 101*a* is higher than the peripheral speed Vf of the paper feeding roller 108.

Figure 31:
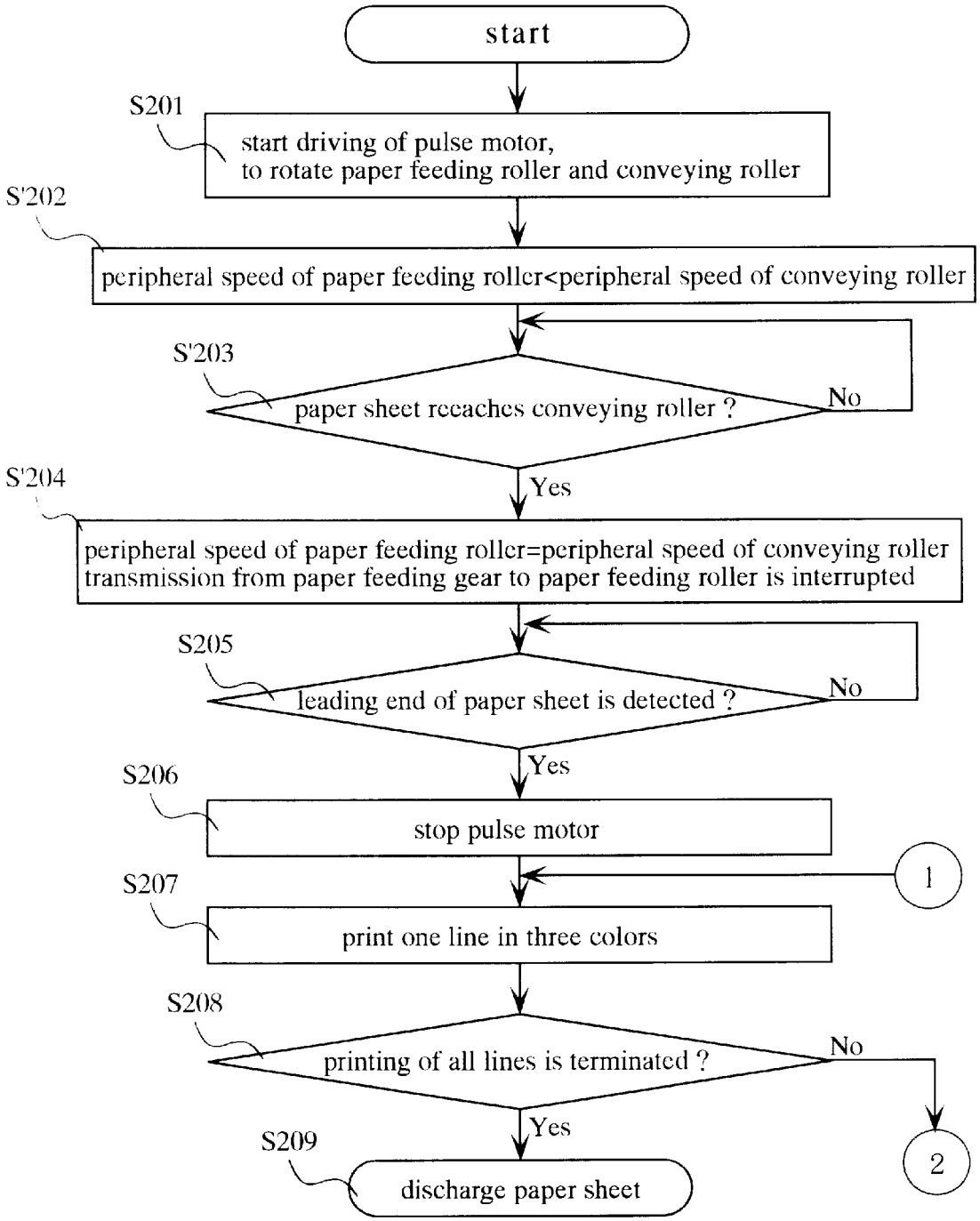
FIG. 31 is a flow chart showing the contents of control at the time of a printing operation, for example, in the fifth embodiment of the present invention.
Figure 32:
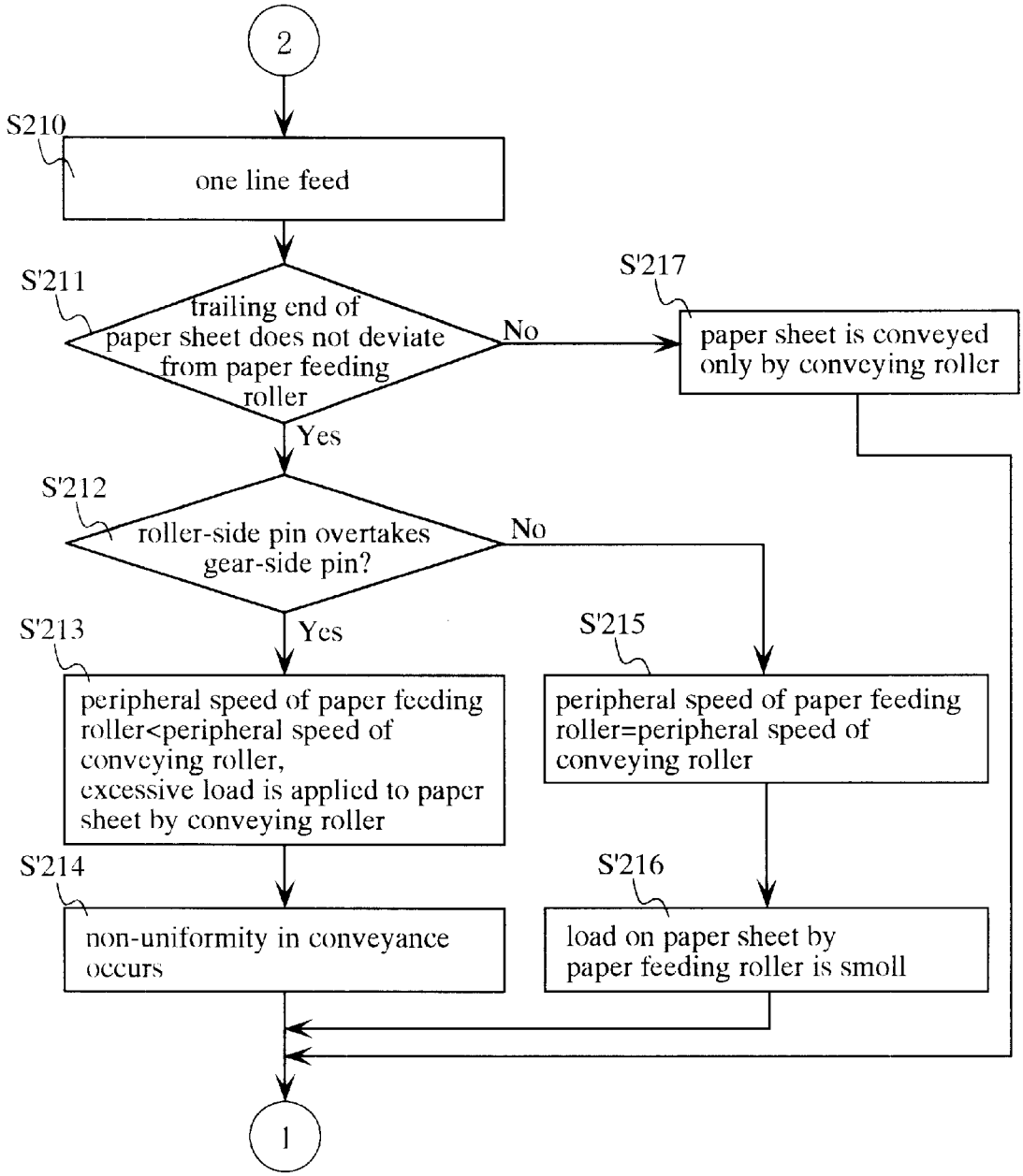
FIG. 32 is a flow chart subsequent to FIG. 31.

FIGS. 31 and 32 are flow charts showing the contents of printing control in the color recorder in the embodiment of the present invention. Part of operations (states) which are not control operations are also described, which are denoted by S'. The driving of the pulse motor 111 is started, to rotate the paper feeding roller 108 and the conveying roller 101*a*

(step 201). At this time, a state where the paper sheet is conveyed only by the paper feeding roller 108 is formed, and the gear-side pin 135 abuts against the roller-side pin 136. The speed relationship between the paper feeding roller 108 and the conveying roller 101*a* is the peripheral speed Vf of the paper feeding roller 108<the peripheral speed Vc of the conveying roller 101*a* as described above (S'202).

When the leading end of the paper sheet 110 is interposed between the conveying roller 101*a* and the pinch roller 101*b* (see FIG. 33), that is, the paper sheet 110 stretches over both the paper feeding roller 108 and a paper conveying roller section 101, the paper sheet is conveyed at the peripheral speed Vc of the conveying roller 101*a* and is dragged by the friction of the paper sheet, so that the paper feeding roller 108 is also rotated at the peripheral speed Vc (S'203, S'204). That is, the paper feeding roller 108 enters a coupled driven state. In the coupled driven state, the rotational speed of the paper feeding gear 132*a* is below the rotational speed of the paper feeding roller 108, whereby the roller-side pin 136 circulates at a higher speed than that of the gear-side pin 135.

Resistance produced in the coupled driven state is only rotating resistance produced by a bearing of the paper feeding roller 108, and there is no sliding resistance produced by the spring clutch in the conventional example, so that the load is significantly light. In experiments, the amount of slip is several ten micrometers with respect to a line feed width of 17 mm, and is significantly reduced, as compared with several hundred micrometers in the conventional example. This is considered to be affected by the resistance produced by friction between paper sheets rather than the rotating resistance produced by the paper feeding roller 108 because the larger the number of paper sheets stocked on the paper feeding plate is, the larger the amount of slip is. The amount of slip is slight, whereby it can be improved by correcting the amount of rotation (the number of pulses fed to the pulse motor) of the conveying roller 101*a* corresponding to one line by the amount of slip.

It is then judged whether or not the leading end of the paper sheet is detected by a sensor (not shown) (step 205). If the leading end of the paper sheet is detected, the driving of the pulse motor 111 is stopped (step 206), one color recording and scanning line is formed (step 207), and it is judged whether or not printing of all lines is terminated (step 208). A paper discharge operation is performed if printing of all the lines is terminated (step 209), while a line feed operation is performed if printing of all the lines is not terminated (step 210).

At the time of the line feed operation, if the trailing end of the paper sheet deviates from the paper feeding roller 108 (NO in S'211), the paper sheet is conveyed only by the paper conveying roller 101*a* (S'217). On the other hand, if the paper sheet does not deviates (YES in S'211), and the roller-side pin 136 does not overtake the gear-side pin (NO in step S'212), the coupled driven state of the paper feeding roller 108 is continued (S'215), and the load applied to the paper sheet by the paper feeding roller 108 is decreased as described above (S'216). When the roller-side pin 136 overtakes the gear-side pin 135 (YES in S'212), the free rotation (the coupled driven operation) of the paper feeding roller 108 is prevented, so that an excessive load is applied to the paper sheet by the conveying roller 101*a* (S'213), and non-uniformity in conveyance occurs (S'214).

Conditions for preventing the roller-side pin 136 from overtaking the gear-side pin 135, that is, preventing the answer from being in the affirmative in the step S'212, to produce no non-uniformity in conveyance by the excessive load in the steps S'213 and S'214 will be described on the basis of FIG. 33.

Figure 33:
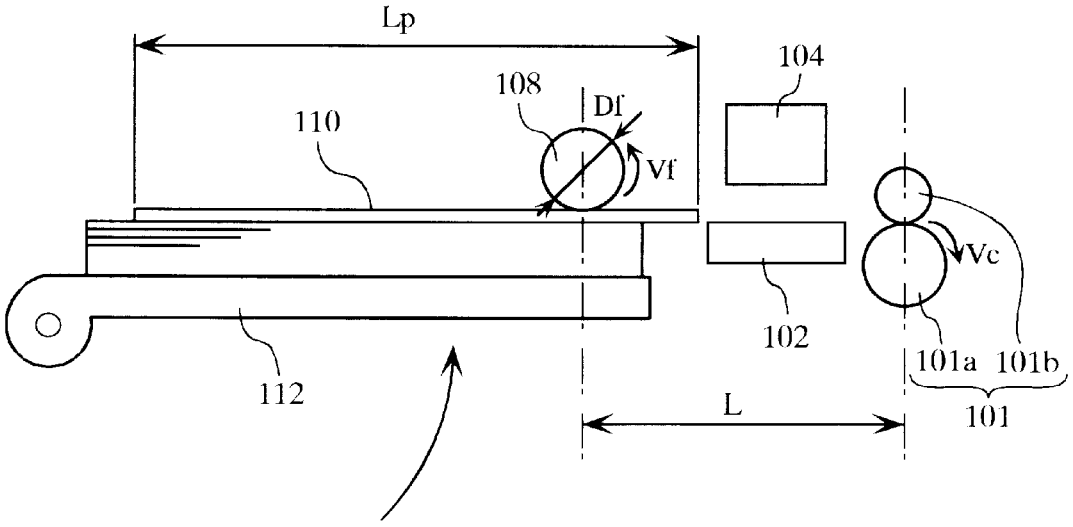
FIG. 33 is an illustration showing the arrangement and the dimensions, for example, of principal sections of the serial head type recorder according to the fifth embodiment of the present invention.
Figure 34:
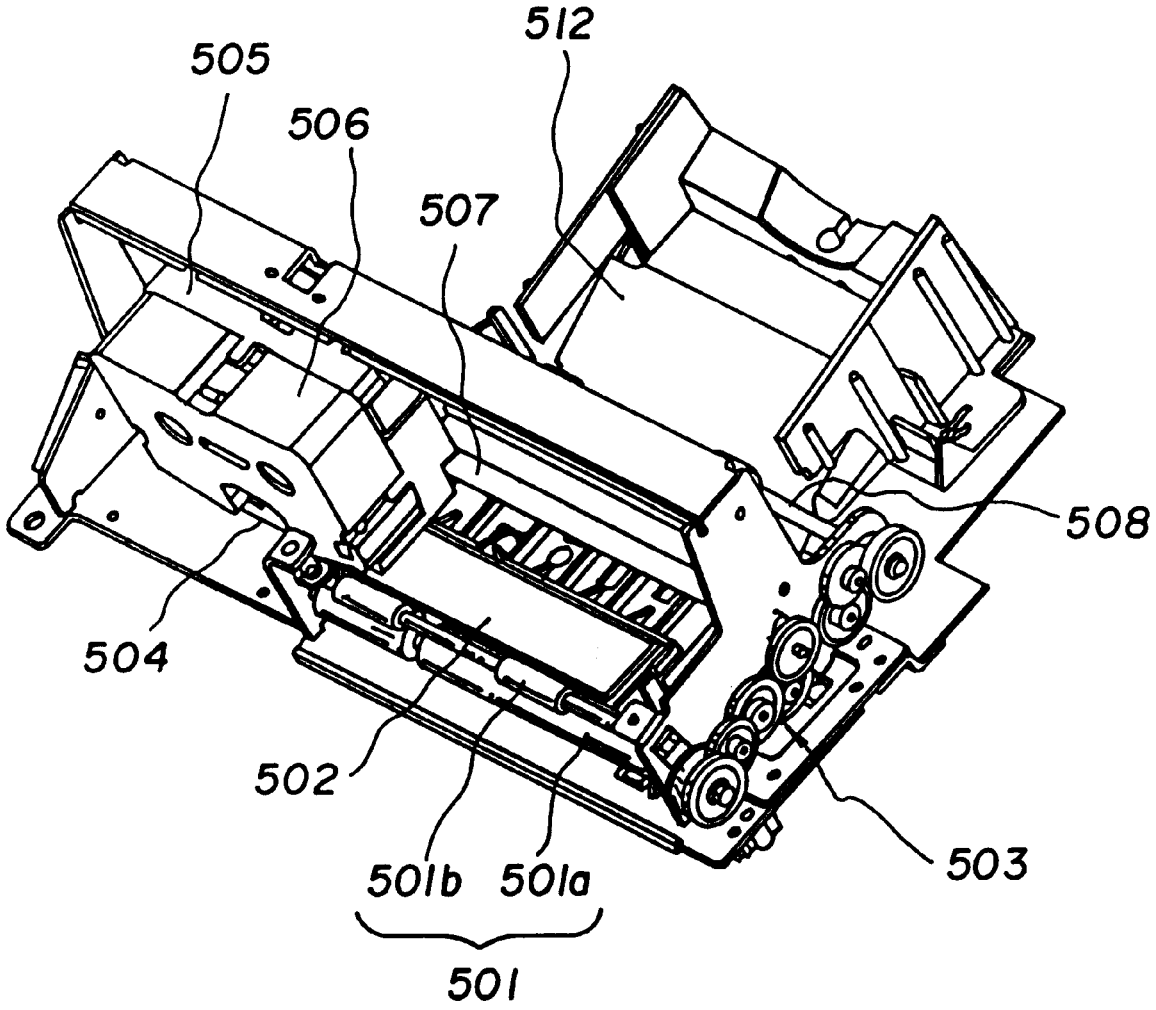
FIG. 34 is a perspective view showing a mechanism of a conventional serial head type recorder.
Figure 35:
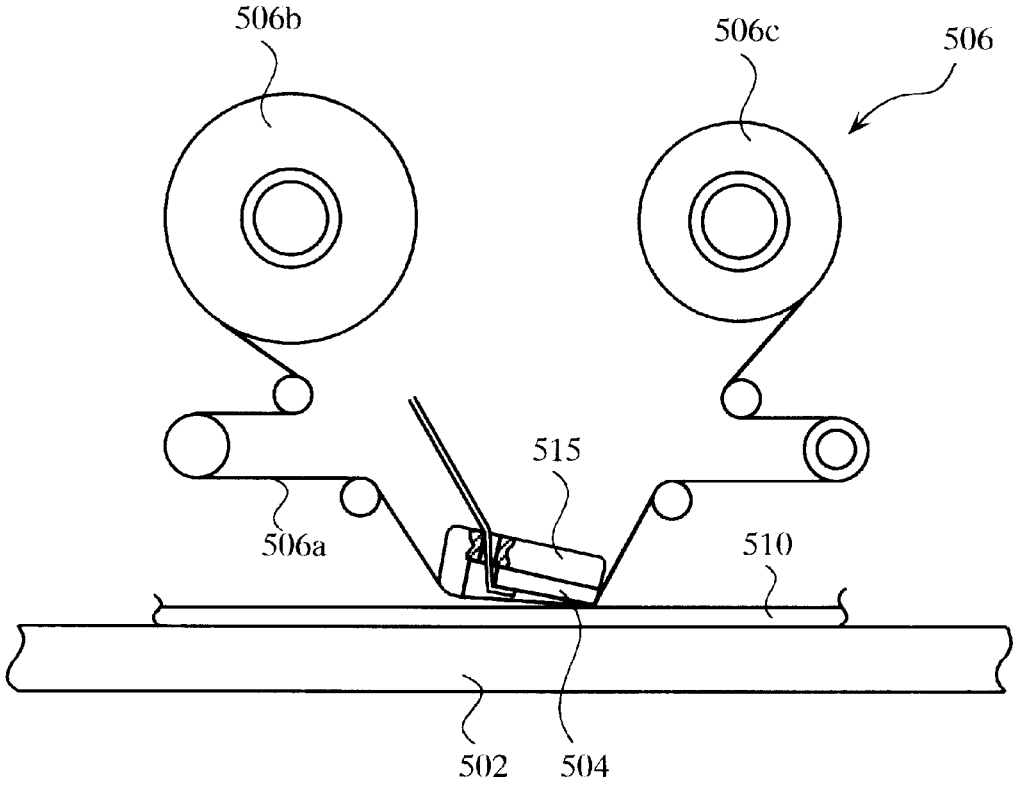
FIG. 35 is a perspective view showing a printing mechanism in the serial head type recorder shown in FIG. 34.
Figure 36:
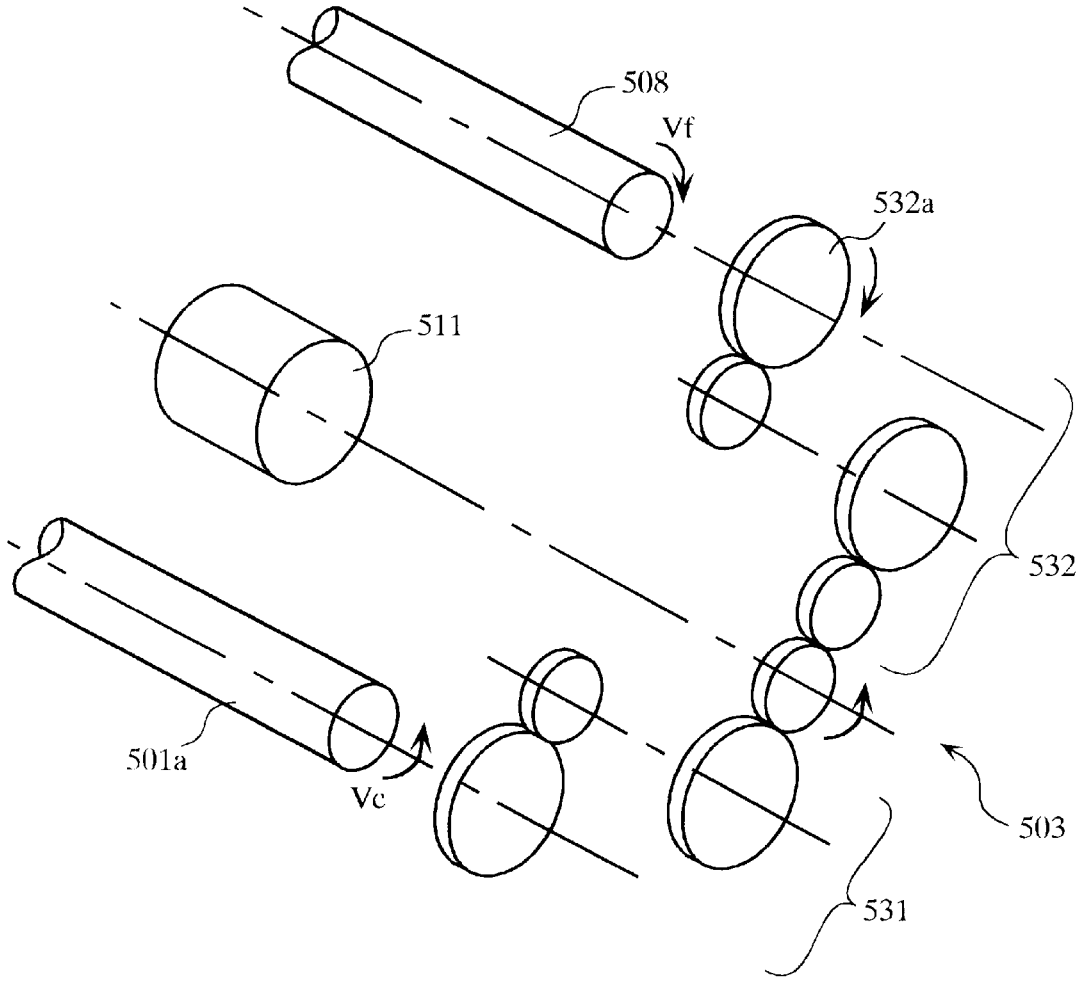
FIG. 36 is a perspective view showing a paper conveying mechanism in a conventional serial head type recorder.
Figure 37:
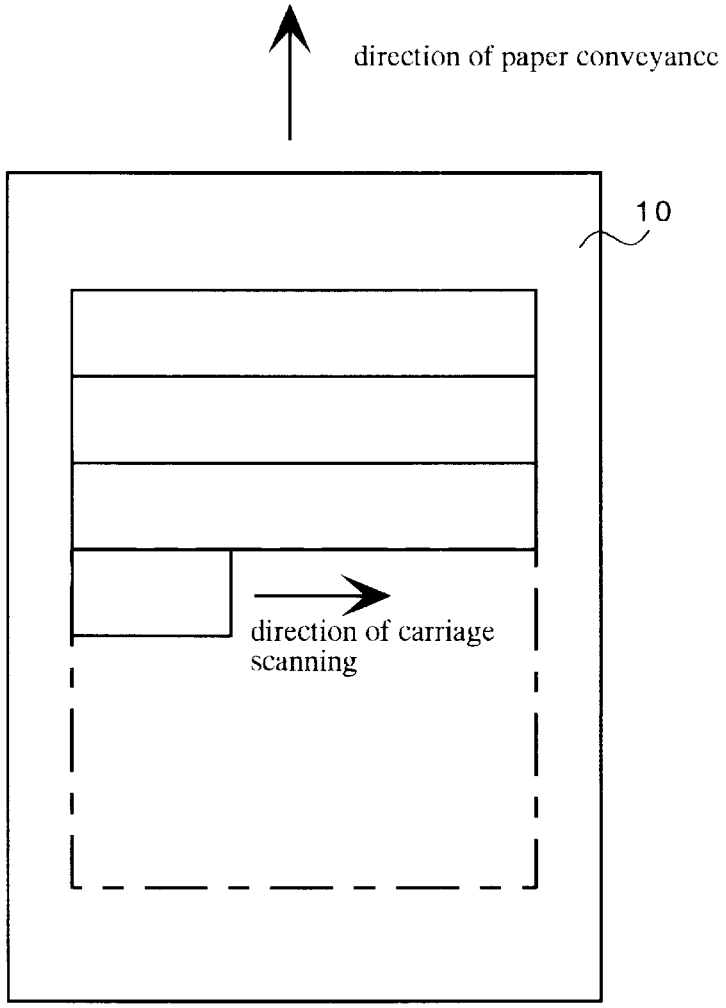
FIG. 37 is an illustration showing how scanning and recording lines are formed on a paper sheet.
Figure 38:
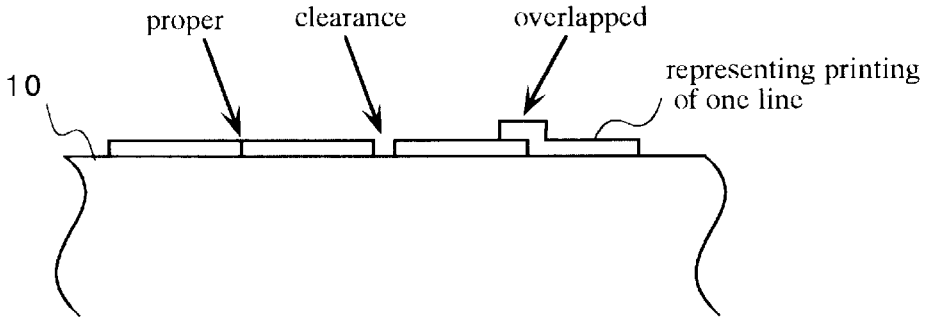
FIG. 38 is an illustration showing how a clearance occurs between scanning and recording lines, and the scanning and recording lines are overlapped with each other.
Figure 39:
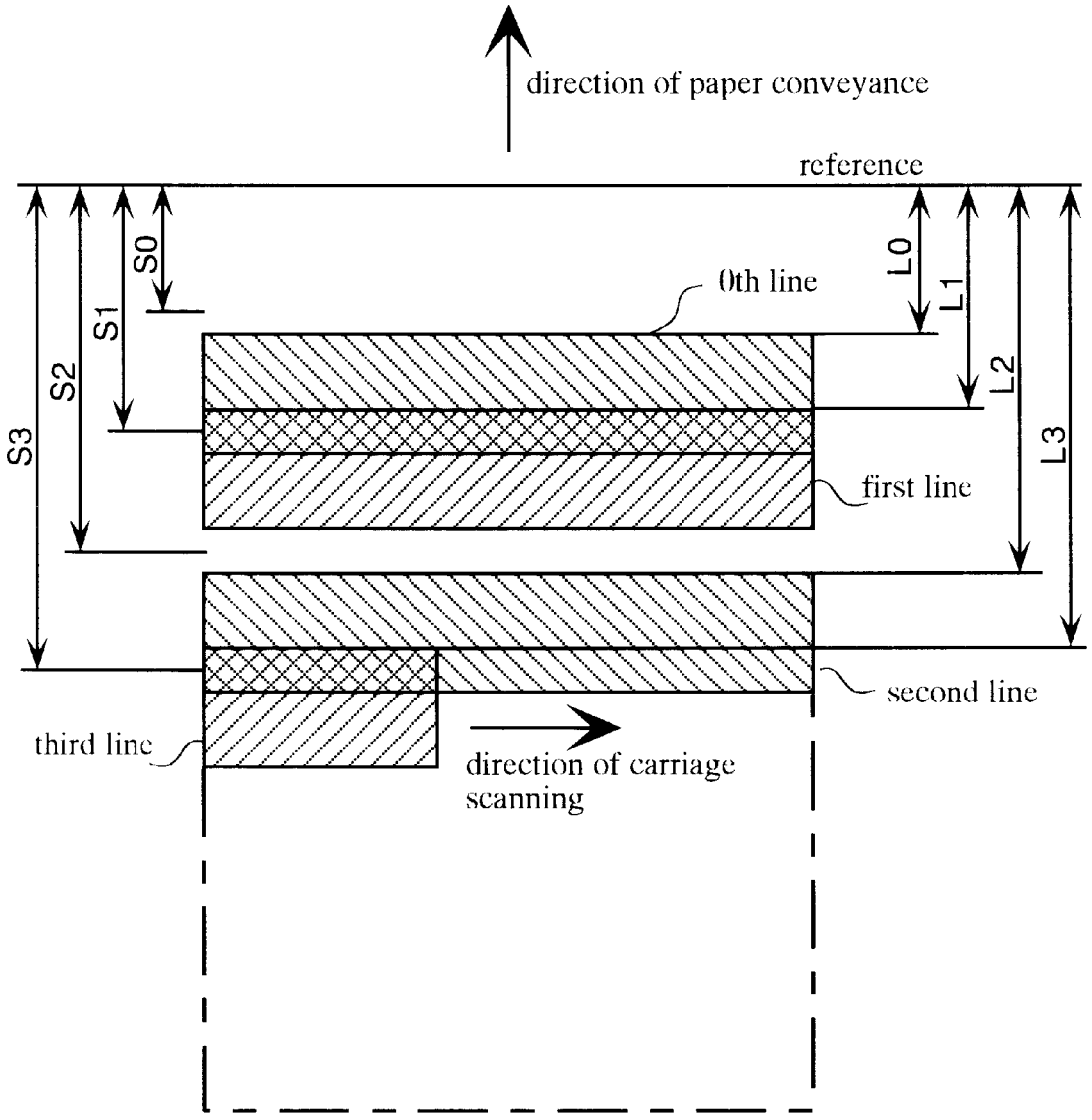
FIG. 39 is an illustration showing the specific relationship between non-uniformity in conveyance and deviation between lines.

FIG. 33 illustrates the dimensions and the like of respective sections of the color recorder. Let Lp be the length in the direction of conveyance of the paper sheet 110, L be the length of a paper path from the paper feeding roller 108 to the paper conveying section 101, Vc be the peripheral speed of the conveying roller 101*a*, Df be the diameter of the paper feeding roller 108, and Vf be the peripheral speed of the paper feeding roller 108 in a case where the paper sheet is conveyed only by the paper feeding roller 108. Letting π be the ratio of the circumference of circle to its diameter, the relationship as expressed by the following second expression is set:

$$\pi \times Df > (Lp-L) \times (1-Vf/Vc) \qquad \text{second expression}$$

Letting ωg be the angular velocity of the paper feeding roller 108 in a case where the paper sheet 110 is conveyed only by the paper feeding roller 108 (the angular velocity of the gear-side pin 135), and ωfr be the angular velocity at the time of the coupled driven operation of the paper feeding roller 108 (the angular velocity of the roller-side pin 136), ωg and ωfr are expressed by the following third and fourth equations:

$$\omega g = 2 \times Vf/Df \qquad \text{third equation}$$

$$\omega fr = 2 \times Vc/Df \qquad \text{fourth equation}$$

Letting r be the radius in the position where the roller-side pin 136 and the gear-side pin 135 are brought into contact with each other, and Va be the peripheral speed of the gear-side pin 135, the following fifth equation holds. Further, letting Vb be the peripheral speed of the roller-side pin 136 at the time of the coupled driven operation of the paper feeding roller 108, the sixth equation holds:

$$Va = r \times \omega g \qquad \text{fifth equation}$$

$$Vb = r \times fr \qquad \text{sixth equation}$$

The relative speed ΔVab between the peripheral speed Va of the gear-side pin 135 and the peripheral speed Vb of the roller-side pin 136 is ΔVab=Vb−Va. The following seventh equation is obtained by the third equation to the sixth equation:

$$\Delta Vab = (2r/Df) \times (Vc-Vf) \qquad \text{seventh equation}$$

The distance from the position where the leading end of the paper sheet 110 reaches the conveying roller 101*a* to the position where the trailing end of the paper sheet 110 deviates from the paper feeding roller 108 is Lp−L. Time t required for the paper sheet to be conveyed by the distance is expressed by the eighth equation:

$$t = (Lp-L)/Vc \qquad \text{eighth equation}$$

During this time t, the distance Lab at which the roller-side pin 136 separates from the gear-side pin 135 is expressed by the ninth equation. The tenth equation is obtained from the seventh equation and the eighth equation:

$$Lab = t \times \Delta Vab \qquad \text{ninth equation}$$

$$Lab = 2r(Lp-L) \times (Vc-Vf)/(VcDf) \qquad \text{tenth equation}$$

During the above-mentioned time t, conditions expressed by the eleventh equation are required in order that the roller-side pin 136 does not overtake the gear-side pin 135. The foregoing second expression is obtained by the tenth equation:

$$2\pi r > Lab \quad \text{eleventh expression}$$

$$\pi \times Df > (Lp - L) \times (1 - Vf/Vc) \quad \text{second expression}$$

Letting V' be the relative speed difference (1−Vf/Vc), ΔL be the remainder of the paper sheet (Lp−L), and Sf be the length πDf of the circumference of the paper feeding roller 108, the second expression is represented as the twelfth expression:

$$Sf > \Delta LV', \text{ where } 0 < V' < 1 \quad \text{twelfth expression}$$

In the case of such setting, the roller-side pin 136 does not overtake the gear-side pin 135, so that the non-uniformity in conveyance caused by the excessive load in the foregoing steps S'213 and S'214 is prevented.

The present embodiment has the advantage in that suitable spacing between paper sheets is obtained by continuous paper feeding. This will be described. The paper feeding roller 108 always presses the paper sheet 110 put on a paper feeding plate 112. When power is transmitted to the paper feeding roller 108 from a paper feeding gear 132*a,* therefore, paper feeding is performed. When the first paper sheet is fed, printing progresses, and the trailing end of the first paper sheet 110 deviates from the paper feeding roller 108, however, the rotation of the paper feeding roller 108 by the movement of the paper sheet 110 is stopped. The gear-side projection 135 of the paper feeding gear 132*a* and the roller-side pin 136 of the paper feeding roller 108 are spaced apart from each other. Even if the paper feeding roller 108 is stopped, therefore, power is not immediately transmitted to the paper feeding roller 108 from the paper feeding gear 132*a*. Consequently, the subsequent paper feeding operation is not performed during this time. Since the first paper sheet 110 is conveyed by the conveying roller 101*a,* a suitable distance is ensured between the trailing end of the first paper sheet and the leading end of the second paper sheet. Consequently, a reciprocating operation in scanning of a carriage 5 shown in FIG. 1 is not prevented by the floating of the leading end of the second paper sheet during printing on the second half of the first paper sheet.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A serial head type recorder comprising a conveying roller for conveying a paper sheet, a motor rotated through a predetermined angle in response to the number of pulses, a group of gears for transmitting torque produced by the motor to said conveying roller, and a serial head for doing printing on the paper sheet, wherein the amount of feeding corresponding one line feed of the paper sheet by said conveying roller is set to an integral multiple of the length of the circumference of the conveying roller, and the printing width of said serial head is set to not less than said amount of feeding.

2. The serial head type recorder according to claim 1, wherein the speed reducing ratio of at least a gear directly connected to said conveying roller to a gear engaged therewith in said group of gears is a ratio of integers.

3. A serial head type recorder comprising a paper conveying roller section comprising a conveying roller for conveying a paper sheet and a pinch roller provided opposite to the conveying roller for interposing said paper sheet between the pinch roller and the conveying roller, a serial head for doing printing on the paper sheet, a paper feeding plate on which the paper sheet is put, a paper feeding roller for feeding the paper sheet upon abutting against the paper sheet put on the paper feeding plate, a motor for producing a driving force, a first transmission gear system for transmitting the driving force to said conveying roller from the motor, and a second transmission gear system for transmitting the driving force to said paper feeding roller from said motor, wherein the roller diameters of said conveying roller and the said paper feeding roller and/or the ratio of gears in each of the first transmission gear system and the second transmission gear system are so set that the peripheral speed of the conveying roller is higher than the peripheral speed of the paper feeding roller, the gear in the final stage in said second transmission gear system is provided with a gear-side projection at a predetermined distance from its center of rotation, said paper feeding roller has a roller-side projection protruding in its radial direction provided in its side end, and the roller-side projection is pressed upon abutment of the gear-side projection which circulates against the roller-side projection, so that the paper feeding roller is rotated.

4. The serial head type recorder according to claim 3, wherein the roller-side projection circulates at higher speed than the gear-side projection in a state where the paper sheet stretches over both the paper feeding roller and the paper conveying roller section, and the roller-side projection does not overtake the gear-side projection before a state where the paper sheet is conveyed only by the paper conveying roller section.

5. The serial head type recorder according to claim 4, wherein letting Lp be the length in the direction of conveyance of the paper sheet, L be the length of a paper path from the paper feeding roller to the paper conveying roller section, Vc be the peripheral speed of the conveying roller, Df be the diameter of the paper feeding roller, Vf be the peripheral speed of the paper feeding roller in a case where the paper sheet is conveyed only by the paper feeding roller, and π be the ratio of the circumference of circle to its diameter, the following relationship is set:

$$\pi \times Df > (Lp - L) \times (1 - Vf/Vc).$$

* * * * *